US007135276B2

(12) United States Patent
Nariyuki

(10) Patent No.: US 7,135,276 B2
(45) **Date of Patent: *Nov. 14, 2006**

(54) PHOTOTHERMOGRAPHIC MATERIAL AND METHOD FOR PREPARING PHOTOSENSITIVE SILVER HALIDE EMULSION

(75) Inventor: Fumito Nariyuki, Kanagawa (JP)

(73) Assignee: Fuji Photo Film Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/958,546

(22) Filed: Oct. 6, 2004

(65) Prior Publication Data

US 2005/0079457 A1 Apr. 14, 2005

(30) Foreign Application Priority Data

Oct. 9, 2003 (JP) ..... 2003-350542
Oct. 27, 2003 (JP) ..... 2003-365841
Feb. 26, 2004 (JP) ..... 2004-051342

(51) Int. Cl.
*G03C 1/00* (2006.01)
*G03C 1/005* (2006.01)
*G03C 1/494* (2006.01)
*G03C 5/16* (2006.01)
*G03C 5/18* (2006.01)

(52) U.S. Cl. ..... 430/619; 430/617; 430/618; 430/620; 430/567; 430/348; 430/449; 430/569

(58) Field of Classification Search ..... 430/617, 430/618, 619, 620, 567, 348, 449, 569
See application file for complete search history.

(56) References Cited

U.S. PATENT DOCUMENTS 3,892,574 A 7/1975 Claes et al.
4,332,889 A 6/1982 Siga et al.
4,459,353 A 7/1984 Maskasky
4,490,458 A 12/1984 House
4,837,141 A 6/1989 Kohno et al.
4,845,020 A 7/1989 Itoh et al.
5,017,469 A 5/1991 Mowforth et al.
5,747,235 A 5/1998 Farid et al.
5,780,218 A 7/1998 Mifune et al.
5,958,668 A 9/1999 Matsumoto et al.
6,048,681 A 4/2000 Suzumoto et al.
6,083,680 A 7/2000 Ito et al.
6,120,983 A 9/2000 Okada et al.
6,143,488 A 11/2000 Uytterhoeven et al.
6,165,705 A 12/2000 Dankosh et al.
6,376,167 B1 4/2002 Ito
6,440,649 B1 8/2002 Simpson et al.
6,482,583 B1 11/2002 Ikari
6,576,410 B1 6/2003 Zou et al.
6,593,075 B1 7/2003 Ichikawa et al.
6,660,464 B1 12/2003 Muenter et al.
6,824,962 B1 11/2004 Oikawa
2002/0068247 A1 6/2002 Ihama et al.
2002/0150847 A1 10/2002 Ihama et al.
2002/0155401 A1 10/2002 Yamaguchi
2002/0197570 A1 12/2002 Ohzeki
2003/0091347 A1 5/2003 Goto et al.
2003/0138740 A1* 7/2003 Yamada ..... 430/350
2003/0190561 A1 10/2003 Kikuchi et al.
2003/0190565 A1 10/2003 Fujiwara et al.
2003/0207216 A1 11/2003 Fukui et al.
2003/0219684 A1 11/2003 Yabuki et al.
2003/0224299 A1 12/2003 Nariyuki
2003/0232288 A1* 12/2003 Oka et al. ..... 430/350
2004/0002022 A1 1/2004 Ii et al.
2004/0018457 A1 1/2004 Mifune
2004/0023175 A1 2/2004 Yamamoto
2004/0038160 A1 2/2004 Yanagi et al.
2004/0067459 A1 4/2004 Kikuchi et al.
2004/0081925 A1 4/2004 Oka et al.
2004/0081926 A1 4/2004 Nariyuki
2004/0096785 A1 5/2004 Nariyuki
2004/0131983 A1 7/2004 Ohzeki et al.
2004/0137389 A1 7/2004 Fukui et al.
2004/0152026 A1 8/2004 Mifune
2004/0202971 A1 10/2004 Sasaki et al.
2005/0058956 A1* 3/2005 Watanabe et al. ..... 430/567
2005/0069827 A1* 3/2005 Nariyuki et al. ..... 430/619
2005/0074707 A1 4/2005 Yamane et al.
2005/0118542 A1 6/2005 Mori et al.
2005/0208437 A1 9/2005 Ohzeki

FOREIGN PATENT DOCUMENTS

EP 1072948 A 1/2001

(Continued)

*Primary Examiner*—Geraldine Letscher
(74) *Attorney, Agent, or Firm*—Margaret A. Burke; Sheldon J. Moss

(57) ABSTRACT

The invention provides a photothermographic material containing a tabular photosensitive silver halide having an average silver iodide content of 40 mol % or higher, 50% or more of a total projected area of the photosensitive silver halide being occupied by tabular grains having an aspect ratio of 2 or more, the photosensitive silver halide grains having a mean equivalent spherical diameter of from 0.2 μm to 5 μm and a variation coefficient of an equivalent spherical diameter distribution of 30% or less. Further, a method for preparing the photosensitive silver halide used in the photothermographic material is characterized in that grains are formed in the presence of at least one selected from a silver halide solvent and an amino group-modified gelatin. A high-sensitivity photothermographic material exhibiting a low fog and a high optical density is provided.

25 Claims, No Drawings

FOREIGN PATENT DOCUMENTS

| | | |
|---|---|---|
| EP | 1422057 A | 5/2004 |
| JP | B 49-25498 | 7/1974 |
| JP | A 59-119344 | 7/1984 |
| JP | A 63-300234 | 12/1988 |
| JP | A 11-327078 | 11/1999 |
| JP | A 2000-171936 | 6/2000 |
| JP | A 2001-100356 | 4/2001 |
| JP | A 2001-272743 | 10/2001 |

* cited by examiner

PHOTOTHERMOGRAPHIC MATERIAL AND METHOD FOR PREPARING PHOTOSENSITIVE SILVER HALIDE EMULSION

CROSS-REFERENCE TO RELATED APPLICATION

This application claims priority under 35 USC 119 from Japanese Patent Application Nos. 2003-350542, 2003-365841 and 2004-51342, the disclosures of which are incorporated by reference herein.

BACKGROUND OF THE INVENTION

1. Field of the Invention

The present invention relates to a photographic silver halide emulsion, to a silver halide photosensitive material, and to a photothermographic material. More particularly, the invention relates to an ultrathin tabular photographic silver halide emulsion having an average silver iodide content of 40 mol % or higher, to a silver halide photosensitive material, and to a photothermographic material.

2. Description of the Related Art (Tabular Silver Iodide Grain)

Photosensitive silver halide emulsions for use in photographic technologies generally contain silver chloride, silver bromide, or a silver salt comprising a combination of chloride ion and bromide ion, to each of which a small amount of iodide is added.

Photosensitive silver iodide emulsions are rarely used in photographic technologies, but they are known in this technical field. Silver halide emulsions using grains containing silver iodide of different phases have been reported. Phosphoric acid silver iodide photographic emulsion resulting from coprecipitation of silver with iodide and phosphate has also been reported. However, there have been no reports on different silver iodide phases.

The crystal structure of silver iodide has been studied by crystallographers, especially those involved in photography. It is widely known that silver iodide can exist in three different crystal forms. A silver halide crystal in the most stable form is hexagonal wurtzite-type silver iodide, and is called β phase silver iodide. In addition, silver iodide in a face-centered cubic form, called γ phase silver iodide, is also stable at room temperature. Silver iodide in a body-centered cubic structure, which is stable only at temperatures of about 147° C. or higher and is called α phase silver iodide, also exists.

Regarding the shape of silver iodide grains, many shapes have been reported and tabular silver iodide crystals have been observed. With regard to the method for preparing tabular silver iodine crystals, a preparation method using an excess amount of iodine ions which yields a hexagonal crystal structure composed mainly of β phase silver iodide has been reported.

Concerning tabular silver iodide having a high aspect ratio, a method for preparing tabular silver iodide having a face-centered crystal structure, a thickness of less than 0.3 μm, and an average aspect ratio of 8 or more has been reported as disclosed in Japanese Patent Application Laid-Open (JP-A) Nos. 59-119344 and 59-119350. As a particularly desirable method, disclosed is a method in which the pAg is kept in a range from 1.0 to 2.0 during precipitation of silver iodide and the temperature in the reaction vessel is kept in a range of from 30° C. to 50° C.

A photosensitive silver halide is required to have grains in a uniform average grain size and uniform shape. To realize stable photographic properties and express the photographic characteristic of gradation as required according to applications, grains with these uniform distributions have generally been prepared and, when necessary, mixed or layered.

(Photothermographic Material)

In recent years, in the medical field and the graphic arts field, there has been a strong desire for a dry photographic process from the viewpoints of environmental conservation and economy of space. Further, the development of digitization in these fields has resulted in the rapid development of systems in which image information is captured and stored in a computer, and then when necessary processed and outputed by communicating it to a desired location where the image information is outputed onto a photosensitive material using a laser image setter or a laser imager, and developed to form an image at the location on the photosensitive material. It is necessary for the photosensitive material to be able to record an image with high-intensity laser exposure and that a clear black-tone image with a high resolution and sharpness can be formed.

While various kinds of hard copy systems using a pigment or a dye, such as ink-jet printers or electrophotographic systems, have been distributed as general image forming systems using such digital imaging recording material, images in the digital imaging recording material obtained by such a general image forming system are insufficient in terms of image quality (sharpness, granularity, gradation, tone) needed for medical images used in making diagnoses and high recording speed (sensitivity). These kinds of digital imaging recording materials have not reached a level at which they can replace medical silver halide film processed with conventional wet development.

A thermographic system using an organic silver salt has already been known. This system has an image forming layer including a reducible silver salt (for example, an organic silver salt), a photosensitive silver halide, and if necessary, a toner for controlling the color tone of silver, dispersed in a binder.

A photothermographic material forms a black silver image by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed on the exposed region. There is much literature in which photothermographic materials are described, and the Fuji Medical Dry Imager FM-DP L is an example in practice of a medical image forming system using a photothermographic material that has been marketed.

Since this kind of image forming system utilizing an organic silver salt has no fixing step, undeveloped silver halide remains inside the film after thermal development. Thus, there have intrinsically been two serious problems in the system.

One problem is that of instability in preserving an image after a thermal developing process, particularly fogging due to print-out when the material is exposed to light. As a way to improve the print-out, a method making use of silver iodide is known. However, the sensitivity of silver iodide grains known until now is extremely low, and silver iodide grains do not achieve a level of sensitivity that can be used in an actual system. And when a measure for preventing recombination between photoelectrons and positive holes is effected to improve the sensitivity, there is an inherent problem that the characteristic of having good print-out resistance will be lost.

As a way of increasing the sensitivity of a silver iodide photographic emulsion, academic literature discloses, for example, using a halogen acceptor such as sodium nitrite, pyrogallol, or hydroquinone, or immersion in an aqueous silver nitrate solution, or sulfur sensitization at a pAg of 7.5, and the like. However, the sensitization effect of these halogen acceptors is very small and extremely insufficient for use in photothermographic materials of the invention.

Another problem is that light scattering due to the remaining silver halide grains may cause cloudiness whereby the film turns translucent or opaque and image quality is degraded. To solve this problem, ways in which the grain size of photosensitive silver halide grains is made fine (to within a range of practical use of 0.08 μm to 0.15 μm) and the addition amount is reduced as much as possible to suppress the cloudiness caused by the silver halide have been practically employed. However, the compromise results in decreasing the sensitivity further, the problem of cloudiness is neither completely solved, and a dark milky color continues to remain and generate haze in the film.

In the case of a conventional wet developing process, the remaining silver halide is removed by processing with a fixing solution containing a silver halide solvent after the developing process. For the silver halide solvent, many kinds of inorganic and organic compounds are known which can form complexes with silver ions.

Even in the case of a dry thermal developing process, many attempts to introduce similar fixing measures in the material have been made. For example, a method has been proposed where a compound capable of forming complexes with silver ions is incorporated in the film and the silver halide is solubilized (usually referred to as fixing) through thermal development. However, this proposal only applies to silver bromide and silver chlorobromide, and the process also requires an additional heat treatment step for fixing, and the heating conditions require a high temperature within a range of 155° C. to 160° C. Thus, the system is one in which fixing is difficult to achieve.

In another proposal, a separate sheet (referred to as a fixing sheet) that includes a compound able to form complexes with silver ions is prepared, and after thermally developing the photothermographic material to form an image, the fixing sheet is overlaid on the developed photothermographic material, heating is carried out and the remaining silver halide is dissolved and removed. However, since this proposal requires two sheets, from a practical viewpoint the obstacles are that the processing step is complicated and the operational stability of the process is hard to maintain, and that there is a necessity to discard the fixing sheets after processing, resulting in generation of waste.

As another fixing method usable in thermal development, a method is proposed where a fixing agent for the silver halide is encapsulated in microcapsules, and thermal development releases the fixing agent and causes it to act. However, it is difficult to achieve a design that effectively releases the fixing agent. A method for fixing using a fixing solution after thermal development is also proposed, but it requires a wet process and therefore is not adequate for a completely dry process.

As described above, known methods for improving the turbidity of film have negative effects, and there have been substantial difficulties in their practical application.

Attempts have also been made at applying the above-mentioned photothermographic material as photosensitive material for photographing. The "photosensitive material for photographing" as used herein means a photosensitive material on which images are recorded by a one-shot exposure through a lense, rather than by writing the image information by a scanning exposure with a laser beam or the like. Conventionally, photosensitive materials for photographing are generally known in the field of wet developing photosensitive materials, and include films for medical use such as direct or indirect radiography films and mammography films, various kinds of photomechanical films used in printing, industrial recording films, films for photographing with general-purpose cameras, and the like.

For example, an X-ray photothermographic material coated on both sides containing tabular silver iodobromide grains using a blue fluorescent intensifying screen is described in JP-A No. 59-142539. As another example, a photosensitive material for medical use containing tabular grains that have a high content of silver chloride and have (100) major faces, and that are coated on both sides of a support, is described in JP-A No. 10-282606. Double-sided coated photothermographic materials are also disclosed in other patent documents. However, according to these known examples, although fine particle silver halide grains having a grain size of 0.1 μm or less do not cause further hazing, the sensitivity is very low. These grains are therefore not usable for practical applications in photographing. And conversely, when using silver halide grains having a grain size of 0.3 μm or more, because the remaining silver halide increases the degree of haze and adversely affects the print-out, there is severe deterioration of the image quality, and the grains are not usable for practical applications.

Photosensitive materials containing tabular silver iodide grains serving as the silver halide grains are well known in the wet developing field, but there have been no examples of applications thereof in a photothermographic material. The reasons are that, as mentioned above, the sensitivity is low, there is no effective sensitization method, and the technical barriers are even higher in thermal development.

To be usable for this kind of photosensitive material for photographing, the photothermographic material needs a higher degree of sensitivity as well as an even higher level of image quality with respect, for example, to the degree of haze of the obtained image.

SUMMARY OF THE INVENTION

A first aspect of the invention is to provide a photothermographic material containing, on at least one surface of a support, at least a photosensitive silver halide, a non-photosensitive organic silver salt, a reducing agent and a binder, wherein the material contains a compound capable of reducing light absorption by the photosensitive silver halide after thermal development, and wherein the photosensitive silver halide has an average silver iodide content of 40 mol % or higher, 50% or more of a total projected area of the photosensitive silver halide is occupied by tabular grains having an aspect ratio of 2 or more, and a mean equivalent spherical diameter of the photosensitive silver halide grains is from 0.2 μm to 5 μm and a variation coefficient of an equivalent spherical diameter distribution of the photosensitive silver halide grains is 30% or less.

A second aspect of the invention is to provide a method for preparing the photosensitive silver halide for use in the photothermographic material according to the first aspect, wherein grains are formed in the presence of at least one substance selected from an amino group-modified gelatin in which 20% or more of all of the amino groups are modified and a silver halide solvent.

DETAILED DESCRIPTION OF THE INVENTION

The inventors set forth to produce a photothermographic material that exhibits excellent image quality with high sensitivity and low haze. As a result of their efforts, the inventors found that the purpose was attained by a photothermographic material containing a photosensitive silver halide having an average silver iodide content of 40 mol % or higher and a compound capable of reducing light absorption by the photosensitive silver halide after thermal development. And further, the inventors found that a high sensitivity and an effective reduction of light absorption by the photosensitive silver halide through thermal development were accomplished by the shape of silver halide grains and the preparation method thereof. The inventors thus reached the solution to the task of the present invention.

Specifically, first was to obtain monodispersed tabular silver halide grains having a high silver iodide content. It was very difficult to form tabular silver halide grains having a high silver iodide content that were tabular grains with uniform shape, grain size distribution, and other characteristics. Well-known procedures for preparing silver bromide grains, or silver iodobromide grains having a low silver iodide content of 5 mol % or less, resulted in a broad distribution of grain sizes, for example, of equivalent spherical diameters or equivalent circular diameters, and also a broad distribution of grain thicknesses.

From the analyses of the inventors, it was supposed that there is a completely different mechanism in the tabular grain formation between silver halide grains having a high silver iodide content and silver bromide grains or silver iodobromide grains having a low silver iodide content of 5 mol % or less. Specifically, in the case of silver iodobromide grains having a low silver iodide content of 5 mol % or less, the tabular grains are formed by crystal growth based on the twin planes of seed grains. Therefore, control of crystal growth on the twin planes was the key to the formation of the tabular grains, and thus, conventionally known control conditions were applicable. However, in the case of silver halide grains having a high silver iodide content, the conventional techniques were assumed to be ineffective.

Based on these analytical results, the inventors succeeded in forming silver halide grains having a high silver iodide content that were tabular grains with uniform grain size and shape distribution.

Secondly, the inventors found that the tabular grains having a high silver iodide content were formed under specific conditions. Specifically, the grain formation was carried out in the presence of at least one substance selected from an amino group-modified gelatin in which 20% or more of all of the amino groups are modified and a silver halide solvent. A photothermographic material having high sensitivity and exhibiting extremely low haze after thermal development was thereby attained.

The present invention will be described in detail below.

1. Silver Halide Emulsion

1) Halogen Composition

The photosensitive silver halide used in the present invention has a silver iodide content of 40 mol % or higher. Other components are not particularly limited and can be selected from silver halide such as silver chloride, silver bromide and the like, and organic silver salts such as silver thiocyanate, silver phosphate and the like, and particularly, silver bromide and silver chloride are preferable. By using such a silver halide having a high silver iodide content, a preferable photothermographic material having excellent image storability after developing process, particularly showing remarkably small increase in fogging in irradiation with light can be designed.

Further, it is preferable that the silver iodide content is 80 mol % or higher, and it is extremely preferable from the standpoint of image storability against irradiation with light after developing process particularly when the silver iodide content is 90 mol % or higher.

The distribution of the halogen composition in a grain may be uniform or the halogen composition may be changed stepwise, or it may be changed continuously. Further, a silver halide grain having a core/shell structure can be preferably used. Preferred structure is a twofold to fivefold structure and, more preferably, core/shell grain having a twofold to fourfold structure can be used. A core-high-silver iodide-structure which has a high content of silver iodide in the core part, and a shell-high-silver iodide-structure which has a high content of silver iodide in the shell part can also be preferably used.

Further, a technique of localizing silver bromide or silver iodide on the surface of a grain as form epitaxial parts can also be preferably used.

Silver halide having a high silver iodide content of the invention can assume any of a content of β phase or γ phase. The term "β phase" described above means a high silver iodide structure having a wurtzite structure of a hexagonal system and the term "γ phase" means a high silver iodide structure having a zinc blend structure of a cubic crystal system.

A content of γ phase in the present invention is determined by a method presented by C. R. Berry. In the method, a content of γ phase is calculated from the peak ratio of the intensity owing to γphase (111) to that owing to β phase (100), (101), (002) in powder X-ray diffracting method. Detail description, for example, is described in Physical Review, volume 161, No. 3, pages 848 to 851 (1967).

2) Grain Size

Concerning the photosensitive silver halide grains used in the present invention, any grain size enough to reach the required high sensitivity can be selected.

In the present invention, the mean equivalent spherical diameter of the silver halide is 0.2 μm to 5.0 μm, preferably 0.3 μm to 3.0 μm, and more preferably 0.35 μm to 3.0 μm. A variation coefficient of an equivalent spherical diameter distribution is 30% or less, preferably 25% or less, and more preferably 20% or less.

The term "equivalent spherical diameter" used here means a diameter of a sphere having the same volume as the volume of one silver halide grain. As for measuring method, the volume of a grain is calculated from projected area and thickness of individual grains by observation through electron microscope, and thereafter the equivalent spherical diameter is determined by converting the volume to a sphere having the volume equivalent to the obtained volume.

In the present invention, a mean equivalent circular diameter of the silver halide is 0.2 μm to 5.0 μm, preferably 0.4 μm to 3.0 μm, and more preferably 0.6 μm to 3.0 μm. A variation coefficient of an equivalent circular diameter distribution is 30% or less, preferably 25% or less, and more preferably 20% or less.

The term "equivalent circular diameter" used here means a diameter of a circle having the same area as the projected area of one silver halide grain. As for measuring method, the area of a grain is calculated from projected area of individual grains by observation through electron microscope, and thereafter the equivalent circular diameter is determined by converting the area to a circle having the area equivalent to the obtained area.

The mean thickness of the silver halide grain used in the invention is preferably from 0.01 μm to 0.2 μm, more preferably from 0.01 μm to 0.1 μm, and further preferably from 0.01 μm to 0.06 μm.

3) Grain Form

The form of silver halide grains used in the present invention is tabular grains having an aspect ratio of 2 or more.

In detail, tabular octahedral grains, tabular tetradecahedral grains and tabular icosahedral grains, spherical grains can be described from the structure of side surface. Tabular octahedral grains and tabular tetradecahedral grains are more preferable. The term "tabular octahedral grain" means a grain having faces of {0001}, {1(−1)00}, or a grain having faces of {0001}, {1(−2)10} and {(−1)2(−1)0}, the term "tabular tetradecahedral grain" means a grain having faces of {0001}, {1(−1)00} and {1(−1)01}, a grain having faces of {0001}, {1(−2)10}, {(−1)2(−1)0}, {1(−2)11} and {(−1)2(−1)1}, a grain having faces of {0001}, {1(−1)00} and {1(−1)0(−1)}, or a grain having faces of {0001}, {1(−2)10}, {(−1)2(−1)0}, {1(−2)1(−1)} and {(−1)2, (−1) (−1)}. The term "tabular icosahedral grain" means a grain having faces of {0001}, {1(−1)00}, {1(−1)01} and {1(−1)0(−1)}, or a grain having faces of {0001}, {1(−2)10}, {(−1)2(−1)0}, {1(−2)11}, {(−1)2(−1)1}, {1(−2)1(−1)} and {(−1)2(−1)(−1)}. Herein, the face {0001} express a family of crystallographic faces equivalent to {0001} face.

Tabular silver halide grains having a shape other than mentioned above may be used preferably.

The aspect ratio of the tabular grain is in the range from 2 to 200, preferably from 5 to 200, and further preferably from 8 to 200.

The silver halide grains having a high silver iodide content used in the present invention may have more complicated form, however as preferred form, grains obtained by rounding corners of silver halide grains can also be preferably used. In this case, the surface index (Mirror index) of the outer surface of a photosensitive silver halide grain is not particularly restricted. Especially concerning the surface index of the major faces which consist outer surfaces, the surface index can be determined by forming a structure of known crystal azimuth on the grain surface, for example, forming an epitaxial junction with silver bromide grain.

4) Method of Grain Formation

The method of forming photosensitive silver halide is well-known in the relevant art and, for example, methods described in Research Disclosure No. 10729, June 1978, and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used.

Further, a method described in JP-A No. 11-119374 (paragraph Nos. 0217 to 0224) and methods described in JP-A Nos. 11-352627 and 2000-347335 are also preferred.

As for the method of forming tabular grains of silver iodide, the method described in JP-A Nos. 59-119350 and 59-119344 are preferably used.

In the preparation of silver halide used in the present invention where the grain formation step usually comprises nucleation step, ripening step and grain growth step, especially low gelatin concentration in the nucleation step is preferred.

The preferred gelatin concentration can be adjusted to be the suitable concentration depending on the kind and other factor of gelatin used. The gelation concentration is preferably in the range from 0.5 g to 15 g per 1 liter of water, and more preferably from 1 g to 10 g per 1 liter of water. When the gelatin concentration is too high, the unevenness of the gelatin adsorption to control grain growth remarkably increase and then the uniformly nucleation would be prevented thereby. Moreover, the unevenness of the gelatin adsorption would prevent the Ostwald ripening of non-tabular nuclei in ripening step, and then undesirable non-tabular grains may be included in the emulsion.

As far as the grains grow uniformly in the nucleation and ripening steps, the concentration of gelatin used during the grain growth is not particularly limited. However in order to avoid the undesirable grain aggregation where the grain size increases with the grain growth, the gelatin concentration enough to keep the protective colloid action during the grain growth is preferred.

5) Silver Halide Solvent

One of the preparing methods of silver halide in the present invention is to form grains in the presence of silver halide solvent.

As a silver halide solvent, well-known compounds can be used. Preferred silver halide solvent is the compound containing at least one atom in a molecule selected from sulfur atom, selenium atom and tellurium atom. More preferable silver halide solvent is the compound having the structure represented by formulae (I) and (II) described below.

$$L_{a1}\text{-}(A_{a1}\text{-}L_{a2})r\text{-}A_{a2}\text{-}L_{a3} \qquad \text{Formula (I)}$$

In formula (I), $L_{a1}$ and $L_{a3}$ each independently represent one selected from an aliphatic group, an aromatic hydrocarbon group, and a heterocyclic group, and $L_{a2}$ represents one selected from a divalent aliphatic group, a divalent aromatic hydrocarbon group, a divalent substituted or unsubstituted heterocyclic linking group, and a linking group made up of a combination thereof. $A_{a1}$ and $A_{a2}$ each independently represent one selected from —S—, —Se—, —Te—, —O—, —$NR_{a20}$—, —CO—, —$SO_2$—, and a group made up of a combination thereof. r represents an integer from 0 to 10. Further, $L_{a1}$ and $L_{a3}$ may be substituted by one selected from —$SO_3M_{a1}$, —$PO_3M_{a2}M_{a3}$, —$NR_{a1}(R_{a2})$, —$N^+R_{a3}(R_{a4})(R_{a5})X_{a1}^-$, —$SO_2N(R_{a6})(R_{a7})$, —$NR_{a8}SO_2R_{a9}$, —$CONR_{a10}(R_{a11})$, —$NR_{a12}COR_{a13}$, —$SO_2R_{a14}$, —PO(—$NR_{a15}(R_{a16}))_2$, —$NR_{a17}CONR_{a18}(R_{a19})$, —$COOM_{a4}$, and a heterocyclic group. $M_{a1}$, $M_{a2}$, $M_{a3}$, and $M_{a4}$ may be the same or different, and each represents one selected from a hydrogen atom and a counter cation. $R_{a1}$ to $R_{a20}$ each independently represent one selected from a hydrogen atom, an aliphatic group, and an aromatic hydrocarbon group, and $X_{a1}^-$ represents a counter anion. However, at least one of $A_{a1}$ and $A_{a2}$ represents one selected from —S—, —Se—, and —Te—.

Formula (II)

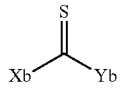

In formula (II), $X_b$ and $Y_b$ each independently represent one selected from an aliphatic group, an aromatic hydrocarbon group, a heterocyclic group, —$N(R_{b1})R_{b2}$, —$N(R_{b3})N(R_{b4})R_{b5}$, —$OR_{b6}$, and —$SR_{b7}$. $X_b$ and $Y_b$ may form a ring. $X_b$ and $Y_b$ may be substituted by one selected from the group consisting of a carboxylic acid, a salt thereof, a sulfonic acid, a salt thereof, an amino group, an ammonium group, and a hydroxy group. $R_{b1}$, $R_{b2}$, $R_{b3}$, $R_{b4}$, and $R_{b5}$ represent one selected from a hydrogen atom, an aliphatic group, an aromatic hydrocarbon group, and a heterocyclic group. $R_{b6}$ and $R_{b7}$ each independently represent one selected from a hydrogen atom, a cation, an aliphatic group, an aromatic hydrocarbon group, and a heterocyclic group.

The addition amount of silver halide solvent preferably is from 0.01 mol to 20 mol per 1 mol of silver halide, more preferably from 0.01 mol to 10 mol, still more preferably from 0.02 mol to 5 mol per 1 mol of silver halide.

As an adding method of silver halide solvent, the method in which a silver halide solvent is added in a reaction vessel before the addition of silver ion and halide ion, the method in which a silver halide solvent is added after definite amount of silver ion and halide ion are added and then silver ion and halide ion are further added, and the method in which a silver halide solvent is added during the addition of silver ion and halide ion in a reaction vessel, are preferably used. The methods in which a silver halide solvent is mixed and added to a silver ion solution or a silver halide solution or both of a silver ion solution and a silver halide solution, are also preferably used.

Specific examples of silver halide solvents represented by formula (I) and (II) of the present invention and others are shown below, however the present invention is not limited in these.

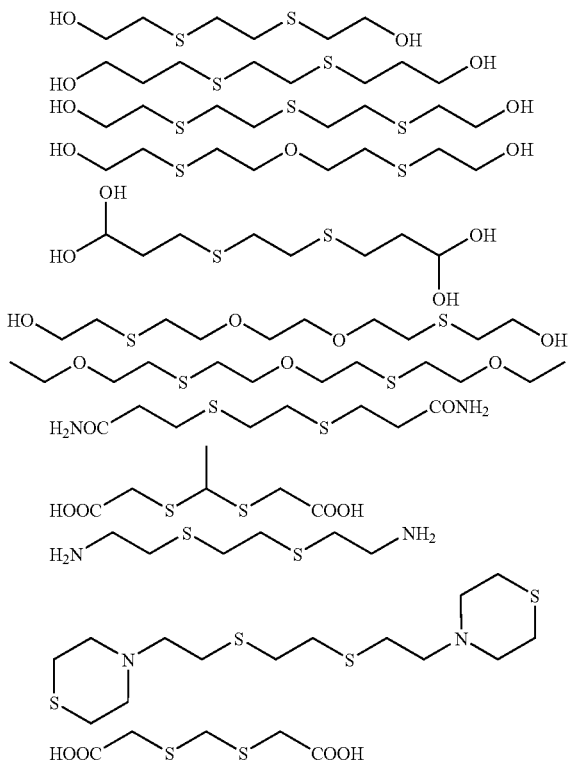

-continued

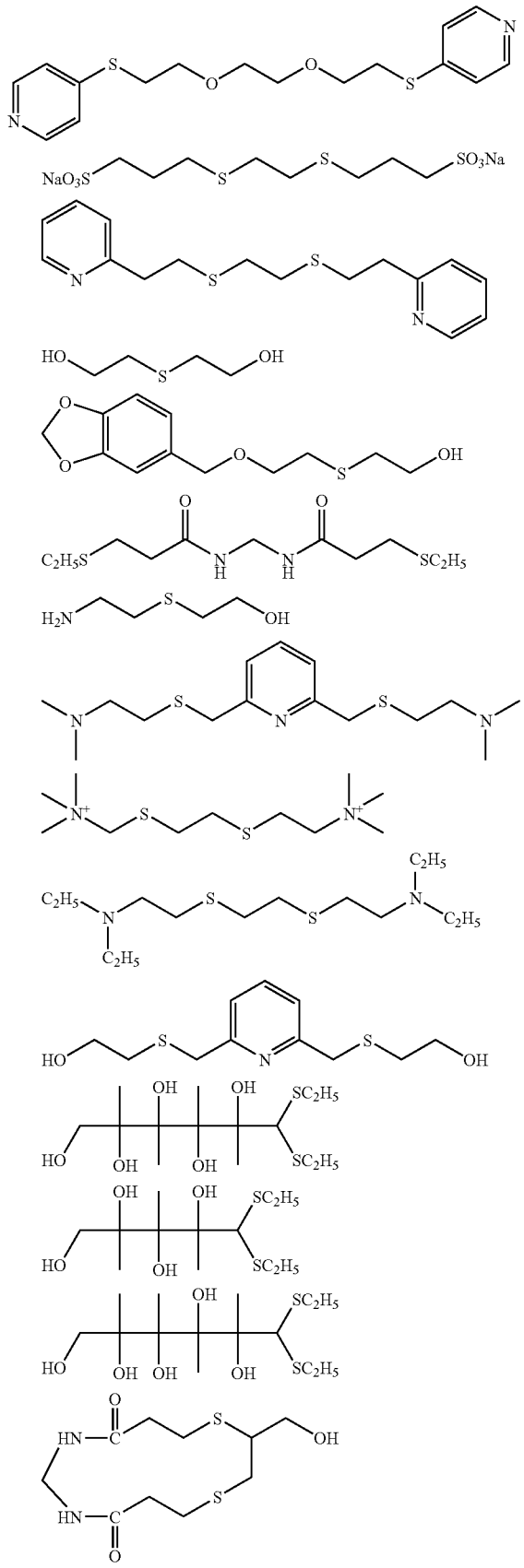

-continued

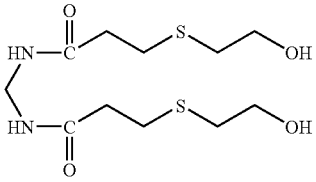

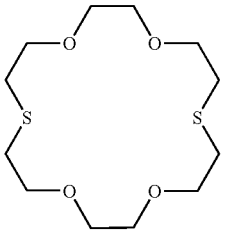

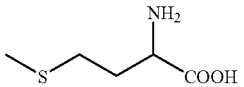

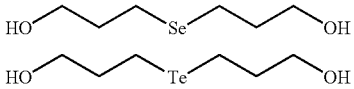

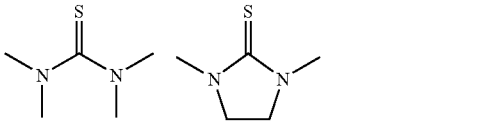

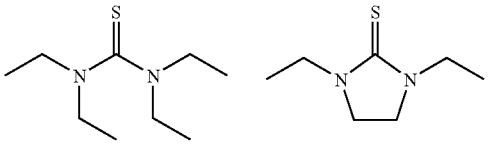

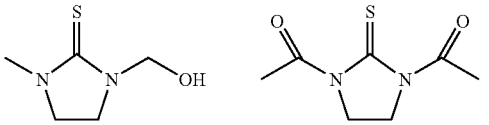

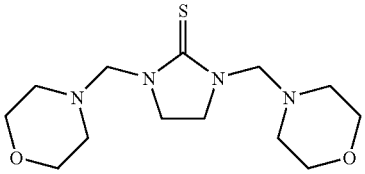

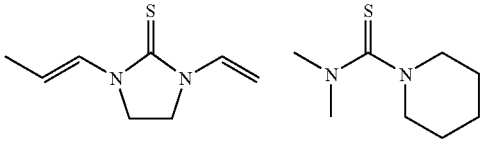

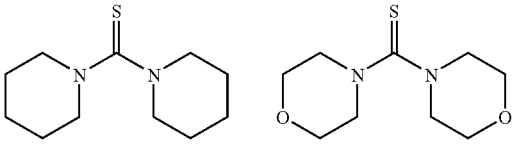

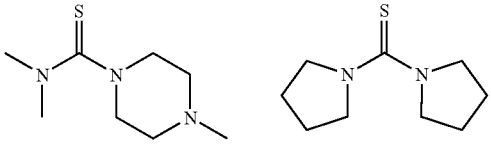

-continued

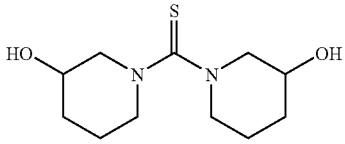

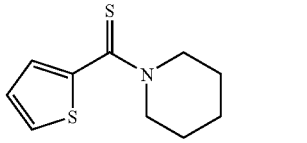

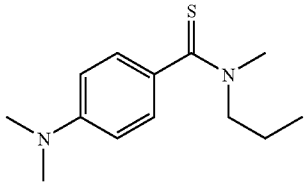

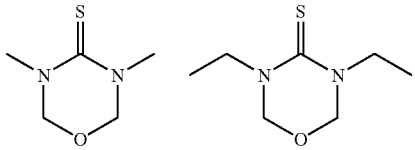

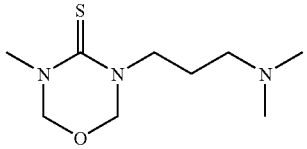

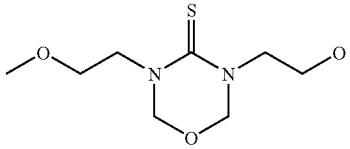

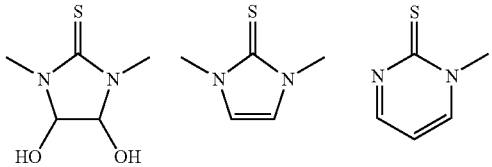

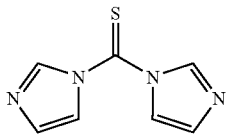

6) Gelatin

Another method of preparing silver halide in the present invention is to form grains in a presence of an amino group-modified gelatin in which 20% or more of all of the amino groups are modified.

In the present invention, plural gelatins containing modified amino groups, and the mixture of amino group-modified gelatin and gelatin containing unmodified amino groups may be used. In the invention, the ratio of modified amino groups is 20% or more of all of the amino groups in gelatin, preferably 40% or more of all of the amino groups, and more preferably 60% or more of all of the amino groups.

In the present invention, the method for modifying gelatin preferably is phthalation, succination, trimellitation and pyromellitation, and particularly preferably phthalation and succination.

The amino group-modified gelatin preferably used in the present invention is described.

The amino group-modified gelatin which is used for forming silver bromide tabular grain is described in JP-A No. 8-82883. Depending on the said description, a tabular grain having small thickness can be obtained by conversion of a primary amino group (—$NH_2$—) to a secondary amino group (—NH—) or a tertiary amino group, or deamination. And it is described that an amino group is modified and one —COOH group is introduced instead of one —$NH_2$ group by the reaction of an acid anhydride, for examples, phtahalic anhydride, succinic anhydride and maleic anhydride.

In the present invention, the inventors had payed attention to this introduction of —COOH group. When the introduction number of —COOH group was increased, the effect that the thickness of tabular grain was further decreased was observed.

This phenomenon is considered as follows.

Usually, a carboxyl group (—COOH group) is isolated in pH 4 or more to become —$COO^-$. Generally, it is considered that the grain formation of silver halide is performed in an excess region of halide ion with respect to silver ion and halide ions adsorb to the surfaces of silver halide grains (E. Moisar and E. Klein, Bunesenges. Phys. Chem., vol. 67, page 949 (1963)). Therefore, it is considered that an adsorption of gelatin molecule to a silver halide grain decreases because —$COO^-$ charged in negative in a gelatin molecule and a halogen ion of the silver halide surface repulse (Suzuki, Morita and Nishio, Journal of The Society of Photographic Science and Technology of Japan, vol. 58, page 25 (1995)).

By taking into consideration that the transverse direction growth of a tabular grain changes depending on the adsorption power of gelatin, it is considered that the thickness of a tabular grain becomes smaller when the adsorption power of gelatin is decreased.

The inventors found that the amino group-modified gelatin is effective to decrease the thickness of tabular grain. It is assumed from the crystal structure that the tabular grain of silver iodide differs from the tabular grain of silver bromide at the structure of side plane and also in the main plane, the structure differs in the front and the reverse side. Therefore, it is considered that the effect of reducing the thickness of tabular grain is obtained according to a different mechanism from silver bromide.

As the typical method of introducing —COOH group, there is a method of modifying an amino group (—$NH_2$) by the addition of a reaction agent to gelatin. As a reaction agent, examples are described below, however the invention is not limited in these.

(1) The compound having 2 or more —COOH groups and form at least one acid anhydride by its structure; for example, maleic anhydride, phthalic anhydride, succinic anhydride, trimellitic anhydride, pyromellitic anhydride and mellitic anhydride are described.

(2) The compound having 2 or more —COOH groups and having one or more isocyanate in its structure; for example, phenylisocyanate and the like are described.

(3) The compound having 2 or more —COOH groups and having one or more aldehyde or ketone in its structure.

(4) The compound having 2 or more —COOH groups and having one or more imidoester in its structure.

And there is a case where gelatin molecules are crosslinked to have a high molecular weight at the reaction of amino modification. For example, there is a case where at the manufacturing of pyromellitated gelatin, gelatin molecules are crosslinked by the change of reaction condition such as gelatin concentration and the like.

In the present invention, it may be or may not be necessary to make gelatin molecule have a high molecular weight at such amino modification.

The preparation examples of modified gelatin in the present invention are described below, however the invention is not limited in these.

Concerning the modification of amino group, various techniques are developed for many years and the descriptions of the following literatures, JP-A Nos. 4-226449, 50-3239, U.S. Pat. Nos. 2,525,753, 2,614,928, 2,614,929, 2,763,639, 2,594,293 and 319,45, Yoshihiro Abiko, NIKAWA TO ZERATIN, chapter 2, NIPPON NIKAWA ZERATIN KOGYO KUMIAI (1987), Ward et al, The Science and Technology of Gelatin, chapter 7, Academic Press (1977) can be referred.

The percentage of chemical modification of —$NH_2$ group in the said modified gelatin can be calculated as following.

Both of the gelatin without the said modification and the gelatin with the said modification are prepared, and the numbers of —$NH_2$ group in both gelatins are calculated as $e_1$ and $e_2$. The percentage of chemical modification can be calculated from $100\times(e_1-e_2)/e_1$. As the calculating method of the said $e_1$ and $e_2$, the methods of using an infrared absorption intensity based on —$NH_2$ group, a NMR signal intensity of the said proton, a color reaction and a fluorescence reaction can be described and a description in "BUNSEKI KAGAKU BINRAN", organic section-2, MARUZEN (1991) can be referred in detail. In addition, quantifying methods such as a change of titration curve of gelatin and formol titration method can be described and a description in "The Science and Technology of Gelatin", Chapter 15, Academic Press (1977) can be referred in detail. And in addition, a method to calculate the percentage by colorimetry after measuring a spectral absorption intensity in the neighborhood of 450 nm by coloring with addition of the mixture of gultaraldehyde and Britton-Robinson high pH buffer solution to a gelatin solution having defined concentration [a description in "Photographic Gelatin II", pp 297 to 315, Academic Press (1976) can be referred] can be described.

As the preparating method of trimellitated gelatin which is one of gelatin in the present invention, the following method described in Journal of The Society of Photographic Science and Technology of Japan, vol. 58, page 25 (1995) can be referred.

After arranging the pH of 15% gelatin aqueous solution kept at a temperature of 60° C. to 9.0, trimellitic anhydride was added. Reaction was performed for 1 hour and during the reaction the pH was kept from 8.75 to 9.25. After the reaction was finished, a deionizing treatment was performed by ultrafiltration. After arranging the pH to 6.0, gelatin powders were obtained by drying.

And one example of preparating pyromellitated gelatin which is one of the gelatins in the present invention is shown below. After arranging pH of 15% gelatin aqueous solution kept at a temperature of 60° C. to 9, pyromellitic anhydride was added. Reaction was performed for 1 hour, and during the reaction pH was kept from 8.75 to 9.25. After the reaction was finished, a deionizing tratment process was performed by ultrafiltration. After arranging pH to 6.0, gelatin powders were obtained by drying.

And as for phthalated gelatin and succcinated gelatin, gelatin powders can be obtained by a similar manner to the preparation described above.

7) Heavy Metal

The photosensitive silver halide grain of the invention can contain metals or complexes of metals belonging to groups 8 to 10 of the periodic table (showing groups 1 to 18). The metal or the center metal of the metal complex from groups 8 to 10 of the periodic table is preferably rhodium, ruthenium or iridium. The metal complex may be used alone, or two or more kinds of complexes containing identical or different species of metals may be used together. A preferred content is in the range from $1\times10^{-9}$ mol to $1\times10^{-3}$ mol per 1 mol of silver. The heavy metals, metal complexes and the adding method thereof are described in JP-A No. 7-225449, in paragraph Nos. 0018 to 0024 of JP-A No. 11-65021 and in paragraph Nos. 0227 to 0240 of JP-A No. 11-119374.

In the present invention, a silver halide grain having a hexacyano metal complex that is present on the outermost surface of the grain is preferred.

The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

The hexacyano metal complex can be added while being mixed with water, as well as a mixed solvent of water and an appropriate organic solvent miscible with water (for example, alcohols, ethers, glycols, ketones, esters and amides) or gelatin.

The addition amount of the hexacyano metal complex is preferably from $1\times10^{-5}$ mol to $1\times10^{-2}$ mol per 1 mol of silver, and more preferably from $1\times10^{-4}$ mol to $1\times10^{-3}$ mol per 1 mol of silver.

In order to allow the hexacyano metal complex to be present on the outermost surface of a silver halide grain, the hexacyano metal complex is directly added in any stage of: after completion of addition of an aqueous solution of silver nitrate used for grain formation, before completion of emulsion formation step prior to a chemical sensitization step, of conducting chalcogen sensitization such as sulfur sensitization, selenium sensitization and tellurium sensitization or noble metal sensitization such as gold sensitization, during washing step, during dispersion step and before chemical sensitization step. In order not to grow the fine silver halide grain, the hexacyano metal complex is preferably rapidly added after the grain is formed, and it is preferably added before completion of the emulsion formation step.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No.11-84574, in paragraph Nos. 0025 to 0031 of JP-A No.11-65021, and paragraph Nos. 0242 to 0250 of JP-A No.11-119374.

8) Chemical Sensitization

The photosensitive silver halide in the present invention can be used without chemical sensitization, but is preferably chemically sensitized by at least one of chalcogen sensitizing method, gold sensitizing method and reduction sensitizing method. The chalcogen sensitizing method includes sulfur sensitizing method, selenium sensitizing method and tellurium sensitizing method.

In sulfur sensitization, unstable sulfur compounds can be used. Such unstable sulfur compounds are described in Chimie et Pysique Photographique, written by P. Grafkides, (Paul Momtel, 5th ed., 1987) and Research Disclosure (vol. 307, Item 307105), and the like.

As typical examples of sulfur sensitizer, known sulfur compounds such as thiosulfates (e.g., hypo), thioureas (e.g., diphenylthiourea, triethylthiourea, N-ethyl-N'-(4-methyl-2-thiazolyl)thiourea and carboxymethyltrimethylthiourea), thioamides (e.g., thioacetamide), rhodanines (e.g., diethylrhodanine, 5-benzylydene-N-ethylrhodanine), phosphinesulfides (e.g., trimethylphosphinesulfide), thiohydantoins, 4-oxo-oxazolidin-2-thione derivatives, disulfides or polysulfides (e.g., dimorphorinedisulfide, cystine, hexathiocanthione), polythionates, sulfur element and active gelatin can be used. Specifically, thiosulfates, thioureas and rhodanines are preferred.

In selenium sensitization, unstable selenium compounds can be used. These unstable selenium compounds are described in JP-B Nos. 43-13489 and 44-15748, JP-A Nos. 4-25832, 4-109340, 4-271341, 5-40324, 5-11385, 6-51415, 6-175258, 6-180478, 6-208186, 6-208184, 6-317867, 7-92599, 7-98483, and 7-140579, and the like.

As typical examples of selenium sensitizer, colloidal metal selenide, selenoureas (e.g., N,N-dimethylselenourea, trifluoromethylcarbonyl-trimethylselenourea and acetyltrimethylselemourea), selenamides (e.g., selenamide and N,N-diethylphenylselenamide), phosphineselenides (e.g., triphenylphosphineselenide and pentafluorophenyltriphenylphosphineselenide), selenophosphates (e.g., tri-p-tolylselenophosphate and tri-n-butylselenophosphate), selenoketones (e.g., selenobenzophenone), isoselenocyanates, selenocarbonic acids, selenoesters, diacylselenides can be used. Furthermore, non-unstable selenium compounds such as selenius acid, selenocyanic acid, selenazoles and selenides described in JP-B Nos. 46-4553 and 52-34492 can also be used. Specifically, phosphineselenides, selenoureas and salts of selenocyanic acids are preferred.

In the tellurium sensitization, unstable tellurium compounds are used. Unstable tellurium compounds described in JP-A Nos.4-224595, 4-271341, 4-333043, 5-303157, 6-27573, 6-175258, 6-180478, 6-208186, 6-208184, 6-317867, 7-140579, 7-301879, 7-301880 and the like, can be used as tellurium sensitizer.

As typical examples of tellurium sensitizer, phosphinetellurides (e.g., butyl-diisopropylphosphinetelluride, tributylphosphinetelluride, tributoxyphosphinetelluride and ethoxy-diphenylphosphinetellride), diacyl(di)tellurides (e.g., bis(diphenylcarbamoyl)ditelluride, bis(N-phenyl-N-methylcarbamoyl)ditelluride, bis(N-phenyl-N-methylcarbamoyl)ditelluride, bis(N-phenyl-N-benzylcarbamoyl)telluride and bis(ethoxycarmonyl)telluride), telluroureas (e.g., N,N'-dimethylethylenetellurourea and N,N'-diphenylethylenetellurourea), telluramides, telluroesters are used. Specifically, diacyl(di)tellurides and phosphinetellurides are preferred. Especially, the compounds described in paragraph No. 0030 of JP-A No.11-65021 and compounds represented by formula (II), (III) and (IV) in JP-A No.5-313284 are more preferred.

Specifically, as for the chalcogen sensitization of the invention, selenium sensitization and tellurium sensitization are preferred, and tellurium sensitization is particularly preferred.

In gold sensitization, gold sensitizer described in Chimie et Physique Photographique, written by P. Grafkides, (Paul Momtel, 5th ed., 1987) and Research Disclosure (vol. 307, Item 307105) can be used. To speak concretely, chloroauric acid, potassium chloroaurate, potassium aurithiocyanate, gold sulfide, gold selenide and the like can be used. In addition to these, the gold compounds described in U.S. Pat. Nos. 2,642,361, 5,049,484, 5,049,485, 5,169,751, and 5,252,455, Belg. Patent No. 691857, and the like can also be used. And another novel metal salts except gold such as platinum, palladium, iridium and so on described in Chimie et Pysique Photographique, written by P. Grafkides, (Paul Momtel, 5th ed., 1987) and Research Disclosure (vol. 307, Item 307105) can be used.

The gold sensitization can be used independently, but it is preferably used in combination with the above chalcogen sensitization. Specifically, these sensitizations are gold-sulfur sensitization (gold-plus-sulfur sensitization), gold-selenium sensitization, gold-tellurium sensitization, gold-sulfur-selenium sensitization, gold-sulfur-tellurium sensitization, gold-selenium-tellurium sensitization and gold-sulfur-selenium-tellurium sensitization.

In the invention, chemical sensitization can be applied at any time so long as it is after grain formation and before coating, and it can be applied, after desalting, (1) before spectral sensitization, (2) simultaneously with spectral sensitization, (3) after spectral sensitization and (4) just before coating.

The addition amount of chalcogen sensitizer used in the invention may vary depending on the silver halide grain used, the chemical ripening condition and the like, and it is about $10^{-8}$ mol to $10^{-1}$ mol, and preferably, about $10^{-7}$ mol to $10^{-2}$ mol, per 1 mol of silver halide.

Similarly, the addition amount of the gold sensitizer used in the invention may vary depending on various conditions and it is generally about $10^{-7}$ mol to $10^{-2}$ mol and, more preferably, $10^{-6}$ mol to $5\times10^{-3}$ mol per 1 mol of silver halide. There is no particular restriction on the condition for the chemical sensitization in the invention and, appropriately, pAg is 8 or lower, preferably, 7.0 or lower, more preferably, 6.5 or lower and, particularly preferably, 6.0 or lower, and pAg is 1.5 or higher, preferably, 2.0 or higher and, particularly preferably, 2.5 or higher; pH is 3 to 10, preferably, 4 to 9; and temperature is at 20° C. to 95° C., preferably, 25° C. to 80° C.

In the invention, reduction sensitization can also be used in combination with the chalcogen sensitization or the gold sensitization. It is specifically preferred to use in combination with the chalcogen sensitization. As the specific compound for the reduction sensitization, ascorbic acid, thiourea dioxide or dimethylamine borane is preferred, as well as use of stannous chloride, aminoimino methane sulfonic acid, hydrazine derivatives, borane compounds, silane compounds and polyamine compounds are preferred. The reduction sensitizer may be added at any stage in the photosensitive emulsion production process from crystal growth to the preparation step just before coating.

Further, it is preferred to apply reduction sensitization by ripening while keeping pH to 8 or higher and pAg to 4 or lower for the emulsion, and it is also preferred to apply reduction sensitization by introducing a single addition portion of silver ions during grain formation. The addition amount of the reduction sensitizer may also vary depending on various conditions and it is generally about $10^{-7}$ mol to $10^{-1}$ mol and, more preferably, $10^{-6}$ mol to $5\times10^{-2}$ mol per 1 mol of silver halide.

In the silver halide emulsion used in the invention, a thiosulfonate compound may be added by the method shown in EP-A No. 293917.

The photosensitive silver halide grain in the invention is preferably chemically sensitized by at least one method of gold sensitizing method and chalcogen sensitizing method for the purpose of designing a high-sensitivity photothermographic material.

9) Compound that can be One-electron-oxidized to Provide a One-electron Oxidation Product which Releases One or More Electrons The photothermographic material of the invention preferably contains a compound that can be one-electron-oxidized to provide a one-electron oxidation product which releases one or more electrons. The said compound can be used alone or in combination with various chemical sensitizers described above to increase the sensitivity of silver halide.

As the compound that can be one-electron-oxidized to provide a one-electron oxidation product which releases one or more electrons is a compound selected from the following Groups. 1 and 2.

(Group 1) a compound that can be one-electron-oxidized to provide a one-electron oxidation product which further releases one or more electrons, due to being subjected to a subsequent bond cleavage reaction;

(Group 2) a compound that can be one-electron-oxidized to provide a one-electron oxidation product, which further releases one or more electrons after being subjected to a subsequent bond formation.

The compound of Group 1 will be explained below.

In the compound of Group 1, as for a compound that can be one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV1 to 36); JP-W No. 2001-500996 (Compound 1 to 74, 80 to 87, and 92 to 122); U.S. Pat. Nos. 5,747,235 and 5,747,236; EP No. 786692A1 (Compound INV 1 to 35); EP No. 893732A1; U.S. Pat. Nos. 6,054,260 and 5,994,051; etc. Preferred ranges of these compounds are the same as the preferred ranges described in the quoted specifications.

In the compound of Group 1, as for a compound that can be one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8), and the compound represented by formula (9) among the compounds which can undergo the chemical reaction represented by reaction formula (1). And the preferable range of these compounds is the same as the preferable range described in the quoted specification.

Formula (1)

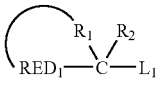

-continued

Formula (2)

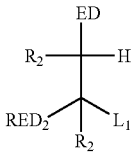

Formula (3)

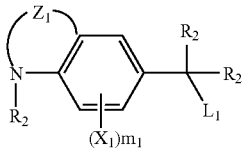

Formula (4)

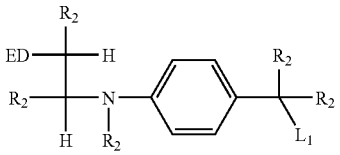

Formula (5)

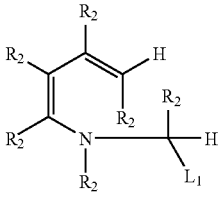

Formula (6)

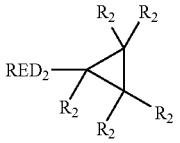

Formula (7)

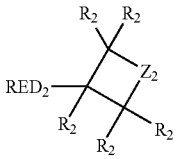

Formula (8)

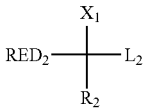

Reaction formula (1)

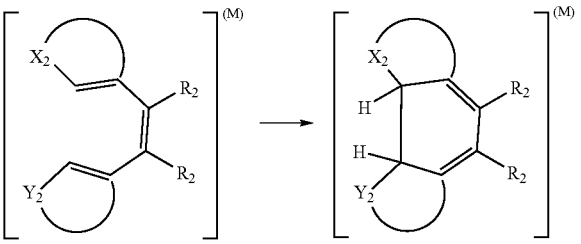

-continued

Formula (9)

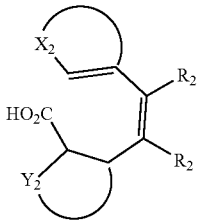

In the formulae, $RED_1$ and $RED_2$ each independently represent a reducible group. $R_1$ represents a nonmetallic atomic group forming a cyclic structure equivalent to a tetrahydro derivative or an octahydro derivative of a 5 or 6 membered aromatic ring (including a hetero aromatic ring) with a carbon atom (C) and $RED_1$. $R_2$ represents one selected from a hydrogen atom and a substituent. In the case where plural $R_2$ exist in a same molecule, these may be the same or different. $L_1$ represents a leaving group. ED represents an electron-donating group. $Z_1$ represents an atomic group capable to form a 6 membered ring with a nitrogen atom and two carbon atoms of a benzene ring. $X_1$ represents a substituent, and $m_1$ represents an integer of 0 to 3. $Z_2$ represents one selected from —$CR_{11}R_{12}$—, —$NR_{13}$—, and —O—. $R_{11}$ and $R_{12}$ each independently represent one selected from a hydrogen atom and a substituent.

$R_{13}$ represents one selected from a hydrogen atom, an alkyl group, an aryl group, and a heterocyclic group. $X_1$ represents one selected from an alkoxy group, an aryloxy group, a heterocyclic oxy group, an alkylthio group, an arylthio group, a heterocyclic thio group, an alkylamino group, an arylamino group, and a heterocyclic amino group. $L_2$ represents one selected from a carboxy group, a salt thereof, and a hydrogen atom. $X_2$ represents a group to form a 5 membered heterocycle with C═C. M represents one selected from a radical, a radical cation, and a cation.

Next, the compound of Group 2 is explained.

In the compound of Group 2, as for a compound that can be one-electron-oxidized to provide a one-electron oxidation product which further releases one or more electrons, after being subjected to a subsequent bond cleavage reaction, specific examples can include the compound represented by formula (10) (same as formula (1) described in JP-A No.2003-140287), and the compound represented by formula (11) which can undergo the chemical reaction represented by reaction formula (1). The preferable range of these compounds is the same as the preferable range described in the quoted specification.

Formula (10)

$$X—L_2—Y$$

Reaction formula (1)

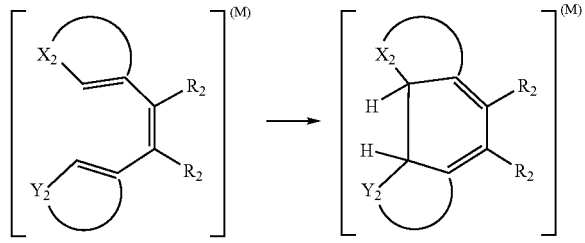

-continued

Formula (11)

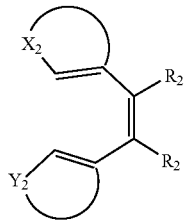

In the formula described above, X represents a reducible group which can be one-electron-oxidized. Y represents a reactive group containing one of a carbon-carbon double bond part, a carbon-carbon triple bond part, an aromatic group part, and nonaromatic heterocyclic part of benzo-condensed ring, which can react with one-electron-oxidized product formed by one-electron-oxidation of X to form a new bond. $L_2$ represents a linking group to link X and Y. $R_2$ represents one selected from a hydrogen atom and a substituent. In the case where plural $R_2$ exist in a same molecule, these may be the same or different.

$X_2$ represents a group to form a 5 membered heterocycle with C═C. $Y_2$ represents a group to form a 5 or 6 membered aryl group or a heterocyclic group with C═C. M represents one selected from a radical, a radical cation, and a cation.

The compounds of Groups 1 and 2 preferably are "the compound having an adsorptive group to silver halide in a molecule" or "the compound having a partial structure of a spectral sensitizing dye in a molecule".

The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 and 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different with each other.

As preferable adsorptive group, a nitrogen containing heterocyclic group substituted by a mercapto group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group and the like) or a nitrogen containing heterocyclic group having —NH— group as a partial structure of heterocycle capable to form a silver imidate (>NAg) (e.g., a benzotriazole group, a benzimidazole group, an indazole group and the like) are described. A 5-mercaptotetrazole group, a 3-mercapto-1,2,4-triazole group and a benzotriazole group are particularly preferable and a 3-mercapto-1,2,4-triazole group and a 5-mercaptotetrazole group are most preferable.

As an adsorptive group, the group which has 2 or more mercapto groups as a partial structure in a molecule is also particularly preferable. Herein, a mercapto group (—SH) may become a thione group in the case where it can tautomerize. As preferred examples of adsorptive group having two or more mercapto groups as a partial structure (dimercapto-substituted nitrogen containing heterocyclic group and the like), a 2,4-dimercaptopyrimidine group, a 2,4-dimercaptotriazine group and a 3,5-dimercaptol, 2,4-triazole group are described.

Further, a quaternary salt structure of nitrogen or phosphor is also preferably used as an adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group and the like) and a nitrogen containing heterocyclic group including quaternary nitrogen atom are described.

As a quaternary salt structure of phosphor, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group and the like) are described. A quaternary salt structure of nitrogen is more preferably used and a 5 or 6 membered aromatic heterocyclic group containing a quaternary nitrogen atom is further preferably used. Particularly preferably, a pyrydinio group, a quinolinio group and an isoquinolinio group are used. These nitrogen containing heterocyclic groups including a quaternary nitrogen atom may have any substituent.

As examples of counter anion of quaternary salt, halogen ion, carboxylate ion, sulfonate ion, sulfate ion, perchlorate ion, carbonate ion, nitrate ion, $BF_4^-$, $PF_6^-$, $Ph_4B^-$ and the like are described. In the case where the group having negative charge at carboxylate group and the like exists in a molecule, an inner salt may be formed with it. As a counter ion outside of a molecule, chloro ion, bromo ion and methanesulfonate ion are particularly preferable.

The preferred structure of the compound represented by Groups 1 and 2 having a quaternary salt of nitrogen or phosphor as an adsorptive group is represented by formula (X).

$$(P\text{-}Q_1\text{-})_i\text{-}R(\text{-}Q_2\text{-}S)_j \qquad \text{Formula (X)}$$

In formula (X), P and R each independently represent a quaternary salt structure of nitrogen or phosphor, which is not a partial structure of a spectral sensitizing dye. $Q_1$ and $Q_2$ each independently represent a linking group and typically represent one selected from a single bond, an alkylene group, an arylene group, a heterocyclic group, —O—, —S—, —NRN, —C(═O)—, —$SO_2$—, —SO—, —P(═O)—, and a combination thereof. Herein, $R_N$ represents one selected from a hydrogen atom, an alkyl group, an aryl group, and a heterocyclic group. S represents a residue which is obtained by removing one atom from the compound represented by Group 1 or 2. i and j are an integer of 1 or more, and are selected in a range of i+j=2 to 6. It is preferred that i is 1, 2 or 3 and j is 1 or 2. It is more preferred that i is 1 or 2 and j is 1. And, it is particularly preferred that i is 1 and j is 1.

The compound represented by formula (X) preferably has 10 to 100 carbon atoms in total, more preferably 10 to 70 carbon atoms, further preferably 11 to 60 carbon atoms, and particularly preferably 12 to 50 carbon atoms.

The compounds of Groups 1 and 2 may be used at any time during preparation of the photosensitive silver halide emulsion and production of the photothermographic material. For example, the compound may be used in a photosensitive silver halide grain formation step, in a desalting step, in a chemical sensitization step, and before coating, etc. The compound may be added in several times, during these steps. The compound is preferably added, after the photosensitive silver halide grain formation step and before the desalting step; in the chemical sensitization step (just before the chemical sensitization to immediately after the chemical sensitization); or before coating. The compound is more preferably added, just before the chemical sensitization step to before mixing with the non-photosensitive organic silver salt.

It is preferred that the compound of Groups 1 and 2 used in the invention is dissolved in water, a water-soluble solvent such as methanol and ethanol, or a mixed solvent thereof, to be added. In the case where the compound is dissolved in water and solubility of the compound is increased by increasing or decreasing a pH value of the solvent, the pH value may be increased or decreased to dissolve and add the compound.

The compound of Groups 1 and 2 used in the invention is preferably added to the image forming layer containing the photosensitive silver halide and the non-photosensitive organic silver salt. The compound may be added to a surface protective layer, or an intermediate layer, as well as the image forming layer containing the photosensitive silver halide and the non-photosensitive organic silver salt, to be diffused to the image forming layer in the coating step.

The compound may be added before or after addition of a sensitizing dye. Each compound is contained in the image forming layer preferably in an amount of $1\times10^{-9}$ mol to $5\times10^{-1}$ mol, more preferably $1\times10^{-8}$ mol to $5\times10^{-2}$ mol, per 1 mol of silver halide.

Specific examples of the compounds of Groups 1 and 2 according to the invention are shown below without intention of restricting the scope of the invention.

1

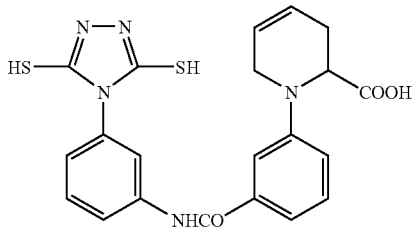

2

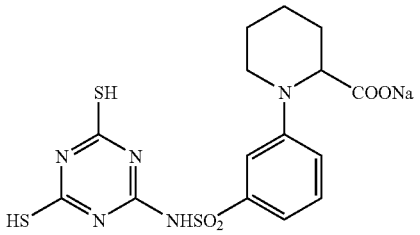

3

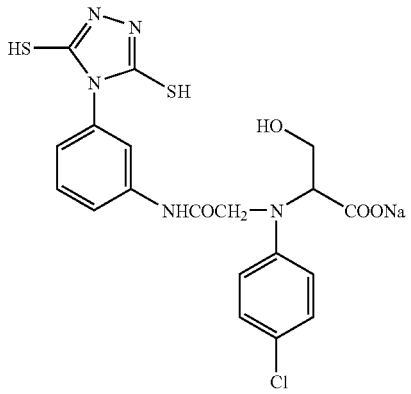

4

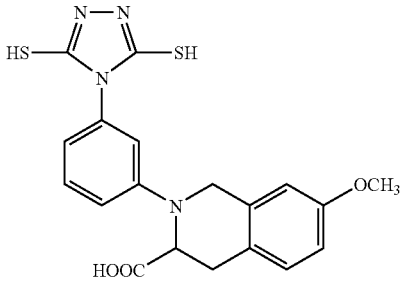

5

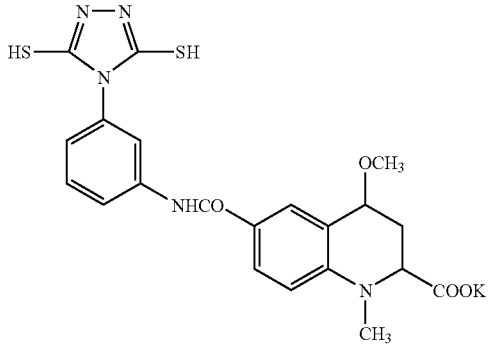

6

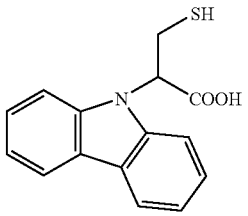

-continued
7
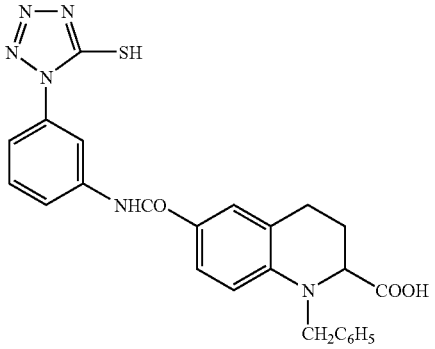
8
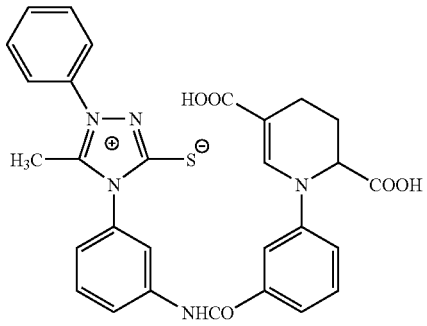
9
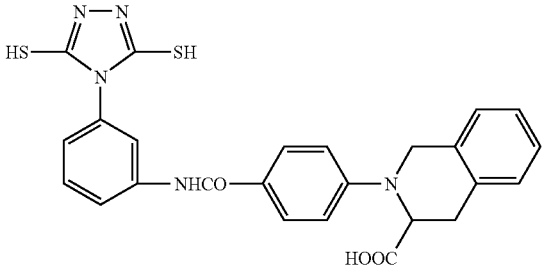
10
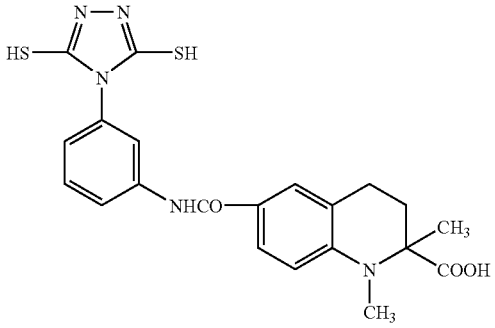
11
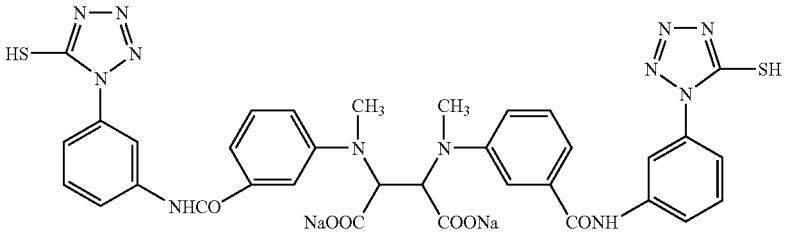
12
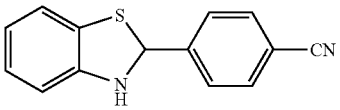
13
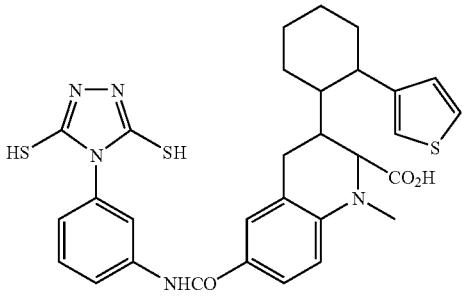
14
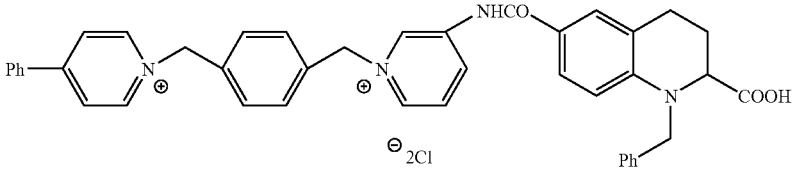

-continued
15
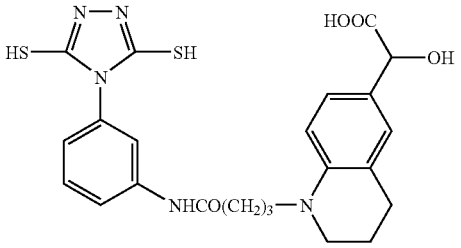
16
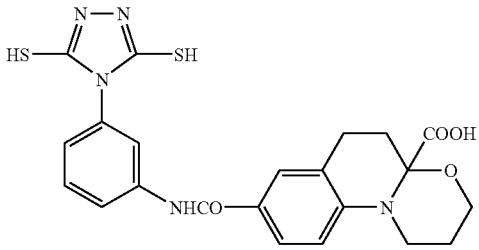
17
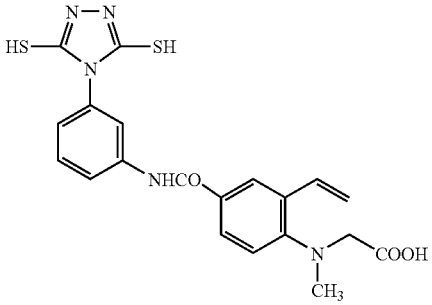
18
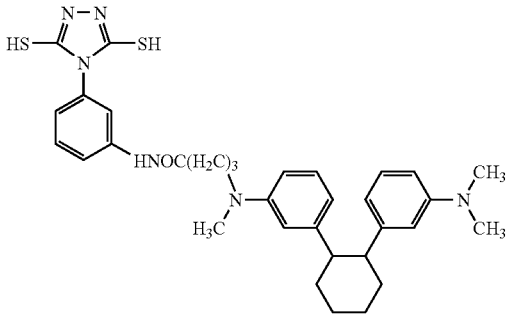
19
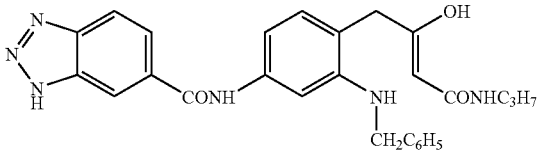
20
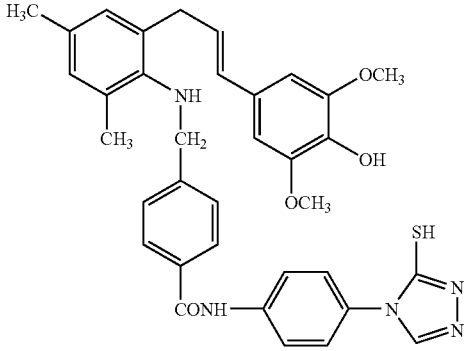
21
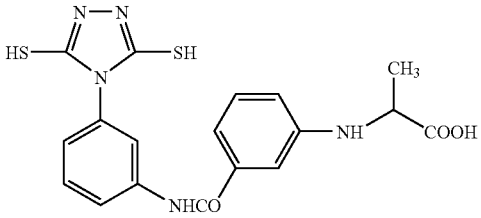
22
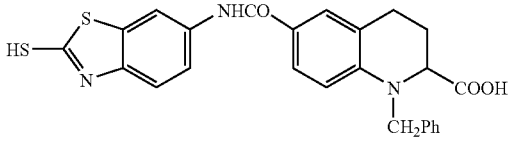
23
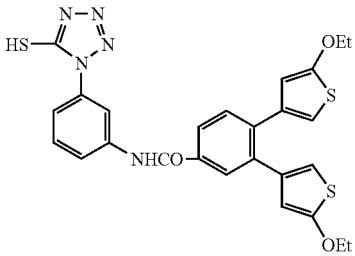
24
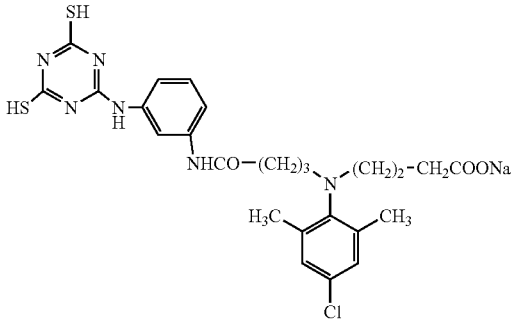

-continued
25
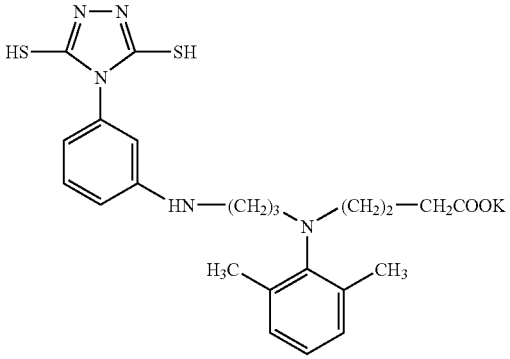
26
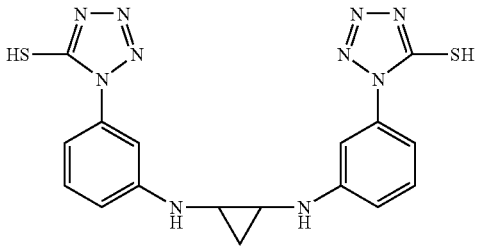
27
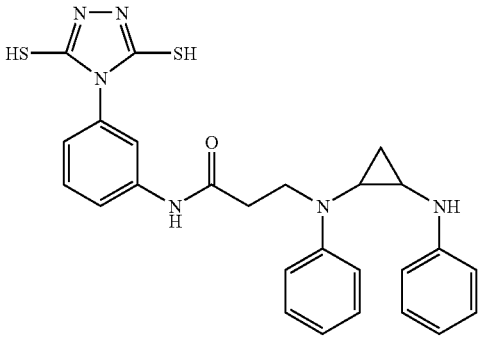
28
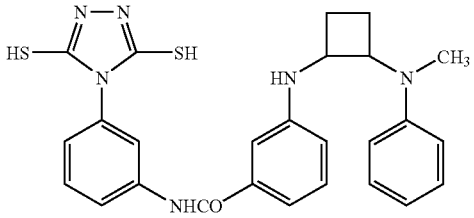
29
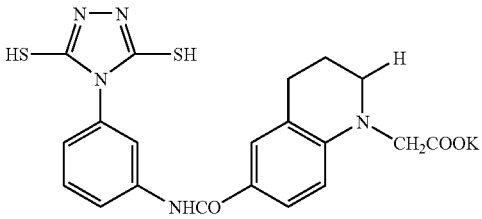
30
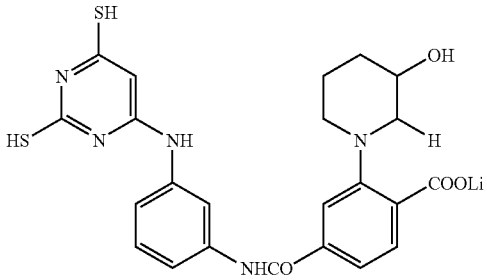
31
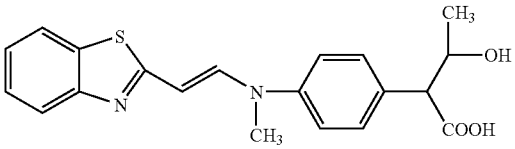
32
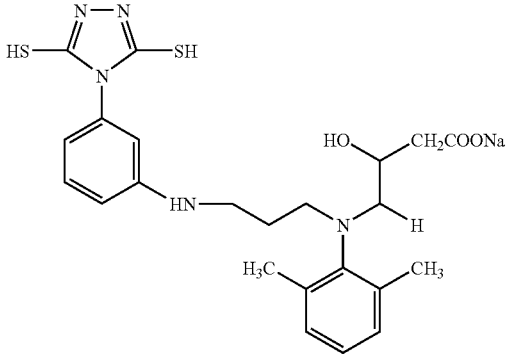

-continued
33
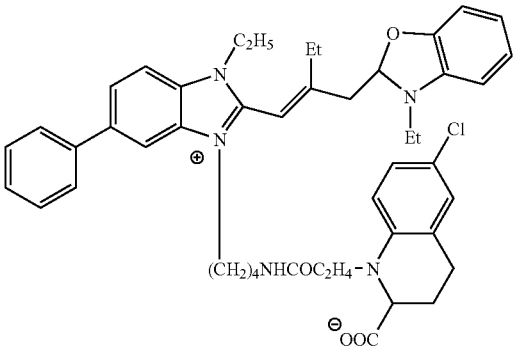
34
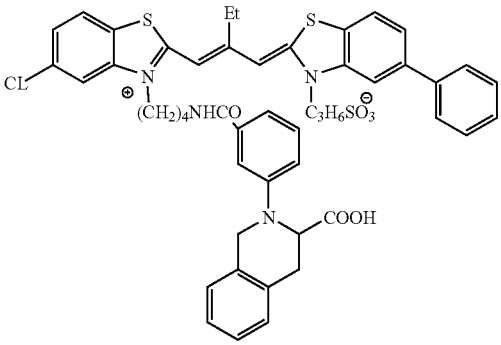
35
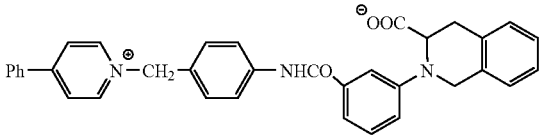
36
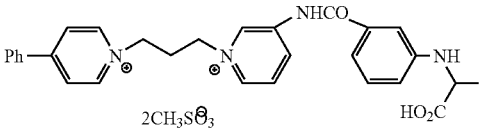
37
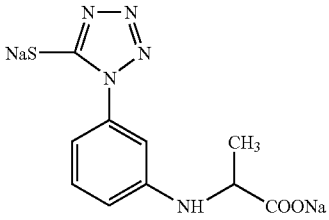
38
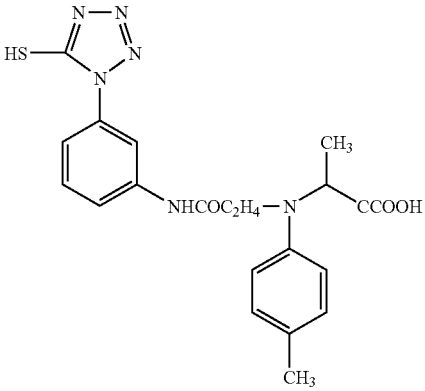
39
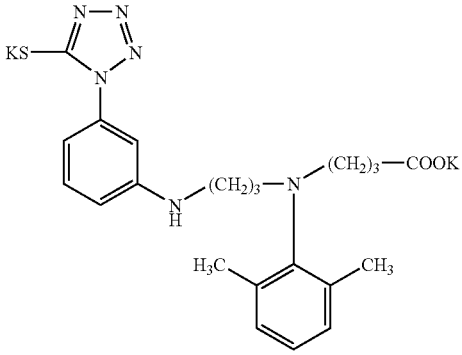
40
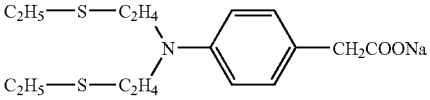

-continued

41

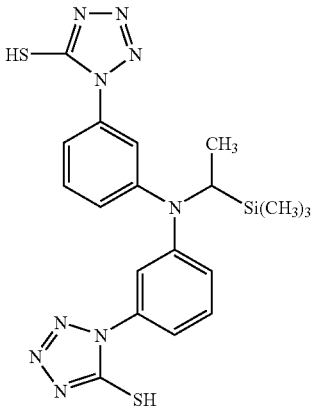

42

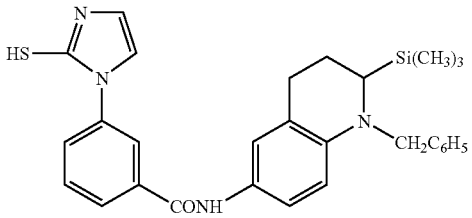

43

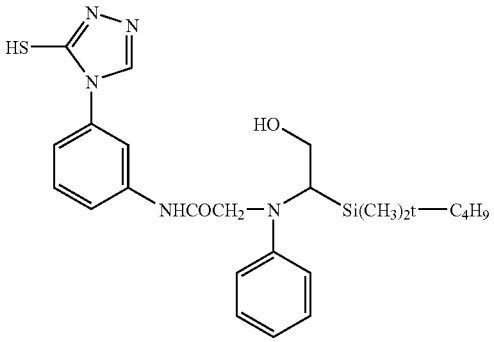

44

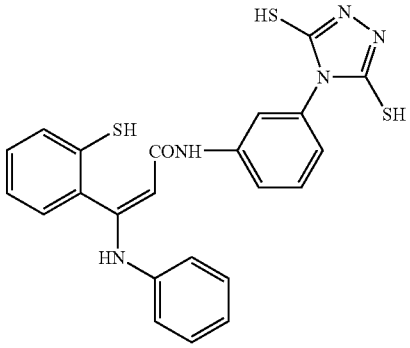

45

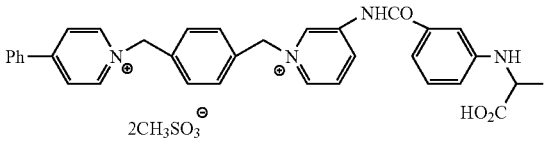

46

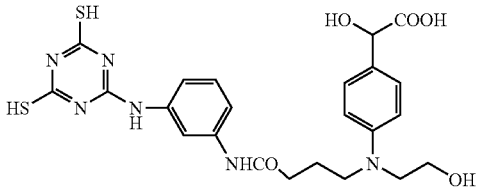

47

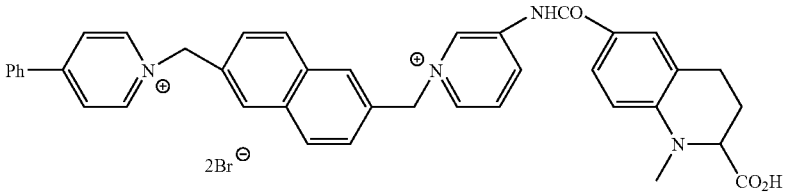

10) Compound having Adsorptive Group and Reducible Group

The photothermographic material of the present invention preferably comprises a compound having an adsorptive group and a reducible group in a molecule. It is preferred that the compound having an adsorptive group and a reducible group used in the invention is represented by the following formula (I).

A-(W)*n*-B Formula (I)

In formula (I), A represents a group capable of adsorption to a silver halide (hereafter, it is called an adsorptive group), W represents a divalent linking group, n represents 0 or 1, and B represents a reducible group.

In formula (I), the adsorptive group represented by A is a group to adsorb directly to a silver halide or a group to promote adsorption to a silver halide. As typical examples, a mercapto group (or a salt thereof), a thione group (—C(═S)—), a nitrogen atom, a heterocyclic group containing at least one atom selected from a nitrogen atom, a sulfur atom, a selenium atom and a tellurium atom, a sulfide group, a disulfide group, a cationic group, an ethynyl group, and the like are described.

The mercapto group (or a salt thereof) as an adsorptive group means a mercapto group (or a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or nonaromatic heterocyclic group having at least a 5 to 7 membered ring, e.g., an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group and the like are described.

A heterocyclic group having a quaternary nitrogen atom may also be adopted, wherein a mercapto group as a substituent may dissociate to form a mesoion. As a counter ion, whereby a mercapto group forms a salt thereof, a cation such as an alkali metal, an alkali earth metal, a heavy metal and the like ($Li^+$, $Na^+$, $K^+$, $Mg^{2+}$, $Ag^+$, $Zn^{2+}$ and the like), an ammonium ion, a heterocyclic group containing a quaternary nitrogen atom, a phosphonium ion and the like are described.

Further, the mercapto group as an adsorptive group may become a thione group by a tautomerization.

The thione group as an adsorptive group may also contain a chain or a cyclic thioamide group, a thioureido group, a thiouretane group or a dithiocarbamic acid ester group.

The heterocyclic group containing at least one atom selected from a nitrogen atom, a sulfur atom, a selenium atom and a tellurium atom as an adsorptive group represents a nitrogen atom containing heterocyclic group having —NH— group, as a partial structure of heterocycle, capable to form a silver iminate (>NAg) or a heterocyclic group, having —S— group, —Se— group, —Te— group or ═N— group as a partial structure of heterocycle, and capable to coordinate to a silver ion by a chelate bonding. As the former examples, a benzotriazole group, a triazole group, an indazole group, a pyrazole group, a tetrazole group, a benzimidazole group, a purine group and the like are described. As the latter examples, a thiophene group, a thiazole group, a benzoxazole group, a thiadiazole group, an oxadiazole group, a triazine group, a selenoazole group, a benzoselenazole group, a tellurazole group, a benzotellurazole group and the like are described.

The sulfide group or disulfide group as an adsorptive group contains all groups having "—S—" or "—S—S—" as a partial structure.

The cationic group as an adsorptive group means the group containing a quaternary nitrogen atom, such as an ammonio group or a nitrogen containing heterocyclic group including a quaternary nitrogen atom. As examples of the heterocyclic group containing a quaternary nitrogen atom, a pyridinio group, a quinolinio group, an isoquinolinio group, an imidazolio group and the like are described.

The ethynyl group as an adsorptive group means —C≡CH group and the said hydrogen atom may be substituted.

The adsorptive group described above may have any substituent.

Further, as typical examples of an adsorptive group, the compounds described in pages 4 to 7 in the specification of JP-A No.11-95355 are described.

As an adsorptive group represented by A in formula (I), a heterocyclic group substituted by a mercapto group (e.g., a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group and the like) or a nitrogen atom containing heterocyclic group having a —NH— group capable to form an imino-silver (>NAg) as a partial structure of heterocycle (e.g., a benzotriazole group, a benzimidazole group, an indazole group and the like) is preferable, and more preferable as an adsorptive group is a 2-mercaptobenzimidazole group or a 3,5-dimercapto-1,2,4-triazole group.

In formula (I), W represents a divalent linking group. The said linking group may be any divalent linking group, as far as it does not give a bad effect toward a photographic property. For example, a divalent linking group, which includes a carbon atom, a hydrogen atom, an oxygen atom a nitrogen atom and a sulfur atom, can be used. As typical examples, an alkylene group having 1 to 20 carbon atoms (e.g., a methylene group, an ethylene group, a trimethylene group, a tetramethylene group, a hexamethylene group and the like), an alkenylene group having 2 to 20 carbon atoms, an alkynylene group having 2 to 20 carbon atoms, an arylene group having 6 to 20 carbon atoms (e.g., a phenylene group, a nephthylene group and the like), —CO—, —$SO_2$—, —O—, —S—, —$NR_1$—, and the combination of these linking groups are described. Herein, $R_1$ represents a hydrogen atom, an alkyl group, a heterocyclic group, or an aryl group.

The divalent linking group represented by W may have any substituent.

In formula (I), a reducible group represented by B represents a group capable to reduce a silver ion. As the examples, a formyl group, an amino group, a triple bonding group such as an acetylene group, a propargyl group and the like, a mercapto group, hydroxylamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols and polyphenols such as hydroquinones, catechols, resorcinols, benzenetriols, bisphenols are contained), aclhydrazines, carbamoylhydrazides and a residue which is obtained by removing one hydrogen atom from 3-pyrazolidones and the like can be described. They may have any substituent.

The oxidation potential of a reducible group represented by B in formula (I), can be measured by using the measuring method described in Akira Fujishima, "DENKIKAGAKU SOKUTEIHO", pages 150 to 208, GIHODO SHUPPAN and The Chemical Society of Japan, "ZIKKEN KAGAKUKOZA", 4th ed., vol. 9, pages 282 to 344, MARUZEN. For example, the method of rotating disc voltammetry can be used; namely the sample is dissolved in the solution (methanol:pH 6.5 Britton-Robinson buffer=10%:90% (% by volume)) and after bubbling with nitrogen gas during 10 minutes the voltamograph can be measured under the condition of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E1/2) can be calculated by that obtained voltamograph.

When a reducible group represented by B in the present invention is measured by the method described above, an oxidation potential preferably is in the range of about −0.3 V to about 1.0 V, more preferably about −0.1 V to about 0.8 V, and particularly preferably about 0 V to about 0.7 V.

In formula (I), a reducible group represented by B preferably is hydroxylamines, hydroxamic acids, hydroxyureas, hydroxysemicarbazides, reductones, phenols, acylhydrazines, carbamoylhydrazides, or a residue which is obtained by removing one hydrogen atom from 3-pyrazolidones and the like.

The compound of formula (I) in the present invention may have the ballasted group or polymer chain in it generally used in the non-moving photographic additives as a coupler. And as a polymer, for example, the polymer described in JP-A No. 1-100530 can be described.

The compound of formula (I) in the present invention may be bis or tris type of compound.

The molecular weight of the compound represented by formula (I) in the present invention is preferably 100 to 10,000 and more preferably 120 to 1,000 and particularly preferably 150 to 500.

The examples of the compound represented by formula (I) in the present invention are shown below, but the present invention is not limited in these.

(1)

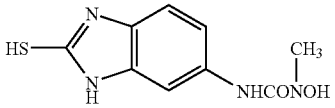

(2)

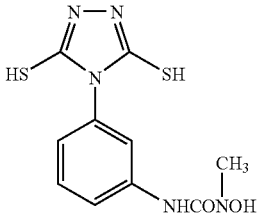

(3)

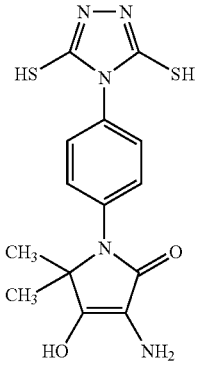

(4)

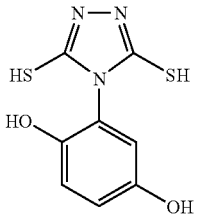

(5)

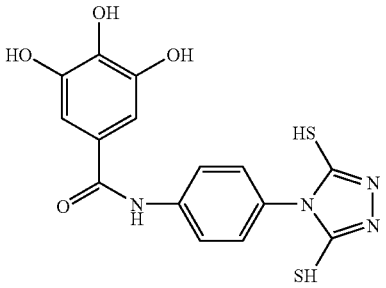

-continued (6)

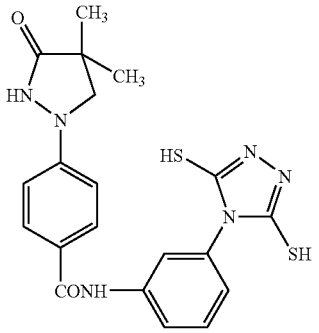

(7)

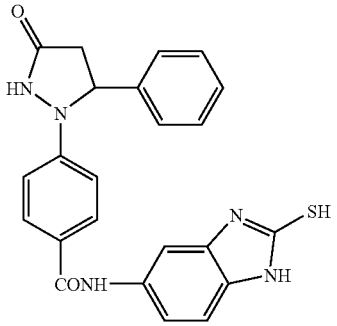

(8)

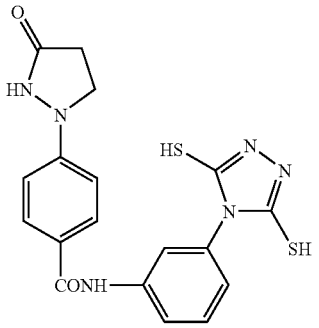

(9)

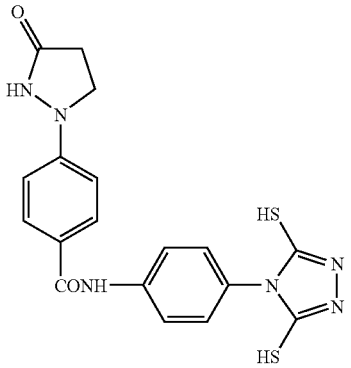

(10)

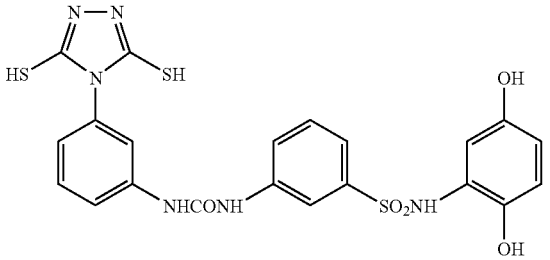

-continued (11)

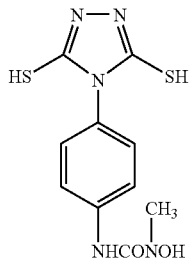

(12)

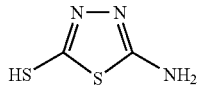

(13)

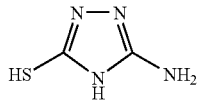

Further, example compounds 1 to 30 and 1"-1 to 1"-77 shown in EP No. 1308776A2, pages 73 to 87 are also described as preferable examples of the compound having an adsorptive group and a reducible group according to the invention.

These compounds can be easily synthesized by the known method.

The compound of formula (I) in the present invention can be used alone as only one kind of the compound, but it is preferred to use two or more kinds of the compounds in combination. When two or more kinds of the compounds are used in combination, those may be added to the same layer or the different layers, whereby adding methods may be different from each other.

The compound represented by formula (I) in the present invention preferably is added to an image forming layer and more preferably is to be added at an emulsion preparing process. In the case, wherein these compounds are added at an emulsion preparing process, these compounds may be added at any step in the process. For example, the silver halide grain forming step, a step before starting of desalting step, the desalting step, the step before chemical ripening, the chemical ripening step, the step before preparing a final emulsion and the like are described. Also, the addition can be performed in the plural divided times during the process. It is preferred to be used in the image forming layer, but also to be diffused at a coating step from a protective layer or an intermediate layer adjacent to the image forming layer, wherein these compounds are added in the protective layer or the intermediate layer in combination with their addition to the image forming layer.

The preferred addition amount is largely depend on the adding method described above or the kind of the compound, but generally $1\times10^{-6}$ mol to 1 mol per 1 mol of photosensitive silver halide, preferably $1\times10^{-5}$ mol to $5\times10^{-1}$ mol, and more preferably $1\times10^{-4}$ mol to $1\times10^{-1}$ mol.

The compound represented by formula (I) in the present invention can be added by dissolving in water or water-soluble solvent such as methanol, ethanol and the like or a mixed solution thereof. At this time, pH may be arranged suitably by an acid or an alkaline and a surfactant can be coexisted. Further, these compounds may be added as an emulsified dispersion by dissolving them in an organic solvent having a high boiling point and also may be added as a solid dispersion.

11) Sensitizing Dye

As the sensitizing dye applicable in the invention, those capable of spectrally sensitizing silver halide grains in a desired wavelength region upon adsorption to silver halide grains having spectral sensitivity suitable to spectral characteristic of an exposure light source can be selected advantageously.

Particularly, the photothermographic material of the invention is preferably spectrally sensitized to have a spectral sensitive peak in a range of 600 nm to 900 nm, or in a range of 300 nm to 500 nm. The sensitizing dyes and the adding method are disclosed, for example, in JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP-A No. 0803764A1, and in JP-A Nos. 2001-272747, 2001-290238 and 2002-23306. The sensitizing dyes described above may be used alone or, two or more kinds of them may be used in combination.

In the invention, the sensitizing dye may be added at any amount according to the properties of sensitivity and fog, but it is preferably added from $10^{-6}$ mol to 1 mol, and more preferably from $10^{-4}$ mol to $10^{-1}$ mol, per 1 mol of silver halide in the image forming layer.

The photothermographic material of the invention may also contain super sensitizers in order to improve spectral sensitizing effect.

The super sensitizers usable in the invention can include those compounds described in EP-A No. 587338, U.S. Pat. Nos. 3,877,943 and 4,873,184, JP-A Nos. 5-341432, 11-109547 and 10-111543, and the like.

12) Combined Use of a Plurality of Silver Halides

The photosensitive silver halide emulsion in the photothermographic material used in the invention may be used alone as one kind, or two or more kinds of them (for example, those of different average particle sizes, different halogen compositions, of different crystal habits and of different conditions for chemical sensitization) may be used together. Gradation can be controlled by using plural kinds of photosensitive silver halide of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

13) Mixing Silver Halide and Organic Silver Salt

The photosensitive silver halide in the invention is particularly preferably formed under the absence of the non-photosensitive organic silver salt and chemically sensitized. This is because a sufficient sensitivity can not sometimes be attained by the method of forming the silver halide by adding a halogenating agent to the organic silver salt.

The method of mixing the silver halide and the organic silver salt can include a method of mixing a separately prepared photosensitive silver halide and an organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above.

14) Mixing Silver Halide into Coating Solution

In the invention, the time of adding silver halide to the coating solution for the image forming layer is preferably in the range from 180 minutes before to just prior to the coating, more preferably, 60 minutes before to 10 seconds before coating. But there is no restriction for mixing method and mixing condition as far as the effect of the invention appears sufficient. As an embodiment of a mixing method, there is a method of mixing in the tank controlling the average residence time to be desired. The average residence time herein is calculated from addition flux and the amount of solution transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunsha, 1989).

2. Photothermographic Material

The photothermographic material of the invention has an image forming layer containing at least a photosensitive silver halide, a non-photosensitive organic silver salt, a reducing agent and a binder, on at least one surface of a support. Further, the image forming layer may carry thereon a surface protective layer, or may carry a back layer, a back protective layer or the like on the opposite surface.

The constitutions and preferable components of these layers will be explained in detail below.

2-1. Compound which Practically Reduces the Visible Absorption Derived from Photosensitive Silver Halide after Thermal Development In the present invention, it is preferred that the photothermographic material contains the compound which practically reduces the visible absorption derived from photosensitive silver halide after thermal development against before thermal development.

In the present invention, it is particularly preferred that silver iodide complex-forming agent, which acts specifically on silver iodide, is used as the compound which practically reduces visible absorption derived from photosensitive silver halide after thermal development.

(Silver Iodide Complex-forming Agent)

As for the silver iodide complex-forming agent according to the present invention, at least one of nitrogen atom and sulfur atom in the compound is possible to contribute to a Lewis acid-base reaction which gives an electron to a silver ion, as a ligand atom (electron donor: Lewis base). The stability of the complex is defined by successive stability constant or total stability constant, but it depends on the combination of silver ion, iodide ion and the silver complex-forming agent. As a general guide, it is possible to obtain a big stability constant by chelate effect from intramolecular chelate ring formation, by means of increasing the acid-bace dissociation constant and the like.

Ultra violet-visible absorption spectrum of photosensitive silver halide can be measured by the method of transmission or the method of reflection. When the absorption derived from other compounds added to the photothermographic material overlaps with the absorption of photosensitive silver halide, ultra violet-visible absorption spectrum of photosensitive silver halide can be observed by using, independently or in combination, the means of difference spectrum and removal of other compounds by solvent and the like.

As a silver iodide complex-forming agent according to the present invention, a 5 to 7 membered heterocyclic compound containing at least one nitrogen atom is preferable. In the case where the compound does not have a mercapto group, a sulfide group, or a thione group as a substituent, the said nitrogen containing 5 to 7 membered heterocycle may be saturated or unsaturated, and may have other substituent. The substituent on a heterocycle may bind each other to form a ring.

As preferable examples of 5 to 7 membered heterocyclic compounds, pyrrole, pyridine, oxazole, isoxazole, thiazole, isothiazole, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, naphthylizine, purine, pterizine, carbazole, acridine, phenanthoridine, phenanthroline, phenazine, phenoxazine, phenothiazine, benzothiazole, benzoxazole, benzimidazole, 1,2,4-triazine, 1,3,5-triazine, pyrrolidine, imidazolidine, pyrazolidine, piperidine, piperazine, morpholine, indoline, isoindoline, and the like can be described.

More preferably, pyridine, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, 1,8-naphthylizine, 1,10-phenanthroline, benzimidazole, benzotriazole, 1,2,4-triazine, 1,3,5-triazine and the like can be described. Particularly preferably, pyridine, imidazole, pyrazine, pyrimidine, pyridazine, phtharazine, triazine, 1,8-naphthylizine and 1,10-phenanthroline, and the like can be described.

These rings may have a substituent and any substituent can be used as far as it does not show a bad influence to photographic property. As preferable examples, a halogen atom (fluorine atom, chlorine atom, bromine atom or iodine atom), an alkyl group (a straight, a branched, a cyclic alkyl group containing a bicycloalkyl group or an active methylene group), an alkenyl group, an alkynyl group, an aryl group, a heterocyclic group (substituted position is not asked), an acyl group, an alkoxycarbonyl group, an aryloxycarbonyl group, a heterocyclic oxycarbonyl group, a carbamoyl group, a N-acylcarbamoyl group, a N-sulfonylcarbamoyl group, a N-carbamoylcarbamoyl group, a N-sulfamoylcarbamoyl group, a carbazoyl group, a carboxy group and a salt thereof, an oxalyl group, an oxamoyl group, a cyano group, a carboimidoyl group, a formyl group, a hydroxy group, an alkoxy group (the group repeating ethylene oxy group units or propylene oxy group units is included), an aryloxy group, a heterocyclic oxy group, an acyloxy group, an alkoxycarbonyloxy group, an aryloxycarbonyloxy group, a carbamoyloxy group, a sulfonyloxy group, an amino group, an alkylamino group, an arylamino group, a heterocyclic amino group, an acylamino group, a sulfonamido group, an ureido group, a thioureido group, an imido group, an alkoxycarbonylamino group, an aryloxycarbonylamino group, a sulfamoylamino group, a semicarbazide group, an ammonio group, an oxamoylamino group, a N-alkylsulfonylureido group, a N-arylsulfonylureido group, a N-acylureido group, N-acylsulfamoylamino group, a nitro group, a heterocyclic group containing a quaternary nitrogen atom (e.g., a pyridinio group, an imidazolio group, a quinolinio group, an isoquinolinio group), an isocyano group, an imino group, an alkylsulfonyl group, an arylsulfonyl group, an alkylsulfinyl group, an arylsulfinyl group, a sulfo group and a salt thereof, a sulfamoyl group, a N-acylsulfamoyl group, a N-sulfonylsulfamoyl group and a salt thereof, a phosphino group, a phosphinyl group, a phosphinyloxy group, a phosphinylamino group, a silyl group, and the like are described.

Here, an active methylene group means the methine group substituted by two electron-attracting groups, wherein the electron-attracting group means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, a carbonimidoyl group. Herein, two electron-attracting groups may bind each other to form a cyclic structure. And, the salt means a salt formed with positive ion such as an alkaline metal, an alkaline earth metal, a heavy metal or the like, or organic positive ion such as an ammonium ion, a phosphonium ion or the like. These substituents may be further substituted by these substituents.

These heterocycles may be further condensed by another ring. In the case where the substituent is an anion group (e.g., $—CO_2^-$, $—SO_3^-$, $—S^-$ and the like), the heterocycle containing nitrogen atom of the invention may become a positive ion (e.g., pyridinium, 1,2,4-triazolium and the like) and may form an intramolecular salt.

In the case where a heterocyclic compound is pyridine, pyrazine, pyrimidine, pyridazine, phthalazine, triazine, naththilizine or phenanthroline derivative, the acid dissociation constant (pKa) of a conjugated acid of nitrogen containing heterocyclic part in acid dissociation equilibrium of the said compound preferably is 3 to 8 in the mixture solution of tetrahydrofuran/water (3/2) at 25° C., and more preferably, pKa is 4 to 7.

As the heterocyclic compound, pyridine, pyridazine or phtharazine derivative is preferable, and particularly preferable is pyridine or phthalazine derivative.

In the case where these heterocyclic compounds have a mercapto group, a sulfide group or a thione group as the substituent, pyridene, thiazole, isothiazole, oxazole, isoxazole, imidazole, pyrazole, pyrazine, pyrimidine, pyridazine, triazine, triazole, thiadiazole or oxadiazole derivatives are preferable, and thiazole, imidazole, pyrazole, pyrazine, pyrimidine, pyridazine, triazine, triazole derivatives are particularly preferable.

For example, as the said silver iodide complex-forming agent, the compound represented by the following formula (C1) or (C2) can be used.

Formula (C1)

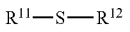

Formula (C2)

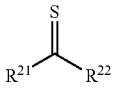

In formula (C1), $R^{11}$ and $R^{12}$ each independently represent one selected from a hydrogen atom and a substituent. In formula (C2), $R^{21}$ and $R^{22}$ each independently represent one selected from a hydrogen atom and a substituent. However, both of $R^{11}$ and $R^{12}$ are not hydrogen atoms together and both of $R^{21}$ and $R^{22}$ are not hydrogen atoms together. As the substituent herein, the substituent explained as the substituent of a 5 to 7 membered nitrogen containing heterocyclic type silver iodide complex-forming agent mentioned above can be described.

Further, the compound represented by formula (C3) described below can also be used preferably.

Formula (C3)

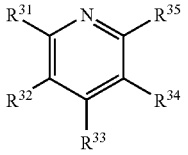

In formula (C3), $R^{31}$ to $R^{35}$ each independently represent one selected from a hydrogen atom and a substituent. As the substituents represented by $R^{31}$ to $R^{35}$, the substituent of a 5 to 7 membered nitrogen containing heterocyclic type silver iodide complex-forming agent mentioned above can be described. In the case where the compound represented by formula (C3) has a substituent, preferred substituting position is $R^{32}$ to $R^{34}$. $R^{31}$ to $R^{35}$ may bind each other to form a saturated or an unsaturated ring. Preferred substituent is a halogen atom, an alkyl group, an aryl group, a carbamoyl group, a hydroxy group, an alkoxy group, an aryloxy group, a carbamoyloxy group, an amino group, an acylamino group, an ureido group, an alkoxycarbonylamino group, an aryloxycarbonylamino group and the like.

In the compound represented by formula (C3), the acid dissociation constant (pKa) of conjugated acid of pyridine ring part preferably is 3 to 8 in the mixed solution of tetrahydrofuran/water (3/2) at 25° C., and particularly preferably, pKa is 4 to 7.

Furthermore, the compound represented by formula (C4) is also preferable.

Formula (C4)

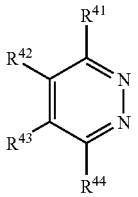

In formula (C4), $R^{41}$ to $R^{44}$ each independently represent one selected from a hydrogen atom and a substituent. $R^{41}$ to $R^{44}$ may bind each other to form a saturated or an unsaturated ring. As the substituent represented by $R^{41}$ to $R^{44}$, the substituent of a 5 to 7 membered nitrogen containing heterocyclic type silver iodide complex-forming agent mentioned above can be described. As preferred group, an alkyl group, an alkenyl group, an alkynyl group, an aryl group, a hydroxy group, an alkoxy group, an aryloxy group a hetecyclic oxy group and a group which forms a phthalazine ring by benzo-condensation are described. In the case where a hydroxy group exists at the carbon atom adjacent to nitrogen atom of the compound represented by formula (C4), there exists equilibrium between pyridazinone.

The compound represented by formula (C4) more preferably forms a phthalazine ring represented by the following formula (C5), and furthermore, this phthalazine ring particularly preferably has at least one subsutituent. As examples of $R^{51}$ to $R^{56}$ in formula (C5), the substituent of a 5 to 7 membered nitrogen containing heterocyclic type silver iodide complex-forming agent mentioned above can be described. And as more preferable examples of the substituent, an alkyl group, an alkenyl group, an alkynyl group, an aryl group, a hydroxy group, an alkoxy group, an aryloxy group and the like are described. An alkyl group, an alkenyl group, an aryl group, an alkoxy group and an aryloxy group are preferable and an alkyl group, an alkoxy group and an aryloxy group are more preferable.

Formula (C5)

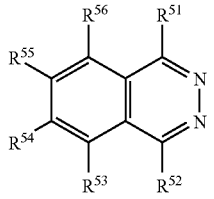

Further, the compound represented by formula (C6) described below is also a preferable embodiment.

Formula (C6)

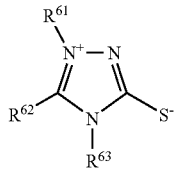

In formula (C6) $R^{61}$ to $R^{63}$ each independently represent one selected from a hydrogen atom and a substituent. As examples of the substituent represented by $R^{62}$, the substituent of a 5 to 7 membered nitrogen containing heterocyclic type silver iodide complex-forming agent mentioned above can be described.

As the compound preferably used, the compound represented by the following formula (C7) is described.

$$R^{71}—S-(L)_n S—R^{72}$$ Formula (C7)

In formula (C7), $R^{71}$ and $R^{72}$ each independently represent one selected from a hydrogen atom and a substituent. L represents a divalent linking group. n represents 0 or 1. As the substituents represented by $R^{71}$ and $R^{72}$, an alkyl group (containing a cycloalkyl group), an alkenyl group (containing a cycloalkenyl group), an alkynyl group, an aryl group, a heterocyclic group, an acyl group, an aryloxycarbonyl group, an alkoxycarbonyl group, a carbamoyl group, an imido group, and a complex substituent containing these groups are described as examples. A divalent linking group represented by L preferably has the length of 1 to 6 atoms and more preferably has the length of 1 to 3 atoms, and furthermore, may have a substituent.

One more of the compounds preferably being used is a compound represented by formula (C8).

Formula (C8)

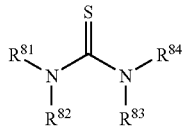

In formula (C8), $R^{81}$ to $R^{84}$ each independently represent one selected from a hydrogen atom and a substituent. As the substituents represented by $R^{81}$ to $R^{84}$, an alkyl group (including a cycloalkyl group), an alkenyl group (including a cycloalkenyl group), an alkynyl group, an aryl group, a heterocyclic group, an acyl group, an aryloxycarbonyl group, an alkoxycarbonyl group, a carbamoyl group, an imido group, and the like are described as examples.

Among the silver iodide complex-forming agents described above, the compounds represented by formulae (C3), (C4), (C5), (C6) and (C7) are preferable and, the compounds represented by formulae (C3) and (C5) are particularly preferable.

Preferable examples of silver iodide complex-forming agent are described below, however the present invention is not limited in these.

(1)

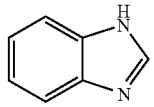

(2)

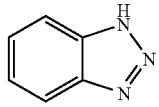

(3)

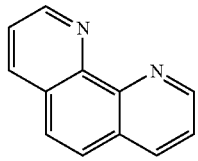

(4)

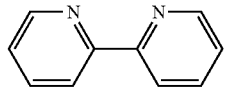

(5)

$C_5H_{11}SC_5H_{11}$ (6)

$C_4H_9SCH_2CH_2SC_4H_9$ (7)

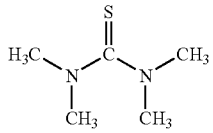

(8)

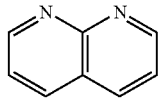

(9)

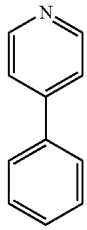

(10)

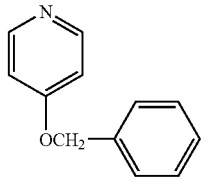

-continued
(11)
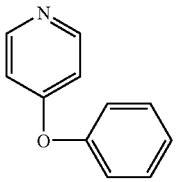
(12)
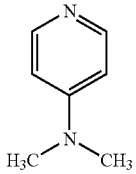
(13)
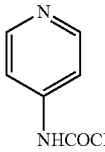
(14)
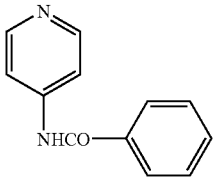
(15)
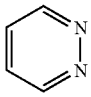
(16)
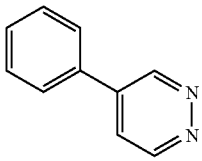
(17)
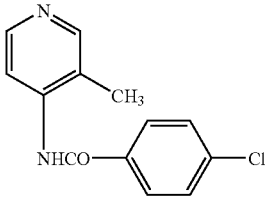
(18)
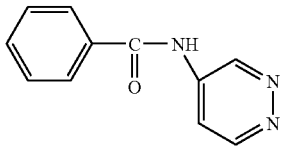
(19)
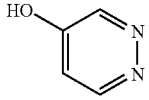
(20)
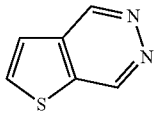
-continued
(21)
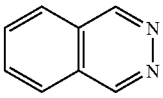
(22)
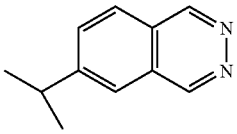
(23)
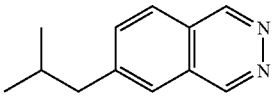
(24)
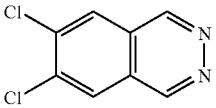
(25)
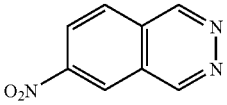
(26)
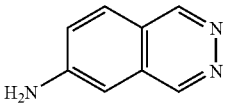
(27)
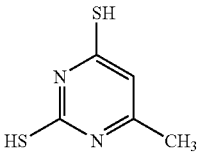
(28)
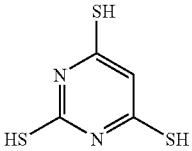
(29)
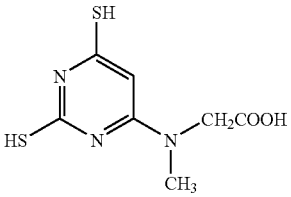
(30)
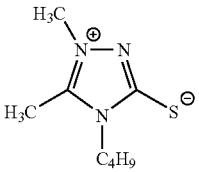
(31)
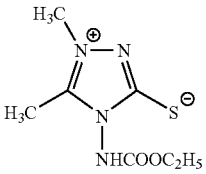

-continued (32)

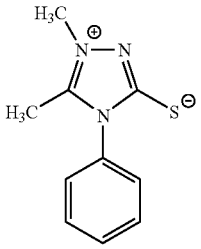

(33)

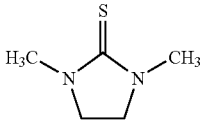

(34)

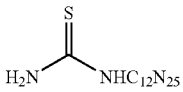

(35)

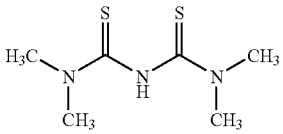

(36)

$HO(CH_2)_3S(CH_2)_2S(CH_2)_3OH$ (37)

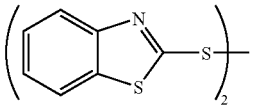

(38)

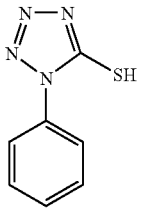

(39)

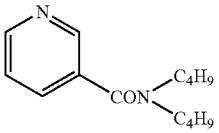

(40)

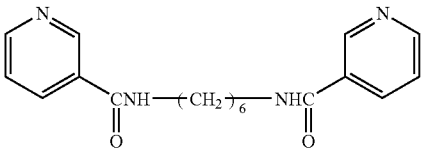

(41)

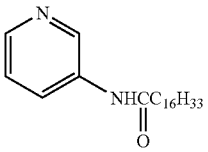

(42)

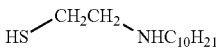

The silver iodide complex-forming agent according to the present invention can also be a compound common to a toner, in the case where the agent achieves the function of conventionally known toner.

The silver iodide complex-forming agent according to the present invention can be used in combination with a toner. And, two or more kinds of the silver iodide complex-forming agents may be used in combination.

The silver iodide complex-forming agent according to the present invention preferably exists in a film under the state separated from a photosensitive silver halide, such as a solid state. It is also preferably added to the layer adjacent to the image forming layer.

Concerning the silver iodide complex-forming agent according to the present invention, a melting point of the compound is preferably adjusted to a suitable range so that it can be dissolved when heated at thermal developing temperature.

In the present invention, an absorption intensity of ultra violet-visible absorption spectrum of photosensitive silver halide after thermal development preferably becomes 80% or less as compared with before thermal development, more preferably 40% or less and, particularly preferably 10% or less.

The silver iodide complex-forming agent according to the invention may be incorporated into photothermographic material by being added into the coating solution, such as in the form of a solution, an emulsion dispersion, a solid fine particle dispersion, and the like.

As well known emulsion dispersing method, there can be mentioned a method comprising dissolving the silver iodide complex-forming agent in an oil such as dibutyl phthalate, tricresyl phosphate, glyceryl triacetate or diethyl phthalate or the like, and an auxiliary solvent such as ethyl acetate or cyclohexanone, followed by mechanically forming the emulsified dispersion.

As solid fine particle dispersing method, there can be mentioned a method comprising dispersing the powder of the silver iodide complex-forming agent in a proper medium such as water, by means of ball mill, colloid mill, vibrating ball mill, sand mill, jet mill, roller mill, or ultrasonics, thereby obtaining solid dispersion.

In this case, there can also be used a protective colloid (such as polyvinyl alcohol), or a surfactant (for instance, an anionic surfactant such as sodium triisopropylnaphthalene-sulfonate (a mixture of compounds having the isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in the range of from 1 ppm to 1000 ppm. It is practically acceptable so long as Zr is incorporated in the photothermographic material in an amount of 0.5 mg or less per 1 g of silver.

Preferably, an antiseptic (for instance, sodium benzoisothiazolinone salt) is added in the water dispersion.

The silver iodide complex-forming agent according to the invention is preferably used in the form of a solid dispersion.

The silver iodide complex-forming agent according to the invention is preferably used in the range from 1 mol % to 5000 mol %, more preferably, from 10 mol % to 1000 mol % and, further preferably, from 50 mol % to 300 mol %, with respect to the photosensitive silver halide in each case.

2-2. Organic Silver Salt

The organic silver salt according to the invention is relatively stable to light but serves as to supply silver ions and forms silver images when heated to 80° C. or higher under the presence of an exposed photosensitive silver halide and a reducing agent. The organic silver salt may be any organic material containing a source capable of reducing silver ions. Such non-photosensitive organic silver salt is disclosed, for example, in JP-A No. 10-62899 (paragraph Nos. 0048 to 0049), EP-A No. 0803764A1 (page 18, line 24 to page 19, line 37), EP-A No. 0962812A1, JP-A Nos. 11-349591, 2000-7683, and 2000-72711, and the like. A silver salt of organic acid, particularly, a silver salt of long chained fatty acid carboxylic acid (having 10 to 30 carbon atoms, preferably, having 15 to 28 carbon atoms) is preferable. Preferred examples of the organic silver salt can include, for example, silver behenate, silver arachidinate, silver stearate, silver oleate, silver laurate, silver capronate, silver myristate, silver palmitate and mixtures thereof.

In the present invention, among the organic silver salts, it is preferred to use an organic silver salt with the silver behenate content of 50 mol % or more, and particularly preferably, 75 mol % to 98 mol %.

There is no particular restriction on the shape of the organic silver salt usable in the invention and it may needle-like, bar-like, tabular or flaky shape.

In the invention, a flaky shaped organic silver salt is preferred. In the present specification, the flaky shaped organic silver salt is defined as described below. When an organic acid silver salt is observed under an electron microscope, calculation is made while approximating the shape of an organic acid silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: x (average)≧1.5 as an average value x is defined as a flaky shape. The relation is preferably: 30≧x (average)≧1.5 and, more preferably, 15≧x (average)≧1.5. By the way, needle-like is expressed as 1≦x (average)<1.5.

In the flaky shaped particle, a can be regarded as a thickness of a tabular particle having a main plate with b and c being as the sides. a in average is preferably 0.01 μm to 0.3 μm and, more preferably, 0.1 μm to 0.23 μm. c/b in average preferably 1 to 6, more preferably, 1 to 4 and, further preferably, 1 to 3 and, particularly preferably, 1 to 2.

As the particle size distribution of the organic silver salt, monodispersion is preferred. In the monodispersion, the percentage for the value obtained by dividing the standard deviation for the length of minor axis and major axis by the minor axis and the major axis respectively is, preferably, 100% or less, more preferably, 80% or less and, further preferably, 50% or less. The shape of the organic silver salt can be measured by determining dispersion of an organic silver salt as transmission type electron microscopic images. Another method of measuring the monodispersion is a method of determining of the standard deviation of the volume weighted mean diameter of the organic silver salt in which the percentage for the value defined by the volume weight mean diameter (variation coefficient), is preferably, 100% or less, more preferably, 80% or less and, further preferably, 50% or less. The monodispersion can be determined from particle size (volume weighted mean diameter) obtained, for example, by a measuring method of irradiating a laser beam to an organic silver salt dispersed in a liquid, and determining a self correlation function of the fluctuation of scattered light to the change of time.

Methods known in the art may be applied to the method for producing the organic silver salt used in the invention and to the dispersing method thereof. For example, reference can be made to JP-A No. 10-62899, EP-A Nos. 0803763A1 and 0962812A1, JP-A Nos. 11-349591, 2000-7683, 2000-72711, 2001-163827, 2001-163889, 2001-163890, 11-203413, 2001-188313, 2001-83652, 2002-6442, 2002-31870, and the like.

In the invention, the photothermographic material can be prepared by mixing an aqueous dispersion of an organic silver salt and an aqueous dispersion of a photosensitive silver salt. A method of mixing two or more kinds of aqueous dispersions of organic silver salts and two or more kinds of aqueous dispersions of photosensitive silver salts upon mixing are used preferably for controlling the photographic properties.

While an organic silver salt in the invention can be used in a desired amount, an amount of an organic silver salt is preferably in the range from 0.1 g/m$^2$ to 5 g/m$^2$, more preferably 1 g/m$^2$ to 3 g/m$^2$, and particularly preferably 1.2 g/m$^2$ to 2.5 g/m$^2$, with respect to the amount of silver.

2-3. Reducing Agent

The photothermographic material of the invention contains a reducing agent for the organic silver salt. The reducing agent may be any substance (preferably, organic substance) capable of reducing silver ions into metallic silver. Examples of the reducing agent are described in JP-A No. 11-65021 (column Nos. 0043 to 0045) and EP-A No. 0803764A1 (page 7, line 34 to page 18, line 12).

In the invention, a so-called hindered phenolic reducing agent or a bisphenol reducing agent having a substituent at the ortho-position to the phenolic hydroxy group is preferred. Particularly, the compound represented by the following formula (R) is preferred.

Formula (R)

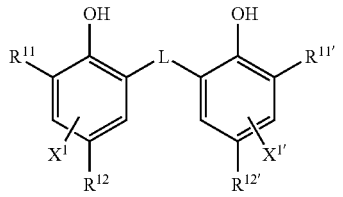

In formula (R), $R^{11}$ and $R^{11'}$ each independently represent an alkyl group having 1 to 20 carbon atoms. $R^{12}$ and $R^{12'}$ each independently represent a hydrogen atom or a group capable of substituting for a hydrogen atom on a benzene ring. L represents one selected from a —S— group and a —$CHR^{13}$— group. $R^{13}$ represents one selected from a hydrogen atom and an alkyl group having 1 to 20 carbon atoms. $X^1$ and $X^{1'}$ each independently represent one selected from a hydrogen atom and a group capable of substituting for a hydrogen atom on a benzene ring.

Each of the substituents is to be described specifically.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, aryl group, hydroxy group, alkoxy group, aryloxy group, alkylthio group, arylthio group, acylamino group, sulfoneamide group, sulfonyl group, phosphoryl group, acyl group, carbamoyl group, ester group, ureido group, urethane group, and halogen atom.

2) $R^{12}$ and $R^{12'}$, $X^1$ and $X^{1'}$ $R^{12}$ and $R^{12'}$ each independently represent one selected from a hydrogen atom and a group capable of substituting for a hydorgen atom on a benzene ring.

$X^1$ and $X^{1'}$ each independently represent one selected from a hydrogen atom and a group capable of substituting for a hydorgen atom on a benzene ring. Each of the groups capable of substituting for a hydrogen atom on the benzene ring can include, preferably, alkyl group, aryl group, halogen atom, alkoxy group, and acylamino group.

3) L

L represents one selected from a —S— group and a —$CHR^{13}$— group. $R^{13}$ represents one selected from a hydrogen atom and an alkyl group having 1 to 20 carbon atoms in which the alkyl group may have a substituent.

Specific examples of the unsubstituted alkyl group for $R^{13}$ can include, for example, methyl group, ethyl group, propyl group, butyl group, heptyl group, undecyl group, isopropyl group, 1-ethylpentyl group, 2,4,4-trimethylpentyl group, and the like.

Examples of the substituent for the alkyl group can include, similar to substituent of $R^{11}$, a halogen atom, an alkoxy group, alkylthio group, aryloxy group, arylthio group, acylamino group, sulfoneamide group, sulfonyl group, phosphoryl group, oxycarbonyl group, carbamoyl group, sulfamoyl group, and the like.

4) Preferred Substituents $R^{11}$ and $R^{11'}$ are, preferably, a secondary or tertiary alkyl group having 3 to 15 carbon atoms and can include, specifically, isopropyl group, isobutyl group, t-butyl group, t-amyl group, t-octyl group, cyclohexyl group, cyclopentyl group, 1-methylcyclohexyl group, 1-methylcyclopropyl group, and the like. $R^{11}$ and $R^{11'}$ each represent, more preferably, an alkyl group having 4 to 12 carbon atoms and, among them, t-butyl group, t-amyl group, 1-methylcyclohexyl group are further preferred and, t-butyl group being most preferred.

$R^{12}$ and $R^{12'}$ are, preferably, an alkyl group having 1 to 20 carbon atoms and can include, specifically, methyl group, ethyl group, propyl group, butyl group, isopropyl group, t-butyl group, t-amyl group, cyclohexyl group, 1-methylcyclohexyl group, benzyl group, methoxymethyl group, methoxyethyl group and the like. More preferred are methyl group, ethyl group, propyl group, isopropyl group, and t-butyl group.

$X^1$ and $X^{1'}$ are, preferably, one of a hydrogen atom, a halogen atom, and an alkyl group, and more preferably, a hydrogen atom.

L is preferably a —$CHR^{13}$— group.

$R^{13}$ is, preferably, a hydrogen atom or an alkyl group having 1 to 15 carbon atoms. Preferable examples of the alkyl group can include methyl group, ethyl group, propyl group, isopropyl group, 2,4,4-trimethylpentyl group. Particularly preferable $R^{13}$ is one selected from a hydrogen atom, methyl group, propyl group, and isopropyl group.

When $R^{13}$ is a hydrogen atom, $R^{12}$ and $R^{12'}$ are preferably an alkyl group having 2 to 5 carbon atoms, more preferably an ethyl group or a propyl group, and most preferably an ethyl group.

When $R^{13}$ is a primary or secondary alkyl group having 1 to 8 carbon atoms, $R^{12}$ and $R^{12'}$ are preferably a methyl group. The alkyl group as $R^{13}$ having 1 to 8 carbon atoms is preferably one of a methyl group, an ethyl group, a propyl group, and an isopropyl group, and more preferably one of a methyl group, an ethyl group, and a propyl group.

When all of $R^{11}$, $R^{11'}$, $R^{12}$ and $R^{12'}$ are a methyl group, $R^{13}$ is preferably a secondary alkyl group. The secondary alkyl group as $R^{13}$ is preferably one of an isopropyl group, an isobutyl group, and a 1-ethylpentyl group, and more preferably is an isopropyl group.

The reducing agent has different thermal development properties depending on the combination of $R^{11}$, $R^{11'}$, $R^{12}$, $R^{12'}$, and $R^{13}$. Since these properties can be controlled by using two or more kinds of the reducing agents in combination in various mixing ratios, it is preferable to use two or more kinds of the reducing agents depending on the purpose.

While examples of the compound as the reducing agent of the invention represented by formula (R) are listed below, the invention is not restricted to these compounds.

R-1

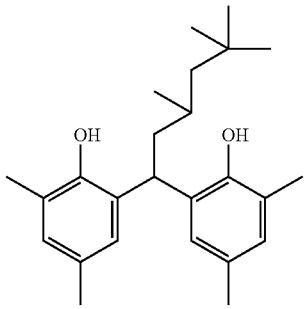

R-2

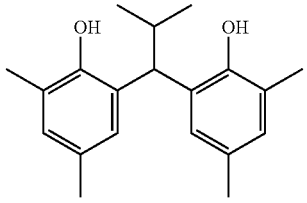

R-3

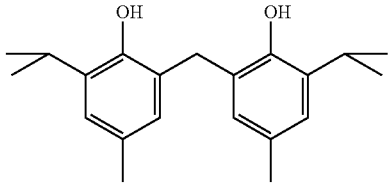

R-4

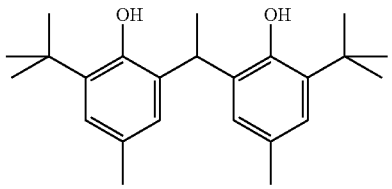

R-5

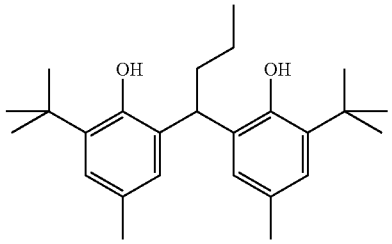

-continued
R-6
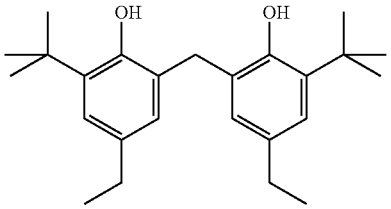
R-7
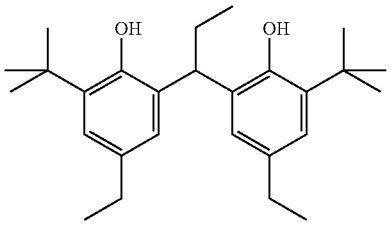
R-8
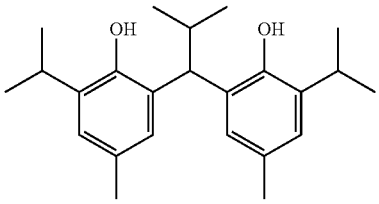
R-9
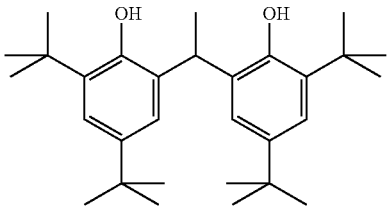
R-10
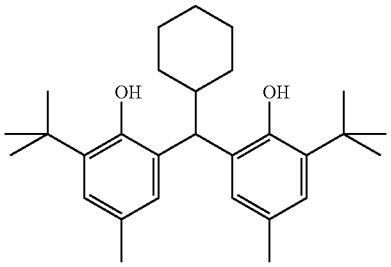
R-11
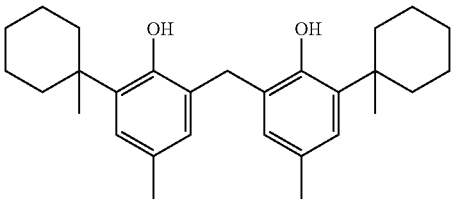
R-12
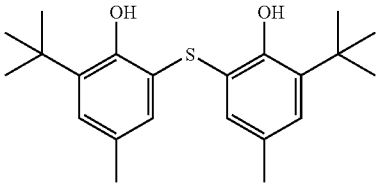
-continued
R-13
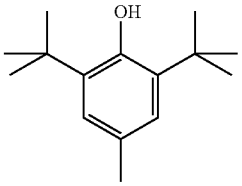
R-14
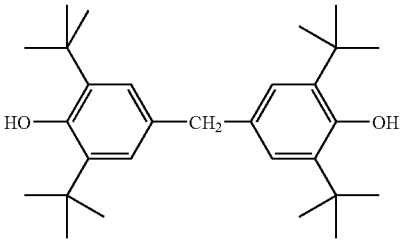
R-15
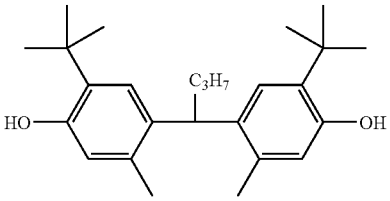
R-16
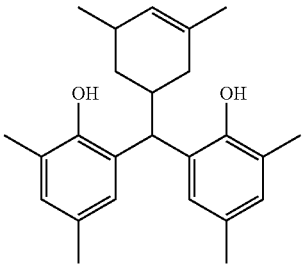
R-17
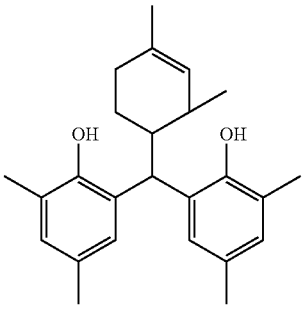
R-18
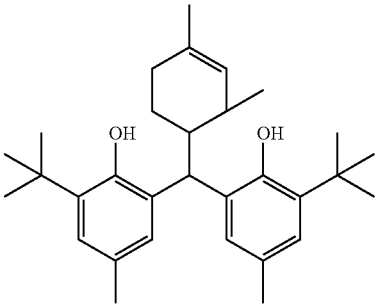
In the invention, the addition amount of the reducing agent is preferably 0.01 g/m$^2$ to 5.0 g/m$^2$, more preferably 0.1 g/m$^2$ to 3.0 g/m$^2$. The reducing agent is contained in a proportion of preferably 5 mol % to 50 mol %, more preferably 10 mol % to 40 mol %, per 1 mol of silver contained in the surface containing the image forming layer.

The reducing agent of the invention can be added to the image forming layer which comprises an organic silver salt and a photosensitive silver halide and to the layer adjacent to the image forming layer, but is preferably contained in the image forming layer.

In the invention, the reducing agent may be incorporated into photothermographic material by being added into the coating solution in any form, such as in the form of solution, emulsion dispersion, solid fine particle dispersion, and the like.

As well known emulsion dispersing method, there can be mentioned a method comprising dissolving the reducing agent in an oil such as dibutyl phthalate, tricresyl phosphate, glyceryl triacetate or diethyl phthalate or the like, and an auxiliary solvent such as ethyl acetate or cyclohexanone, followed by mechanically forming the emulsified dispersion.

As solid fine particle dispersing method, there can be mentioned a method comprising dispersing the reducing agent in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the isopropyl groups in different substitution sites)). Preferably, an antiseptic (for instance, sodium benzoisothiazolinone salt) is added in the water dispersion.

Particularly, the reducing agent is preferably used as a solid particle dispersion, and the reducing agent is added in the form of fine particles having mean particle size from 0.01 μm to 10 μm, and more preferably, from 0.05 μm to 5 μm, and further preferably, from 0.1 μm to 1 μm. In the invention, other solid dispersions are preferably used with this particle size range.

2-4. Development Accelerator

In the photothermographic material of the invention, sulfoneamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, and represented by formula (1) described in the specification of JP-A No. 2002-278017; and phenolic or naphthalic compounds represented by formula (2) described in the specification of JP-A No. 2001-264929 are used preferably as a development accelerator. The development accelerator described above is used in the range from 0.1 mol % to 20 mol %, preferably, in the range from 0.5 mol % to 10 mol % and, more preferably, in the range from 1 mol % to 5 mol % with respect to the reducing agent.

The introducing methods to the photothermographic material can include similar methods as those for the reducing agent and, it is particularly preferred to add as a solid dispersion or an emulsion dispersion. In the case of adding the development accelerator as an emulsion dispersion, it is preferred to add as an emulsion dispersion dispersed by using a high boiling solvent which is solid at a ordinary temperature and an auxiliary solvent at a low boiling point, or to add as a so-called oilless emulsion dispersion not using the high boiling solvent.

Among the above-described development accelerators according to the invention, particularly preferable are, hydrazine compounds represented by formula (1) described in the specification of JP-A No. 2002-278017, and phenolic or naphthalic compounds represented by formula (2) described in the specification of JP-A No. 2001-264929.

Preferred specific examples for the development accelerator of the invention are to be described below, but the invention is not restricted to them.

A-1

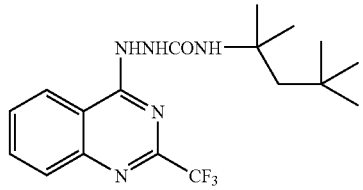

A-2

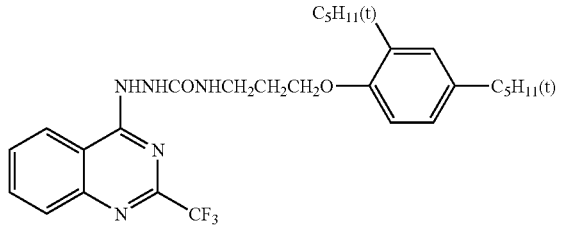

A-3

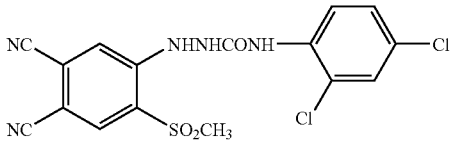

A-4

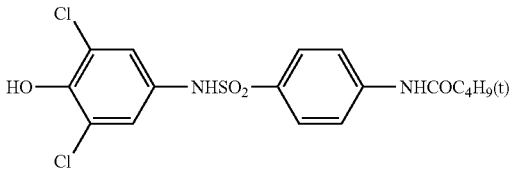

A-5

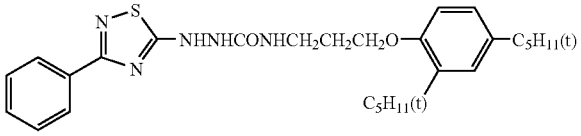

A-6

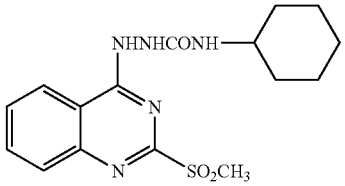

A-7

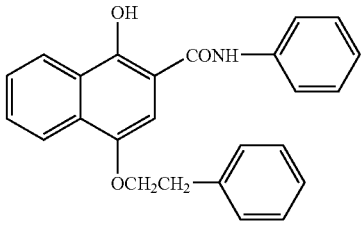

-continued

A-8

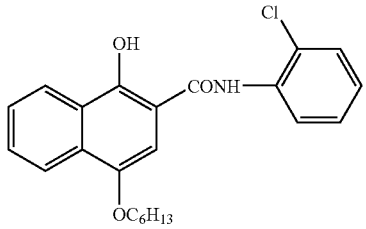

A-9

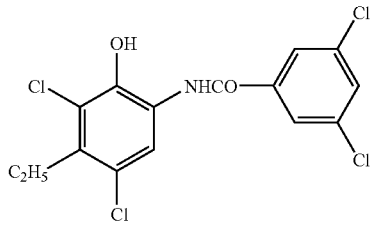

A-10

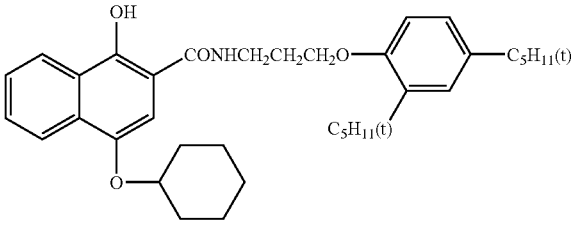

2-5. Hydrogen Bonding Compound

In the invention, in the case where the reducing agent has an aromatic hydroxy group (—OH) or an amino group, it is preferred to use in combination, a non-reducing compound having a group capable of reacting with these groups of the reducing agent, and that is also capable of forming a hydrogen bond therewith.

As a group forming a hydrogen bond, there can be mentioned a phosphoryl group, a sulfoxido group, a sulfonyl group, a carbonyl group, an amido group, an ester group, an urethane group, an ureido group, a tertiary amino group, a nitrogen-containing aromatic group, and the like. Preferred among them is phosphoryl group, sulfoxido group, amido group (not having >N—H moiety but being blocked in the form of >N—Ra (where, Ra represents a substituent other than H)), urethane group (not having >N—H moiety but being blocked in the form of >N—Ra (where, Ra represents a substituent other than H)), and ureido group (not having >N—H moiety but being blocked in the form of >N—Ra (where, Ra represents a substituent other than H)).

In the invention, particularly preferable as the hydrogen bonding compound is the compound expressed by formula (D) shown below.

Formula (D)

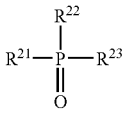

In formula (D), $R^{21}$ to $R^{23}$ each independently represent one selected from an alkyl group, an aryl group, an alkoxy group, an aryloxy group, an amino group, and a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., methyl group, ethyl group, isopropyl group, t-butyl group, t-octyl group, phenyl group, a 4-alkoxyphenyl group, a 4-acyloxyphenyl group, and the like.

Specific examples of an alkyl group expressed by $R^{21}$ to $R^{23}$ include methyl group, ethyl group, butyl group, octyl group, dodecyl group, isopropyl group, t-butyl group, t-amyl group, t-octyl group, cyclohexyl group, 1-methylcyclohexyl group, benzyl group, phenetyl group, 2-phenoxypropyl group, and the like.

As an aryl group, there can be mentioned phenyl group, cresyl group, xylyl group, naphthyl group, 4-t-butylphenyl group, 4-t-octylphenyl group, 4-anisidyl group, 3,5-dichlorophenyl group, and the like.

As an alkoxyl group, there can be mentioned methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, benzyloxy group, and the like.

As an aryloxy group, there can be mentioned phenoxy group, cresyloxy group, isopropylphenoxy group, 4-t-butylphenoxy group, naphthoxy group, biphenyloxy group, and the like.

As an amino group, there can be mentioned are dimethylamino group, diethylamino group, dibutylamino group, dioctylamino group, N-methyl-N-hexylamino group, dicyclohexylamino group, diphenylamino group, N-methyl-N-phenylamino, and the like.

Preferred as $R^{21}$ to $R^{23}$ are an alkyl group, an aryl group, an alkoxy group, and an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by formula (D) of the invention and others are shown below, but it should be understood that the invention is not limited thereto.

D-1

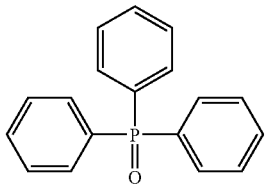

D-2

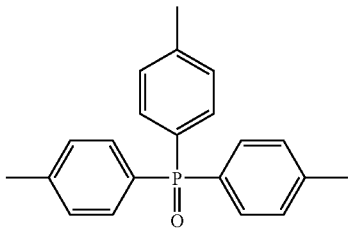

-continued
D-3
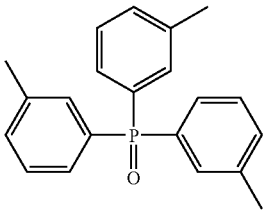
D-4
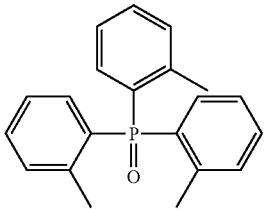
D-5
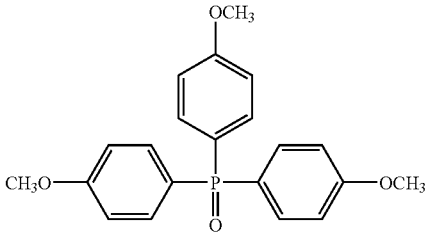
D-6
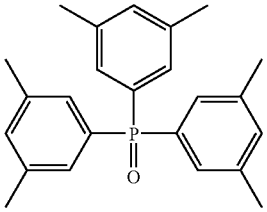
D-7
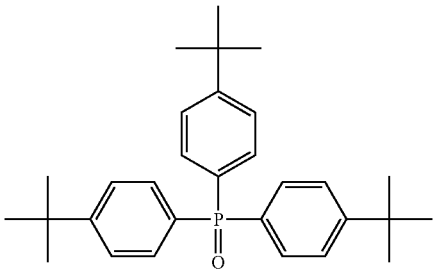
D-8
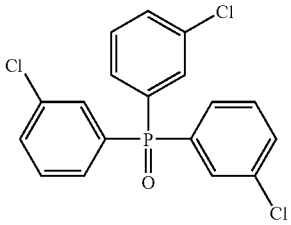
D-9
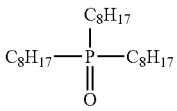
-continued
D-10
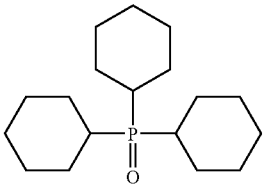
D-11
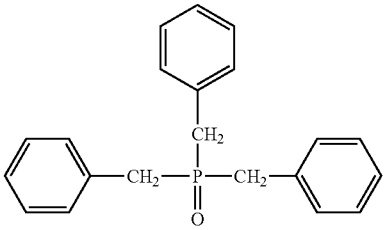
D-12
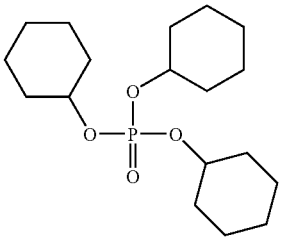
D-13
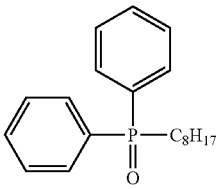
D-14
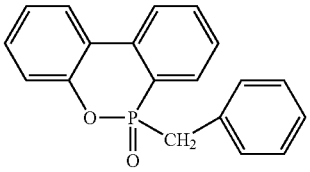
D-15
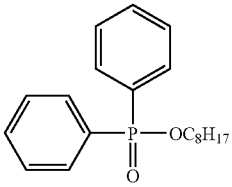
D-16
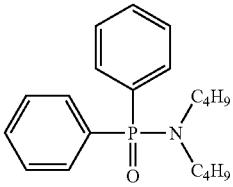

-continued

D-17

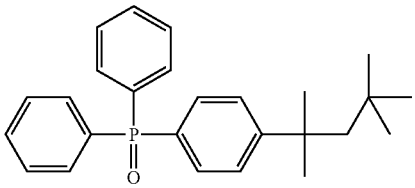

D-18

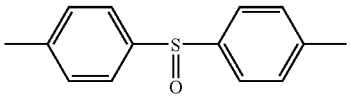

D-19

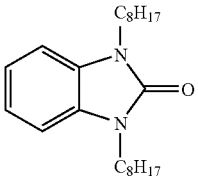

D-20

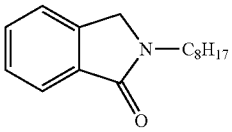

D-21

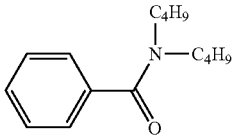

Specific examples of hydrogen bonding compounds other than those enumerated above can be found in those described in JP-A Nos. 2001-281793 and 2002-14438.

The hydrogen bonding compound of the invention can be used in the photothermographic material by being incorporated into the coating solution in the form of solution, emulsion dispersion, or solid fine particle dispersion similar to the case of the reducing agent. In the solution, the hydrogen bonding compound of the invention forms a hydrogen-bonded complex with a compound having a phenolic hydroxy group, and can be isolated as a complex in crystalline state depending on the combination of the reducing agent and the compound expressed by formula (D).

It is particularly preferred to use the crystal powder thus isolated in the form of a solid fine particle dispersion, because it provides stable performance. Further, it is also preferred to use a method of leading to form complex during dispersion by mixing the reducing agent and the hydrogen bonding compound of the invention in the form of powders and dispersing them with a proper dispersing agent using a sand grinder mill and the like.

The hydrogen bonding compound of the invention is preferably used in the range from 1 mol % to 200 mol %, more preferably from 10 mol % to 150 mol %, and further preferably, from 30 mol % to 100 mol %, with respect to the reducing agent.

2-6. Binder

Any kind of polymer may be used as the binder for the image forming layer in the photothermographic material of the invention. Suitable as the binder are those that are transparent or translucent, and that are generally colorless, such as natural resin or polymer and their copolymers; synthetic resin or polymer and their copolymer; or media forming a film; for example, included are gelatin, rubber, poly(vinyl alcohol), hydroxyethyl cellulose, cellulose acetate, cellulose acetate butyrate, poly(vinyl pyrrolidone), casein, starch, poly(acrylic acid), poly(methylmethacrylic acid), poly(vinyl chloride), poly(methacrylic acid), styrene-maleic anhydride copolymers, styrene-acrylonitrile copolymers, styrene-butadiene copolymers, poly(vinyl acetal) (e.g., poly(vinyl formal) and poly(vinyl butyral)), poly(ester), poly(urethane), phenoxy resin, poly(vinylidene chloride), poly(epoxide), poly(carbonate), poly(vinyl acetate), poly(olefin), cellulose esters, and poly(amide). A binder may be used with water, an organic solvent or emulsion to form a coating solution.

In the invention, the glass transition temperature (Tg) of the binder of the image forming layer is preferably in the range from 10° C. to 80° C., more preferably, from 20° C. to 70° C. and, further preferably, from 23° C. to 65° C.

In the specification, Tg is calculated according to the following equation.

$$1/Tg=\Sigma(Xi/Tgi)$$

Where, the polymer is obtained by copolymerization of n monomer compounds (from i=1 to i=n); Xi represents the mass fraction of the ith monomer ($\Sigma Xi=1$), and Tgi is the glass transition temperature (absolute temperature) of the homopolymer obtained with the ith monomer. The symbol $\Sigma$ stands for the summation from i=1 to i=n.

Values for the glass transition temperature (Tgi) of the homopolymers derived from each of the monomers were obtained from J. Brandrup and E. H. Immergut, Polymer Handbook (3rd Edition) (Wiley-Interscience, 1989).

The polymer used for the binder may be of one kind or, may be two or more kinds of polymers, when necessary. And, the polymer having Tg of 20° C. or more and the polymer having Tg of less than 20° C. can be used in combination. In the case where two or more kinds of polymers differing in Tg may be blended for use, it is preferred that the weight-average Tg is in the range mentioned above.

In the case where the image forming layer is formed by first applying a coating solution containing 30% by weight or more of water in the solvent and by then drying, furthermore, in the case where the binder of the image forming layer is soluble or dispersible in an aqueous solvent (water solvent), and particularly in the case where a polymer latex having an equilibrium water content of 2% by weight or lower under 25° C. and 60% RH is used, the performance can be ameliorated.

Most preferred embodiment is such prepared to yield an ion conductivity of 2.5 mS/cm or lower, and as such a preparing method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-admixing organic solvent.

As water-admixing organic solvents, there can be mentioned, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

The term "equilibrium water content under 25° C. and 60% RH" as referred herein can be expressed as follows:

$$\text{Equilibrium water content under 25° C. and 60\% RH}=[(W1-W0)/W0]\times 100\ (\%\text{ by weight})$$

wherein, W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content under 25° C. and 60% RH is preferably 2% by weight or lower, but is more preferably, 0.01% by weight to 1.5% by weight, and is most preferably, 0.02% by weight to 1% by weight.

The binders used in the invention are, particularly preferably, polymers capable of being dispersed in aqueous solvent. Examples of dispersed states may include a latex, in which water-insoluble fine particles of hydrophobic polymer are dispersed, or such in which polymer molecules are dispersed in molecular states or by forming micelles, and both are preferred. The mean particle size of the dispersed particles is in the range from 1 nm to 50,000 nm, and preferably from 5 nm to 1,000 nm. There is no particular limitation concerning particle size distribution of the dispersed particles, and may be widely distributed or may exhibit a monodisperse particle size distribution.

In the invention, preferred embodiment of the polymers capable of being dispersed in aqueous solvent includes hydrophobic polymers such as acrylic polymers, poly(ester), rubber (e.g., SBR resin), poly(urethane), poly(vinyl chloride), poly(vinyl acetate), poly(vinylidene chloride), poly (olefin), and the like. As the polymers above, usable are straight chain polymers, branched polymers, or crosslinked polymers; also usable are the so-called homopolymers in which one kind of monomer is polymerized, or copolymers in which two or more kinds of monomers are polymerized. In the case of a copolymer, it may be a random copolymer or a block copolymer.

The molecular weight of these polymers is, in number average molecular weight, in the range from 5,000 to 1,000,000, preferably from 10,000 to 200,000. Those having too small molecular weight exhibit insufficient mechanical strength on forming the image forming layer, and those having too large molecular weight are also not preferred because the filming properties result poor.

Specific examples of preferred polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of —MMA(70)-EA(27)-MAA(3)— (molecular weight 37000, Tg 61° C.).

P-2; Latex of —MMA(70)-2EHA(20)-St(5)-AA(5)— (molecular weight 40000, Tg 59° C.).

P-3; Latex of —St(50)-Bu(47)-MAA(3)— (crosslinking, Tg −17° C.).

P-4; Latex of —St(68)-Bu(29)-AA(3)— (crosslinking, Tg 17° C.).

P-5; Latex of —St(71)-Bu(26)-AA(3)— (crosslinking, Tg 24° C.).

P-6; Latex of —St(70)-Bu(27)-IA(3)— (crosslinking).

P-7; Latex of —St(75)-Bu(24)-AA(1)— (crosslinking, Tg 29° C.).

P-8; Latex of —St(60)-Bu(35)-DVB(3)-MAA(2)— (crosslinking).

P-9; Latex of —St(70)-Bu(25)-DVB(2)-AA(3)— (crosslinking).

P-10; Latex of —VC (50)-MMA(20)-EA(20)-AN(5)-AA (5)— (molecular weight 80000).

P-11; Latex of —VDC(85)-MMA(5)-EA(5)-MAA(5)— (molecular weight 67000).

P-12; Latex of —Et(90)-MAA(10)— (molecular weight 12000).

P-13; Latex of —St(70)-2EHA(27)-AA(3)— (molecular weight 130000, Tg 43° C.).

P-14; Latex of —MMA(63)-EA(35)-AA(2)— (molecular weight 33000, Tg 47° C.).

P-15; Latex of —St(70.5)-Bu(26.5)-AA(3)— (crosslinking, Tg 23° C.).

P-16; Latex of —St(69.5)-Bu(27.5)-AA(3)— (crosslinking, Tg 20.5° C.).

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of poly(ester), there can be mentioned FINETEX ES650, 611, 675, and 850 (all manufactured by Dainippon Ink and Chemicals, Inc.), WD-size and WMS (all manufactured by Eastman Chemical Co.), and the like; as examples of poly (urethane), there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of poly(olefin), there can be mentioned Chemipearl S120 and SA100 (all manufactured by Mitsui Petrochemical Industries, Ltd.), and the like.

The polymer latex above may be used alone, or may be used by blending two or more kinds depending on needs.

Particularly preferable as the polymer latex for use in the invention is that of styrene-butadiene copolymer. The weight ratio of monomer unit for styrene to that of butadiene constituting the styrene-butadiene copolymer is preferably in the range from 40:60 to 95:5. Further, the monomer unit of styrene and that of butadiene preferably account for 60% by weight to 99% by weight with respect to the copolymer. Preferable range of molecular weight is similar to that described above.

As the latex of styrene-butadiene copolymer preferably used in the invention, there can be mentioned P-3 to P-8, P-14 and P-15, or commercially available LACSTAR-3307B, 7132C, Nipol Lx416, and the like.

In the image forming layer of the photothermographic material according to the invention, when necessary, there can be added hydrophilic polymers such as gelatin, polyvinyl alcohol, methyl cellulose, hydroxypropyl cellulose, carboxymethyl cellulose, and the like.

The hydrophilic polymers above are added at an amount of 30% by weight or less, preferably 20% by weight or less, with respect to the total weight of the binder incorporated in the image forming layer.

According to the invention, the layer containing organic silver salt (the image forming layer) is preferably formed by using polymer latex for the binder. According to the amount of the binder for the image forming layer, the weight ratio for total binder to organic silver salt (total binder/organic silver salt) is preferably in the range of 1/10 to 10/1, and more preferably 1/5 to 4/1.

The layer containing organic silver salt is, in general, a photosensitive layer (image forming layer) containing a photosensitive silver halide, i.e., the photosensitive silver salt; in such a case, the weight ratio for total binder to silver halide (total binder/silver halide) is in the range of from 400 to 5, more preferably, from 200 to 10.

The total amount of binder in the image forming layer of the invention is preferably in the range from 0.2 $g/m^2$ to 30 $g/m^2$, and more preferably from 1 $g/m^2$ to 15 $g/m^2$. As for the image forming layer of the invention, there may be added a crosslinking agent for crosslinking, a surfactant or the like to improve coating properties.

In the invention, a solvent of a coating solution for the image forming layer (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. The water content in a solvent is more preferably 50% by weight or more and still more preferably 70% by weight or more.

Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

2-7. Antifoggant

1) Organic Polyhalogen Compound

In the invention, as an antifoggant, the photothermographic material preferably contains the compound expressed by formula (H) below:

$$Q—(Y)n\text{-}C(Z_1)(Z_2)X \qquad \text{Formula (H)}$$

In formula (H), Q represents one selected from an alkyl group, an aryl group, and a heterocyclic group; Y represents a divalent linking group; n represents 0 or 1; $Z_1$ and $Z_2$ represent a halogen atom; and X represents one selected from a hydrogen atom and an electron-attracting group.

In formula (H), in the case where Q is an aryl group, Q preferably is a phenyl group substituted by an electron-attracting group whose Hammett substituent constant up yields a positive value. For the details of Hammett substituent constant, reference can be made to Journal of Medicinal Chemistry (1973), vol. 16, No. 11, pp. 1207 to 1216, and the like. As such electron-attracting groups, examples can include, halogen atoms, an alkyl group substituted by an electron-attracting group, an aryl group substituted by an electron-attracting group, a heterocyclic group, an alkylsulfonyl group, an arylsulfonyl group, an acyl group, an alkoxycarbonyl group, a carbamoyl group, a sulfamoyl group, and the like. Preferable as the electron-attracting groups are a halogen atom, a carbamoyl group and an arylsulfonyl group, and particularly preferred among them is a carbamoyl group.

X preferably is an electron-attracting group. As the electron-attracting group, preferable are a halogen atom, an aliphatic aryl sulfonyl group, a heterocyclic sulfonyl group, an aliphatic aryl acyl group, a heterocyclic acyl group, an aliphatic aryl oxycarbonyl group, a heterocyclic oxycarbonyl group, a carbamoyl group, and a sulfamoyl group; more preferable are a halogen atom and a carbamoyl group; and particularly preferable is a bromine atom.

$Z_1$ and $Z_2$ are preferably a bromine atom, or an iodine atom, and more preferably, a bromine atom.

Y preferably represents one selected from —C(=O)—, —SO—, —$SO_2$—, —C(=O)N(R)—, and —$SO_2$N(R)—; more preferably represents one selected from —C(=O)—, —$SO_2$—, and —C(=O)N(R)—; and particularly preferably represents one selected from —$SO_2$— and —C(=O)N(R)—. Herein, R represents one selected from a hydrogen atom, an aryl group, and an alkyl group, preferably represents one selected from a hydrogen atom and an alkyl group, and particularly preferably represents a hydrogen atom.

n represents 0 or 1, and preferably represents 1.

Specific examples of the compounds expressed by formula (H) of the invention are shown below, but the present invention is not limited in these.

H-1

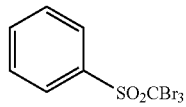

H-2

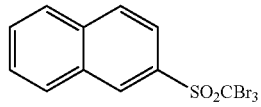

H-3

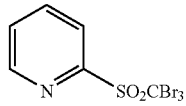

H-4

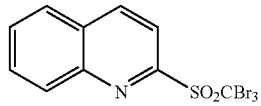

H-5

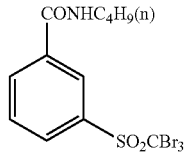

H-6

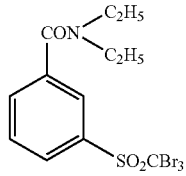

-continued

H-7

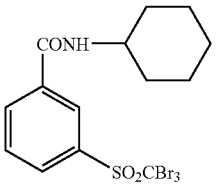

H-8

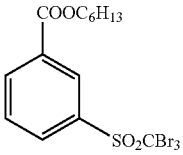

H-9

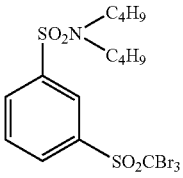

H-10

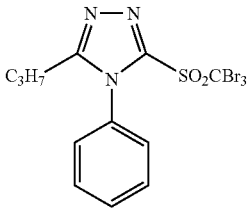

H-11

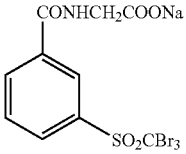

H-12

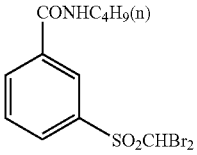

H-13

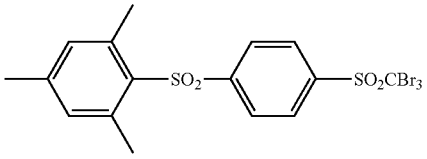

H-14

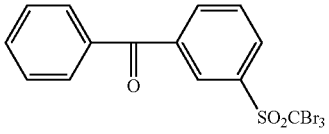

H-15

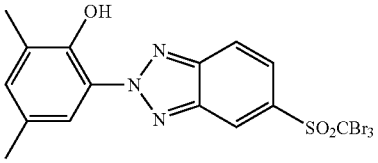

-continued

H-16

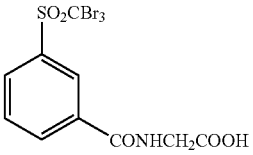

H-17

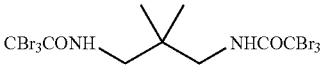

H-18

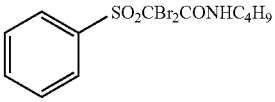

H-19

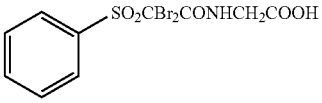

The compounds expressed by formula (H) of the invention are preferably used in an amount of $10^{-4}$ mol to 0.8 mol, more preferably, $10^{-3}$ mol to 0.1 mol, and further preferably, $5\times10^{-3}$ mol to 0.05 mol, per 1 mol of non-photosensitive silver salt incorporated in the image forming layer.

Particularly, in the case where a silver halide having a composition of a high silver iodide content according to the invention is used, the compound is most preferably used in the range from $5\times10^{-3}$ mol to 0.03 mol in order to obtain a sufficient anti-fogging effect.

In the invention, methods of incorporating a compound expressed by formula (H) into a photothermographic material are described in the methods of incorporating a reducing agent described above.

The melting point of the compound expressed by formula (H) is preferably 200° C. or lower, and more preferably 170° C. or lower.

Examples of other organic polyhalogen compound used in the invention are disclosed in paragraphs Nos. 0111 to 0112 of JP-A No. 11-65021. Preferable examples thereof are an organic halogen compound expressed by formula (P) described in JP-A No. 11-87297, an organic polyhalogen compound expressed by formula (II) described in JP-A No. 10-339934 and an organic polyhalogen compound described in JP-A No. 2001-033911.

2) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formaline scavenger compound expressed by formula (S) in JP-A No. 2000-221634, a triazine compound related to claim 9 of JP-A No. 11-352624, a compound expressed by formula (III), 4-hydroxy-6-methyl-1,3,3a,7-tetrazaindene and the like, as described in JP-A No. 6-11791.

As an antifoggant, stabilizer and stabilizer precursor usable in the invention, there can be mentioned those disclosed as patents in paragraph number 0070 of JP-A No. 10-62899 and in line 57 of page 20 to line 7 of page 21 of EP No. 0803764A1, the compounds described in JP-A Nos. 9-281637 and 9-329864.

The photothermographic material of the invention may further contain an azolium salt in order to prevent fog. As azolium salts, there can be mentioned a compound expressed by formula (XI) as described in JP-A No. 59-193447, a compound described in JP-B No. 55-12581, and a compound expressed by formula (II) in JP-A No. 60-153039. The azolium salt may be added to any part of the photothermographic material, but as the addition layer, preferred is to a layer on the surface having thereon the image forming layer, and more preferred is to select the image forming layer.

The azolium salt may be added at any time of the process of preparing the coating solution; in the case the azolium salt is added into the image forming layer, any time of the process may be selected, from the preparation of the organic silver salt to the preparation of the coating solution, but preferred is to add the salt after preparing the organic silver salt and just before coating. As the method for adding the azolium salt, any method using a powder, a solution, a fine-particle dispersion, and the like, may be used. Furthermore, it may be added as a solution having mixed therein other additives such as sensitizing dyes, reducing agents, toners, and the like.

In the invention, the azolium salt may be added at any amount, but preferably, it is added in a range of $1\times10^{-6}$ mol to 2 mol, and more preferably, $1\times10^{-3}$ mol to 0.5 mol per 1 mol of silver.

2-8. Other Additives

1) Mercapto Compounds, Disulfides and Thiones

In the invention, mercapto compounds, disulfide compounds, and thione compounds may be added in order to control the development by suppressing or enhancing development, to improve spectral sensitizing efficiency, and to improve storage properties before and after development. Descriptions can be found in paragraph Nos. 0067 to 0069 of JP-A No. 10-62899, a compound expressed by formula (I) of JP-A No. 10-186572 and specific examples thereof shown in paragraph Nos. 0033 to 0052, in lines 36 to 56 in page 20 of EP-A No. 0803764A1, in JP-A No. 2001-100358 and the like. Among them, mercapto-substituted heterocyclic aromatic compounds are preferred.

2) Toner

In the photothermographic material of the present invention, the addition of a toner is preferred. The description of the toner can be found in JP-A No. 10-62899 (paragraph Nos. 0054 to 0055), EP No. 0803764A1 (page 21, lines 23 to 48), JP-A Nos. 2000-356317 and the like. Preferred are phthalazinones (phthalazinone, phthalazinone derivatives and metal salts thereof, e.g., 4-(1-naphthyl)phthalazinone, 6-chlorophthalazinone, 5,7-dimethoxyphthalazinone and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate and tetrachlorophthalic anhydride); phthalazines (phthalazine, phthalazine derivatives and metal salts thereof, (e.g., 4-(1-naphthyl)phthalazine, 6-isopropylphthalazine, 6-ter-butylphthalazine, 6-chlorophthalazine, 5,7-dimethoxyphthalazine and 2,3-dihydrophthalazine); combinations of phthalazines and phthalic acids. As for the combination with the silver halide having a high silver iodide content, particularly preferred is a combination of phthalazines and phthalic acids.

Preferred addition amount of the phthalazines in the invention is in the range from 0.01 mol to 0.3 mol, more preferably 0.02 mol to 0.2 mol and particularly preferably 0.02 mol to 0.1 mol, per 1 mol of organic silver salt. This addition amount is one important factor for the problem of development acceleration when using a silver halide emulsion having a high silver iodide content of the invention. By selecting appropriate addition amount, both of sufficient development performance and low fog will be possible.

3) Plasticizer and Lubricant

Plasticizers and lubricants usable in the photothermographic material of the invention are described in paragraph No. 0117 of JP-A No. 11-65021. Lubricants are described in paragraph Nos. 0061 to 0064 of JP-A No. 11-84573.

4) Dyes and Pigments

From the viewpoint of improving color tone, preventing the generation of interference fringes and preventing irradiation on laser exposure, various kinds of dyes and pigments (for instance, C.I. Pigment Blue 60, C.I. Pigment Blue 64, and C.I. Pigment Blue 15:6) may be used in the image forming layer of the invention. Detailed description can be found in WO No. 98/36322, JP-A Nos. 10-268465 and 11-338098, and the like.

5) Nucleator

In the photothermographic material according to the invention, it is preferred to add a nucleator into the image forming layer. Details on the nucleators, method of their addition and addition amount can be found in paragraph No. 0118 of JP-A No. 11-65021, paragraph Nos. 0136 to 0193 of JP-A No. 11-223898, as compounds expressed by formulae (H), (1) to (3), (A), and (B) in JP-A No. 2000-284399; as a nucleation accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide, at an amount of 5 mmol or less, preferably, 1 mmol or less per 1 mol of silver.

In the case of using a nucleator in the photothermographic material of the invention, it is preferred to use an acid resulting from hydration of diphosphorus pentaoxide, or a salt thereof in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The amount of usage of the acid obtained by hydration of diphoshorus pentaoxide or the salt thereof (i.e., the coating amount per 1 $m^2$ of the photothermographic material) may be set as desired depending on sensitivity and fogging, but preferred is an amount of 0.1 $mg/m^2$ to 500 $mg/m^2$, and more preferably, of 0.5 $mg/m^2$ to 100 $mg/m^2$.

2-9. Preparation of Coating Solution and Coating

The temperature for preparing the coating solution for the image forming layer of the invention is preferably from 30° C. to 65° C., more preferably, from 35° C. or more to less than 60° C., and further preferably, from 35° C. to 55° C. Furthermore, the temperature of the coating solution for the image forming layer immediately after adding the polymer latex is preferably maintained in the temperature range from 30° C. to 65° C.

2-10. Layer Constitution and Other Constituents

The photothermographic material according to he invention may have a non-photosensitive layer in addition to the image forming layer. The non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer which is provided to the side opposite to the image forming layer.

Furthermore, a layer that functions as an optical filter may be provided as (a) or (b) above. An antihalation layer may be provided as (c) or (d) to the photosensitive material.

1) Surface Protective Layer

The photothermographic material of the invention may further comprise a surface protective layer with an object to prevent adhesion of the image forming layer. The surface protective layer may be a single layer, or plural layers. Description on the surface protective layer may be found in paragraph Nos. 0119 to 0120 of JP-A No. 11-65021 and in JP-A No. 2001-348546.

Preferred as the binder of the surface protective layer of the invention is gelatin, but polyvinyl alcohol (PVA) may be used preferably instead, or in combination. As gelatin, there can be used an inert gelatin (e.g., Nitta gelatin 750), a phthalated gelatin (e.g., Nitta gelatin 801), and the like.

Usable as PVA are those described in paragraph Nos. 0009 to 0020 of JP-A No. 2000-171936, and preferred are the completely saponified product PVA-105 and the partially saponified PVA-205 and PVA-335, as well as modified polyvinyl alcohol MP-203 (trade name of products from Kuraray Ltd.).

The coating amount of polyvinyl alcohol (per 1 $m^2$ of support) in the surface protective layer (per one layer) is preferably in the range from 0.3 $g/m^2$ to 4.0 $g/m^2$, and more preferably, from 0.3 $g/m^2$ to 2.0 $g/m^2$.

The coating amount of whole binder (including water-soluble polymer and polymer latex) (per 1 $m^2$ of support) in the surface protective layer (per one layer) is preferably in the range from 0.3 $g/m^2$ to 5.0 $g/m^2$, and more preferably, from 0.3 $g/m^2$ to 2.0 $g/m^2$.

2) Antihalation Layer

The photothermographic material of the present invention may comprise an antihalation layer provided to the side farther from the light source with respect to the image forming layer. Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case the exposure wavelength is in the infrared region, an infrared-absorbing dye may be used, and in such a case, preferred are dyes having no absorption in the visible region.

In the case of preventing halation from occurring by using a dye having absorption in the visible region, it is preferred that the color of the dye would not substantially reside after image formation, and is preferred to employ a means for bleaching color by the heat of thermal development; in particular, it is preferred to add a thermal bleaching dye and a base precursor to the non-photosensitive layer to impart function as an antihalation layer. Those techniques are described in JP-A No. 11-231457 and the like.

The addition amount of the thermal bleaching dye is determined depending on the usage of the dye. In general, it is used at an amount as such that the optical density (absorbance) exceeds 0.1 when measured at the desired wavelength. The optical density is preferably in the range from 0.2 to 2. The addition amount of dyes to obtain optical density in the above range is generally from 0.001 $g/m^2$ to 1 $g/m^2$.

By decoloring the dye in such a manner, the optical density after thermal development can be lowered to 0.1 or lower. Two or more kinds of thermal bleaching dyes may be used in combination in a photothermographic material. Similarly, two or more kinds of base precursors may be used in combination.

In the case of thermal decolorization by the combined use of a decoloring dye and a base precursor, it is advantageous from the viewpoint of thermal decoloring efficiency to further use the substance capable of lowering the melting point by at least 3° C. when mixed with the base precursor (e.g., diphenylsulfone, 4-chlorophenyl(phenyl)sulfone) as disclosed in JP-A No. 11-352626.

3) Back Layer

Back layers usable in the invention are described in paragraph Nos. 0128 to 0130 of JP-A No. 11-65021.

In the invention, coloring matters having maximum absorption in the wavelength range from 300 nm to 450 nm may be added in order to improve color tone of developed silver images and a deterioration of the images during aging. Such coloring matters are described in, for example, JP-A Nos. 62-210458, 63-104046, 63-103235, 63-208846, 63-306436, 63-314535, 01-61745, 2001-100363, and the like. Such coloring matters are generally added in the range from 0.1 $mg/m^2$ to 1 $g/m^2$, preferably to the back layer which is provided to the side opposite to the image forming layer.

4) Matting Agent

A matting agent may be preferably added to the photothermographic material of the invention in order to improve transportability. Description on the matting agent can be found in paragraphs Nos. 0126 to 0127 of JP-A No. 11-65021.

The addition amount of the matting agent is preferably in the range from 1 $mg/m^2$ to 400 $mg/m^2$, more preferably, from 5 $mg/m^2$ to 300 $mg/m^2$, with respect to the coating amount per 1 $m^2$ of the photothermographic material.

The matt degree of the image forming layer surface is not restricted as far as star-dust trouble occurs, but the matt degree of 30 seconds to 2000 seconds is preferred, particularly preferred, 40 seconds to 1500 seconds as Beck's smoothness. Beck's smoothness can be calculated easily, by seeing Japan Industrial Standared (JIS) P8119 "The method of testing Beck's smoothness for papers and sheets using Beck's test apparatus", or TAPPI standard method T479.

The matt degree of the back layer in the invention is preferably in the range of 1200 seconds or less and 10 seconds or more; more preferably, 800 seconds or less and 20 seconds or more; and further preferably, 500 seconds or less and 40 seconds or more, as expressed by Beck smoothness.

In the invention, the matting agent is incorporated preferably in the outermost surface layer of the photothermographic material, a layer functioning as the outermost surface layer, or a layer near to the outer surface. And, the matting agent is preferably incorporated in a layer that functions as the so-called protective layer.

5) Polymer Latex

A polymer latex can be incorporated in the surface protective layer or in the back layer of the invention.

As such polymer latexes, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Oyo (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl methacrylate (25.4% by weight)/styrene (8.6% by weight)/2-hydroethyl methacrylate (5.1% by weight)/acrylic acid (2.0% by weight) copolymer, a latex of methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer, and the like.

The polymer latex preferably is contained in an amount of 10% by weight to 90% by weight, particularly preferably, of 20% by weight to 80% by weight of all of the binder (including water-soluble polymer and polymer latex) in the surface protective layer or in the back layer.

6) Surface pH

The surface pH of the photothermographic material according to the invention preferably yields a pH of 7.0 or lower, more preferably, 6.6 or lower, before thermal development treatment. Although there is no particular restriction concerning the lower limit, the lower limit of pH value is about 3, and the most preferred surface pH range is from 4 to 6.2.

From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

7) Hardener

A hardener may be used in each of image forming layer, protective layer, back layer, and the like.

As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone based compounds of JP-A No. 62-89048.

The hardener is added as a solution, and the solution is added to the coating solution for the protective layer 180 minutes before coating to just before coating, preferably 60 minutes before to 10 seconds before coating. However, so long as the effect of the invention is sufficiently exhibited, there is no particular restriction concerning the mixing method and the conditions of mixing.

As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Liquid Mixing Technology" (Nikkan Kogyo Shinbunsya, 1989), and the like.

8) Surfactant

As the surfactant applicable in the invention, there can be mentioned those disclosed in paragraph No. 0132 of JP-A No. 11-65021.

In the invention, it is preferred to use fluorocarbon surfactants. Specific examples of fluorocarbon surfactants can be found in those described in JP-A Nos. 10-197985, 2000-19680, and 2000-214554. Polymer fluorocarbon surfactants described in JP-A No. 9-281636 can be also used preferably.

9) Antistatic Agent

The photothermographic material of the invention may contain an electrically conductive layer including various kinds of metal oxides or electrically conductive polymers known to the public. The antistatic layer may serve as an undercoat layer described above, or a back surface protective layer, and the like, but can also be placed specially. As to the antistatic layer, technologies described in paragraph No. 0135 of JP-A No. 11-65021, JP-A Nos. 56-143430, 56-143431, 58-62646, and 56-120519, and in paragraph Nos. 0040 to 0051 of JP-A No. 11-84573, U.S. Pat. No. 5,575,957, and in paragraph Nos. 0078 to 0084 of JP-A No. 11-223898 can be applied.

10) Support

As the transparent support, favorably used is polyester, particularly, polyethylene terephthalate, which is subjected to heat treatment in the temperature range from 130° C. to 185° C. in order to relax the internal strain caused by biaxial stretching and remaining inside the film, and to remove strain ascribed to heat shrinkage generated during thermal development.

As the support of the photothermographic material used in combination with the ultraviolet light emission screen, PEN is preferably used, but the present invention is not limited thereto. As the PEN, polyethylene-2,6-naphthalate is preferred.

The "polyethylene-2,6-naphthalate" herein means that the structure repeating units essentially may consist of ethylene-2,6-naphthalene dicarboxylate groups and also may include un-copolymerized polyethylene-2,6-naphthalene dicarboxylate, and the copolymer containing 10% or less, and preferably 5% or less, of the structure repeating units denatured with the other components and mixtures or constituents of other polymer.

Polyethylene-2,6-naphthalate can be synthesized by reacting a naphthalene-2,6-dicarboxylic acid or functional derivatives thereof, and an ethylene glycol or functional derivatives thereof in the presence of a suitable catalyst at proper reaction condition. The polyethylene-2,6-naphthalate of the present invention may be copolymerized or blended polysters, where one or more kinds of suitable third component (denaturing agent) is added before the completion of polymerization of the polyethylene-2,6-aphthalate. As the suitable third component, compounds containing a divalent ester forming functional group, for example, dicarboxylic acids such as oxalic acid, adipic acid, phthalic acid, isophthalic acid, terephthalic acid, naphthalene-2,7-dicarboxylic acid, succinic acid, diphenylether dicarboxylic acid and the like, or lower alkylesters thereof, oxycarboxylic acids such as p-oxybenzoic acid, p-oxyethoxybenzoic acid, or lower alkylesters thereof, and divalent alcohols such as propylene glycol, trimethylene glycol and the like are described. Polyethylene-2,6-naphthalate and the denatured polymers thereof may include, for example, the polymer where the terminal hydroxy group and/or the carboxylic group is blocked by mono-functional compounds such as benzoic acid, benzoyl benzoic acid, benzyloxy benzoic acid, methoxy polyalkylene glycol and the like, or the polymer denatured with a very small amount of compounds having tri-functional or tetra-functional ester forming group such as glycerine and penta-erthritol in the extent to form linear chain copolymers substantially.

In the case of a photothermographic material for medical use, the transparent support may be colored with a blue dye (for instance, dye-I described in Examples of JP-A No. 8-240877), or may be uncolored.

Exemplified embodiments of the support are described in paragraph No. 0134 of JP-A No. 11-65021.

As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684.

11) Other Additives

Furthermore, antioxidant, stabilizing agent, plasticizer, UV absorbent, or a film forming promoting agent may be added to the photothermographic material. A solvent described in paragraph No. 0133 of JP-A No. 11-65021 may be added. Each of the additives is added to either of the image forming layer (photosensitive layer) or the non-photosensitive layer. Reference can be made to WO No. 98/36322, EP No. 803764A1, JP-A Nos. 10-186567 and 10-18568, and the like.

12) Coating Method

The photothermographic material of the invention may be coated by any method. More specifically, various types of coating operations inclusive of extrusion coating, slide coating, curtain coating, immersion coating, knife coating, flow coating, or an extrusion coating using the kind of hopper described in U.S. Pat. No. 2,681,294 are used. Preferably used is extrusion coating or slide coating described in pages 399 to 536 of Stephen F. Kistler and Petert M. Schweizer, "LIQUID FILM COATING" (Chapman & Hall, 1997), and particularly preferably used is slide coating.

Example of the shape of the slide coater for use in slide coating is shown in FIG. 11b.1, page 427, of the same literature. If desired, two or more layers can be coated simultaneously by the method described in pages 399 to 536 of the same literature, or by the method described in U.S. Pat. No. 2,761,791 and British Patent No. 837095.

The coating solution for the image forming layer in the invention is preferably a so-called thixotropic fluid. For the details of this technology, reference can be made to JP-A No. 11-52509.

Viscosity of the coating solution for the image forming layer in the invention at a shear velocity of 0.1 $s^{-1}$ is preferably from 400 mPa·s to 100,000 mPa·s, and more preferably, from 500 mPa·s to 20,000 mPa·s.

At a shear velocity of 1000 $S^{-1}$, the viscosity is preferably from 1 mPa·s to 200 mPa·s, and more preferably, from 5 mPa·s to 80 mPa·s.

13) Wrapping Material

In order to suppress fluctuation from occurring on the photographic property during a preservation of the invention before thermal development, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1}m^{-2}day^{-1}$ or lower at 25° C., more preferably, 10 $mL \cdot atm^{-1}m^{-2}day^{-1}$ or lower, and further preferably, 1.0 mL $atm \cdot m^{-2}day^{-1}$ or lower. Preferably, vapor transmittance is 10 $g \cdot atm^{-1}m^{-2}day^{-1}$ or lower, more preferably, 5 $g \cdot atm^{-1}m^{-2}day^{-1}$ or lower, and further preferably, 1 $g \cdot atm^{-1}m^{-2}day^{-1}$ or lower. As specific examples of a wrapping material having low oxygen transmittance and/or vapor transmittance, reference can be made to, for instance, the wrapping material described in JP-A Nos. 8-254793 and 2000-206653.

14) Other Applicable Techniques

Techniques which can be used for the photothermographic material of the invention also include those in EP No. 803764A1, EP No. 883022A1, WO No. 98/36322, JP-A Nos. 56-62648, 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-20699, 2001-275471, 2001-275461, 2000-313204, 2001-292844, 2000-324888, 2001-293864 and 2001-348546.

15) Color Image Formation

The constitution of a multicolor photothermographic material may include combinations of two layers for those for each of the colors, or may contain all the components in a single layer as described in U.S. Pat. No. 4,708,928.

In the case of multicolor photothermographic material, each of the image forming layers is maintained distinguished from each other by incorporating functional or non-functional barrier layer between each of the photosensitive layers as described in U.S. Pat. No. 4,460,681.

3. Image Forming Method 3-1. Exposure

The photothermographic material of the present invention may be either "single-sided type" having an image forming layer on one side of the support, or "double-sided type" having image forming layers on both sides of the support.

(Double-sided Type Photothermographic Material)

The photothermographic material of the present invention is preferably applied for an image forming method to record X-ray images using an X-ray intensifying screen.

The image forming method using these photothermographic materials comprises the steps of:

(a) providing an assembly for forming an image by placing the photothermographic material between a pair of the X-ray intensifying screens, (b) putting an analyte between the assembly and the X-ray source, (c) applying an X-ray, which has an energy level in the range of 25 kVp to 125 kVp, to the analyte, (d) taking the photothermographic material out of the assembly, and (e) heating the thus taken out photothermographic material in the temperature range of 90° C. to 180° C.

The photothermographic material used for the assembly in the present invention is subjected to X-ray exposure through a step wedge tablet and thermal development. On the photographic characteristic curve having an optical density (D) and an exposure amount (log E) along the rectangular coordinates having the equal axis-of-coordinate unit, it is preferred to adjust so that the thermal developed image may have the photographic characteristic curve where the average gamma (γ) made at the points of a density of fog+0.1 and a density of fog+0.5 is from 0.5 to 0.9, and the average gamma (γ) made at the points of a density of fog+1.2 and a density of fog+1.6 is from 3.2 to 4.0.

For the X-ray radiography employed in the practice of the present invention, the use of photothermographic material having the aforesaid photographic characteristic curve would give the X-ray images with excellent photographic properties that exhibit an extended bottom portion and high gamma value at middle density area. According to these photogaraphic properties, the depiction in low density portion, on the mediastinal region, the heart shadow region and the like, having little X-ray transmittance becomes excellent, and the density becomes pleasing to the eye, and the contrast in the images on the lung field region having much X-ray transmittance becomes excellent.

The photothermographic material having the preferred photographic characteristic curve mentioned above can be easily prepared, for example, by the method where each of the image forming layer of both sides may be constituted of two or more image forming layers containing silver halide and having a sensitivity different from each other. Especially, the aforesaid image forming layer preferably comprises an emulsion of high sensitivity for the upper layer and an emulsion with photographic properties of low sensitivity and high contrast for the lower layer.

In the case of preparing the image forming layer containing two layers, the sensitivity difference between the silver halide emulsion in each layer is preferably from 1.5 times to 20 times, and more preferably from 2 times to 15 times. The ratio of the amount of emulsion used for forming each layer may depend on the sensitivity difference between emulsions used and the covering power. Generally, as the sensitivity difference is large, the ratio of the using amount of high sensitivity emulsion is reduced.

For example, if the sensitivity difference is two times, and the covering power is equal, the ratio of the amount of high sensitivity emulsion to low sensitivity emulsion would be preferably adjusted to be in the range from 1:20 to 1:50 based on silver amount.

As the techniques for crossover cut (in the case of double-sided coated photosensitive material) and anti-halation (in the case of single-sided coated photosensitive material), dyes or combined use of dye and mordant described in JP-A. No. 2-68539, (from page 13, left lower column, line 1, to page 14, left lower column, line 9) can be employed.

Next the fluorescent intensifying screen (radiographic intensifying screen) employed in the practice of the present invention is explained below. The radiographic intensifying screen essentially comprises a support and a fluorescent substance layer coated on one side of the support as the fundamental structure. The fluorescent substance layer is a layer where the fluorescent substance is dispersed in bonding agents (binders). On the surface of a fluorescent substance layer opposite to the support side (the surface of the side that does not face on the support), a transparent protective layer is generally disposed to protect the fluorescent substance layer from chemical degradation and physical shock.

Preferred fluorescent substances of the present invention are described below. Tungstate type fluorescent substances ($CaWO_4$, $MgWO_4$, $CaWO_4$:Pb and the like), terbium activated rare earth sulfoxide type fluorescent substances [$Y_2O_2S$:Tb, $Gd_2O_2S$:Tb, $La_2O_2S$:Tb, $(Y,Gd)_2O_2S$:Tb, $(Y,Gd)O_2S$:Tb, Tm and the like], terbium activated rare earth phosphate type fluorescent substances ($YPO_4$:Tb, $GdPO_4$:Tb, $LaPO_4$:Tb and the like), terbium activated rare earth oxyhalogen type fluorescent substances (LaOBr:Tb, LaOBr:Tb, Tm, LaOCl:Tb, LaOCl:Tb, Tm, LaOBr:Tb, GdOBr:Tb, GdOCl:Tb and the like), thulium activated rare earth oxyhalogen type fluorescent substances (LaOBr:Tm, LaOCl:Tm and the like), barium sulfate type fluorescent substances [$BaSO_4$:Pb, $BaSO_4$:$Eu^{2+}$, $(Ba,Sr)SO_4$:$Eu^{2+}$ and the like], divalent europium activated alkali earth metal phosphate type fluorescent substances [$(Ba_2PO_4)_2$:$Eu^{2+}$, $(Ba_2PO_4)_2$:$Eu^{2+}$, and the like], divalent europium activated alkali earth metal fluorinated halogenide type fluorescent substances [BaFCl:$Eu^{2+}$, BaFBr:$Eu^{2+}$, BaFCl:$Eu^{2+}$, Tb, BaFBr:$Eu^{2+}$, Tb, $BaF_2$.BaCl.KCl:$Eu^{2+}$, (Ba,Mg)$F_2$.BaCl.KCl:$Eu^{2+}$, and the like], iodide type fluorescent substances (CsI:Na, CsI:Tl, NaI, KI:Tl and the like), sulfide type fluorescent substances [ZnS:Ag(Zn,Cd)S:Ag, (Zn,Cd)S:Cu, (Zn,Cd)S:Cu, Al and the like], hafnium phosphate type fluorescent substances ($HfP_2O_7$:Cu and the like).

However, the fluorescent substance used in the present invention is not particularly limited to these specific examples, so long as to emit light in visible and near ultraviolet region by exposure to a radioactive ray.

In the fluorescent intensifying screen used in the present invention, the fluorescent substances are preferably packed in the grain size graded structure. Especially, fluorescent substance particles having a large particle size is preferably coated at the side of the surface protective layer and fluorescent substance particles having a small particle size is preferably coated at the side of the the support. Hereto, the small particle size of fluorescent substance is preferably in the range from 0.5 μm to 2.0 μm and the large size is preferably in the range from 10 μm to 30 μm.

(Single-sided Type Photothermographic Material)

The single-sided type photothermographic material of the present invention is favorably applied for an X-ray photosensitive material used for mammography.

To use the single-sided type photothermographic material for that purpose, it is very important to design the contrast of the obtained image in the suitable range.

Concerning the preferable constitutive conditions as an X-ray photosensitive material for mammography, those described in JP-A Nos. 5-45807, 10-62881, 10-54900, and 11-109564 can be referred.

(Combined use with Ultraviolet Fluorescent Screen)

As for the image forming method using photothermographic material according to the present invention, it is preferred that the image forming method is perfomed in combination with a fluorescent substance having a main emission peak at 400 nm or lower. And more preferably, the image forming method is performed in combination with a fluorescent substance having a main emission peak at 380 nm or lower. Either double-sided coated photosensitive material or single-sided coated photosensitive material can be applied for the assembly. As the screen having a main emission peak at 400 nm or lower, the screens described in JP-A No. 6-11804 and WO No. 93/01521 and the like are used, but the present invention is not limited to these. As the techniques of crossover cut (for double-sided coated photosensitive material) and anti-halation (for single-sided coated photosensitive material) of ultraviolet light, the technique described in JP-A No. 8-76307 can be applied. As ultraviolet absorbing dyes, the dye described in JP-A No. 2001-144030 is particularly preferred.

3-2. Thermal Development

Although any method may be used for the development of the photothermographic material of the invention, thermal development is usually performed by elevating the temperature of the photothermographic material exposed imagewise. The temperature for the development is preferably in the range from 90° C. to 180° C., and more preferably, from 100° C. to 140° C.

Time period for development is preferably in the range from 1 second to 60 seconds, more preferably from 5 seconds to 30 seconds, and particularly preferably from 5 seconds to 20 seconds.

In the process for thermal development, plate type heater processes are preferred. Preferable process for thermal development by a plate type heater may be a process described in JP-A NO. 11-133572, which discloses a thermal developing device in which a visible image is obtained by bringing a photothermographic material with a formed latent image into contact with a heating means at a thermal developing portion, wherein the heating means comprises a plate heater, and plurality of retainer rollers are oppositely provided along one surface of the plate heater, the thermal developing device is characterized in that thermal development is performed by passing the photothermographic material between the retainer rollers and the plate heater. It is preferred that the plate heater is divided into 2 to 6 parts, with the leading end having the lower temperature by 1° C. to 10° C.

Such a process is also described in JP-A NO. 54-30032, which allows for excluding moisture and organic solvents included in the photothermographic material out of the system, and also allows for suppressing the change of shapes of the support of the photothermographic material upon rapid heating of the photothermographic material.

3-3. System

Examples of a medical laser imager equipped with a light exposing portion and a thermal developing portion include Fuji Medical Dry Laser Imager FM-DP L and DRYPIX 7000. Concerning FM-DP L, description is found in Fuji Medical Review, No. 8, pages 39 to 55, and these techniques can be applied. In addition, the present photothermographic material can be also applied as a photothermographic material for the laser imager used in "AD network" which was proposed by Fuji Film Medical Co., Ltd. as a network system accommodated to DICOM standard.

4. Application of the Invention

The image forming method in which the photothermographic material of the invention is used is preferably employed as image forming methods for photothermographic materials for use in medical imaging, photothermographic materials for use in industrial photographs, photothermographic materials for use in graphic arts, as well as for COM, through forming black and white images by silver imaging.

EXAMPLES

The present invention is specifically explained by way of Examples below, which should not be construed as limiting the invention thereto.

Example 1

1. Preparation of Photosensitive Silver Halide Emulsion (Preparation of Silver Halide Emulsion-1)

A solution was prepared by adding 8 mL of a 10% by weight potassium iodide solution, and then 12 mL of 1 mol/L sodium hydroxide, 36.5 g of succinated gelatin, and 160 mL of a 5% by weight methanol solution of 2,2'-(ethylenedithio)-diethanol to 1421 mL of distilled water. The solution was kept at 75° C. while stirring in a stainless steel reaction vessel, and thereto were added total amount of: solution A prepared through diluting 22.22 g of silver nitrate by adding distilled water to give the volume of 218 mL; and solution B prepared through diluting 36.6 g of potassium iodide with distilled water to give the volume of 366 mL. A method of controlled double jet was executed through adding total amount of the solution A at a constant flow rate over 32 minutes, accompanied by adding the solution B while maintaining the pAg at 10.2. Thereafter, 10 mL of a 3.5% by weight aqueous solution of hydrogen peroxide was added thereto, and 10.8 mL of a 10% by weight aqueous solution of benzimidazole was further added.

Thereafter, a solution C prepared through diluting 51.86 g of silver nitrate by adding distilled water to give the volume of 508.2 mL and a solution D prepared through diluting 63.9 g of potassium iodide with distilled water to give the volume of 639 mL were added. A method of controlled double jet was executed through adding total amount of the solution C at a constant flow rate over 160 minutes, accompanied by adding the solution D while maintaining the pAg at 10.2. Hexachloroiridium (III) potassium salt was added in its entirety to give $1\times10^{-4}$ mol per 1 mol of silver, at 20 minutes post initiation of the addition of the solution C and the solution D.

Moreover, at 5 seconds after completing the addition of the solution C, a potassium iron (II) hexacyanide aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide emulsion-1 having the pAg of 11.0.

The silver halide grains in the resulting silver halide emulsion-1 were pure silver iodide grains, and silver halide grains having an aspect ratio of 2 or more occupied 58% of the total projected area. The grains had a mean equivalent spherical diameter of 0.42 μm, a variation coefficient of an equivalent spherical diameter distribution of 32%, a mean equivalent circular diameter of 0.72 μm, a variation coefficient of an equivalent circular diameter distribution of 35%, a mean thickness of 0.1 μm, and a mean aspect ratio of 7. 30% or more of the silver iodide existed in γ phase from the result of powder X-ray diffraction analysis.

(Preparation of Silver Halide Emulsion-2)

Preparation of silver halide emulsion-2 was conducted in a similar manner to the process in the preparation of the silver halide emulsion-1 except that 4 g of succinated gelatin was added before the first controlled double jet addition, thereafter 32.5 g of succinated gelatin was added before the second controlled double jet addition and subjected to ripening for 20 minutes.

The silver halide grains in the resulting silver halide emulsion-2 were pure silver iodide grains and grains having an aspect ratio of 2 or more occupied 83% of the total projected area. The grains had a mean equivalent spherical diameter of 0.42 μm, a variation coefficient of an equivalent spherical diameter distribution of 19%, a mean equivalent circular diameter of 0.7 μm, a variation coefficient of an equivalent circular diameter distribution of 24%, a mean thickness of 0.1 μm and a mean aspect ratio of 7.2. 30% or more of the silver iodide existed in γ phase from the result of powder X-ray diffraction analysis.

(Preparation of Silver Halide Emulsion-3)

Preparation of silver halide emulsion-3 was conducted in a similar manner to the process in the preparation of silver halide emulsion-1 except that 18 g of phthalated gelatin was added before the first controlled double jet addition and thereafter 18.5 g of phthalated gelatin was added before the second controlled double jet addition.

The silver halide grains in the resulting silver halide emulsion-3 were pure silver iodide grains and grains having an aspect ratio of 2 or more occupied 87% of the total projected area. The grains had a mean equivalent spherical diameter of 0.42 μm, a variation coefficient of an equivalent spherical diameter distribution of 22%, a mean equivalent circular diameter of 0.9 μm, a variation coefficient of an equivalent circular diameter distribution of 26%, a mean thickness of 0.057 μm, and a mean aspect ratio of 16.4. 30% or more of the silver iodide existed in γ phase from the result of powder X-ray diffraction analysis.

(Preparation of Silver Halide Emulsion-4)

Preparation of silver halide emulsion-4 was conducted in a similar manner to the process in the preparation of silver halide emulsion-1 except that 9 g of phthalated gelatin was added before the first controlled double jet addition and thereafter 27.5 g of phthalated gelatin was added before the second controlled double jet addition and subjected to ripening for 15 minutes.

The silver halide grains in the resulting silver halide emulsion-4 were pure silver iodide grains and grains having an aspect ratio of 2 or more occupied 92% of the total projected area. The grains had a mean equivalent spherical diameter of 0.42 μm, a variation coefficient of an equivalent spherical diameter distribution of 17%, a mean equivalent circular diameter of 0.94 μm, a variation coefficient of an equivalent circular diameter distribution of 21%, a mean thickness of 0.056 μm, and a mean aspect ratio of 16.7.30% or more of the silver iodide existed in γ phase from the result of powder X-ray diffraction analysis.

(Preparation of Silver Halide Emulsion-5)

Preparation of silver halide emulsion-5 was conducted in a similar manner to the process in the preparation of silver halide emulsion-1 except that 4.5 g of phthalated gelatin was added before the first controlled double jet addition and thereafter 32 g of phthalated gelatin was added before the second controlled double jet addition.

The silver halide grains in the resulting silver halide emulsion-5 were pure silver iodide grains and grains having an aspect ratio of 2 or more occupied 94% of the total projected area. The grains had a mean equivalent spherical diameter of 0.42 μm, a variation coefficient of an equivalent spherical diameter distribution of 14%, a mean equivalent circular diameter of 0.96 μm, a variation coefficient of an equivalent circular diameter distribution of 16%, a mean thickness of 0.054 μm, and a mean aspect ratio of 17.7.30% or more of the silver iodide existed in γ phase from the result of powder X-ray diffraction analysis.

(Preparation of Silver Halide Emulsion-6)

Preparation of silver halide emulsion-6 was conducted in a similar manner to the process in the preparation of silver halide emulsion-1 except that 2.5 g of phthalated gelatin was added before the first controlled double jet addition and thereafter 34 g of succinated gelatin was added before the second controlled double jet addition and subjected to ripening for 30 minutes.

The silver halide grains in the resulting silver halide emulsion-6 were pure silver iodide grains and grains having an aspect ratio of 2 or more occupied 95% of the total projected area. The grains had a mean equivalent spherical diameter of 0.42 μm, a variation coefficient of an equivalent spherical diameter distribution of 15%, a mean equivalent circular diameter of 0.93 μm, a variation coefficient of an equivalent circular diameter distribution of 19%, a mean thickness of 0.057 μm, and a mean aspect ratio of 16.2. 30% or more of the silver iodide existed in γ phase from the result of powder X-ray diffraction analysis.

(Preparation of Silver Halide Emulsion-7)

Preparation of silver halide emulsion-7 was conducted in a similar manner to the process in the preparation of silver halide emulsion-5 except that each 14 mL of the solution A and solution B were added at a constant flow rate over one minute and subjected to ripening for 5 minutes, and thereafter a method of controlled double jet was executed through adding total amount of the solution A at a constant flow rate over 40 minutes, accompanied by adding the solution B while maintaining the pAg at 10.2.

The silver halide grains in the resulting silver halide emulsion-7 were pure silver iodide grains and grains having an aspect ratio of 2 or more occupied 98% of the total projected area. The grains had a mean equivalent spherical diameter of 0.42 μm, a variation coefficient of an equivalent spherical diameter distribution of 13%, a mean equivalent circular diameter of 0.97 μm, a variation coefficient of an equivalent circular diameter distribution of 15%, a mean thickness of 0.053 μm, and a mean aspect ratio of 18.30% or more of the silver iodide existed in γ phase from the result of powder X-ray diffraction analysis.

2. Evaluation of Silver Halide Emulsion-1 to -7

The forms of silver halide grains prepared above are summarized in the following Table 1.

From the data in Table 1, it is apparent that in silver halide emulsion-2 to -7, where the nucleating processes were done in a gelatin concentration range of 0.5 g to 15 g per 1 liter of water, the silver halide grains had an increased ratio of tabular silver halide grains having an aspect ratio of 2 or more, and the obtained tabular silver halide grains showed a remarkable narrow distribution in the equivalent spherical diameter and the equivalent circular diameter.

TABLE 1

| Emulsion No. | Ratio of Occupied Projected Area* (%) | Dc(μm) | Variation Coefficient of Dc(%) | Th(μm) | AR | Dsp(μm) | Variation Coefficient of Dsp(%) |
|---|---|---|---|---|---|---|---|
| 1 | 58 | 0.72 | 35 | 0.1 | 7.0 | 0.42 | 32 |
| 2 | 83 | 0.70 | 24 | 0.1 | 7.2 | 0.42 | 19 |
| 3 | 87 | 0.90 | 26 | 0.057 | 16.4 | 0.42 | 22 |
| 4 | 92 | 0.94 | 21 | 0.056 | 16.7 | 0.42 | 17 |
| 5 | 94 | 0.96 | 16 | 0.054 | 17.7 | 0.42 | 14 |

TABLE 1-continued

| Emulsion No. | Ratio of Occupied Projected Area* (%) | Dc(μm) | Variation Coefficient of Dc(%) | Th(μm) | AR | Dsp(μm) | Variation Coefficient of Dsp(%) |
|---|---|---|---|---|---|---|---|
| 6 | 95 | 0.93 | 19 | 0.057 | 16.2 | 0.42 | 15 |
| 7 | 98 | 0.97 | 15 | 0.053 | 18.0 | 0.42 | 13 |

Dc: mean equivalent circular diameter
Th: mean grain thickness
AR: mean aspect ratio
Dsp: mean equivalent spherical diameter
*Ratio of projected area occupied by grains having an aspect ratio of 2 or more

Example 2

1. Preparation of Silver Halide Emulsion-11 to −17

1 mol of the silver halide emulsion-1 to -7 prepared above in Example 1 was added to the reaction vessel. 0.5 mol/L potassium bromide solution and 0.5 mol/L silver nitrate solution were added at an addition speed of 10 mL/min over 20 minutes by the method of double jet addition to precipitate substantially a 10 mol % of silver bromide on the host silver iodide grains as epitaxial form while keeping the pAg at 10.2 during the operation. Furthermore, the mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

The above silver halide dispersion was kept at 38° C. with stirring, and thereto was added 5 mL of a 0.34% by weight methanol solution of 1,2-benzoisothiazoline-3-one, and after 40 minutes the temperature was elevated to 47° C. At 20 minutes after elevating the temperature, sodium benzene thiosulfonate in a methanol solution was added at $7.6\times10^{-5}$ mol per 1 mol of silver. At additional 5 minutes later, a tellurium sensitizer C in a methanol solution was added at $2.9\times10^{-5}$ mol per 1 mol of silver and subjected to ripening for 91 minutes. And then, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureido phenyl)-5-mercaptotetrazole in an aqueous solution at $8.5\times10^{-3}$ mol per 1 mol of silver were added to produce silver halide emulsion-11 to -17.

2. Preparations of Photothermographic Material 2-1. Undercoating of the Support

The biaxially tentered and blue tinted polyethylene terephthalate support having a thickness of 175 μm (containing 1,4-bis-(2,6-diethylanilino)-anthraquinone) was subjected to the corona discharge treatment. Thereafter, each undercoating solution containing the following main components were applied by a wire bar to form a first layer of undercoat layers and a second layer of undercoat layers, successively. This was performed on both sides of the support.

<First Layer of Undercoat Layers (The Support Side)>

The amount of coating solution was set to 4.9 mL per 1 $m^2$ on one side of the support. The coating amount of each component per 1 $m^2$ on one side of the support is as follows.

Styrene-butadiene copolymer latex (as solid content) 0.31 g.

Sodium salt of 2,4-dichloro-6-hydroxy-s-triazine 8 mg.

Drying temperature: 190° C.

<Second Layer of Undercoat Layers>

The amount of coating solution was set to 7.9 mL per 1 $m^2$ on one side of the support. The coating amount of each component per 1 $m^2$ on one side of the support is as follows.

| | |
|---|---|
| Gelatin | 80 mg |
| $C_{12}H_{25}O(CH_2CH_2O)_{10}H$ | 1.8 mg |
| Antiseptic D | 0.27 mg |
| Matting agent (Polymethyl-metacrylate particle, mean particle size of 2.5 μm) | 2.5 mg |
| Drying temperature: | 185° C. |

2-2. Coating of Photosensitive Layer

On both sides of the undercoated support mentioned above, simultaneous coating by an extrusion method was subjected in order of the crossover cut layer, silver halide emulsion layer and surface protective layer from the support side and dried.

1) Crossover Cut Layer (Preparating Method of Dye for Crossover Cut)

Dye A (solid content 10 g) was added in a solvent mixture containing 150 mL of methanol and 50 mL of water and stirred for 2 hours while controlling the temperature at 70° C. to prepare a wet caked dye. 1 mol of methanol and 2 mol of water per 1 mol of dye were included in the obtained dye crystal.

As for the solvent component of the obtained dye crystal, a methanol was confirmed by $^1$H-NMR method, and a water of crystallization was confirmed by Karl Fischer method using the wet caked dye dried under the room temperature. And also, it was confirmed that the dye crystal released some methanol and water of crystallization on heating at 150° C. The concentration of the solid dye in the wet cake was 50% by weight.

(Preparation of Fine Crystal Dispersion of Dye for Crossover Cut)

3.0 g as solid dye of the obtained wet caked dye in a form of wet cake without drying was added to a dispersing water premixed with 1.2 g of 25% by weight solution of DEMOL SNB (manufactured by KAO Corporation) as a dispersing aid and mixed well. Thereafter water was added to adjust the total weight to be 30 g and mixed well to give a slurry. 120 g of zirconia beads were prepared and added to the vessel with the above-obtained slurry and dispersed with a sand mill (1/16 gallon Sand Grinder Mill, manufactured by AIMEX Co., Ltd.) at a rotation speed of 1500 rpm. While the dispersion process, the vessel was kept cool by circulating cold water.

Here the zirconia beads having a mean particle diameter of 1 mm were used and the time period for dispersion was 8 hours. After the dispersion, water was added to adjust the concentration of the dye solid to be 5% by weight and to prepare dye dispersion DP1.

(Preparation of Coating Solution for Crossover Cut Layer)

The coating amount of each component per 1 $m^2$ on one side of the support is as follows.

| | |
|---|---|
| Gelatin | 0.47 g |
| DP1 (dispersion of dye for cross-over cut, on the basis of solid dye content) | 8.4 mg |
| Sodium polystyrenesulfonate (average molecular weight: 600,000) | 10 mg |
| A-1 | 5 mg |
| Antiseptic D | 1 mg |

Therein the coating solution was prepared by adjusting the pH at 6.0 with a small amount of acetic acid or sodium hydroxide. The coating amount per 1 $m^2$ on one side of the support was 12.4 mL.

Dye A

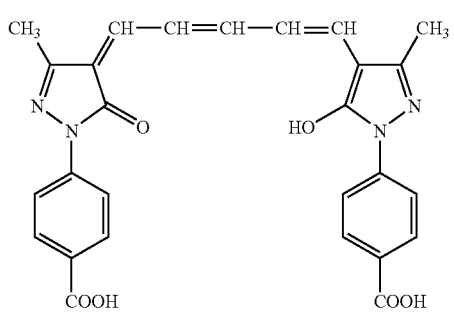

A-1

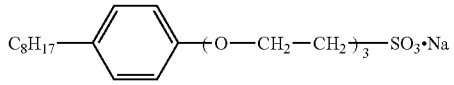

Antiseptic D

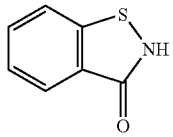

2) Silver Halide Emulsion Layer

Each component was added to each emulsion to make the following coating amount. The coating amount of each component per 1 $m^2$ on one side of the support is shown below.

| | |
|---|---|
| Coating amount of coated silver | 1.8 g |
| Gelatin | 1.7 g |
| Dextrane (average molecular weight: 39,000) | 428 mg |
| Sodium polystyrenesulfonate (average molecular weight: 600,000) | 40 mg |
| A-2 | 204 mg |
| A-3 | 2.2 mg |
| A-4 | 0.5 mg |
| A-5 | 2.8 mg |
| 1,2-Bis(vinyl sulfonylacetamide)ethane | 50 mg |

Therein the amount of coating solution for the silver halide emulsion layer was 45.2 mL per 1 $m^2$ on one side of the support.

A-2

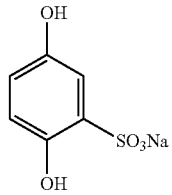

A-3

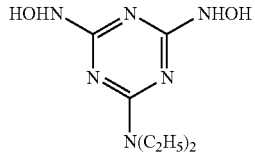

A-4

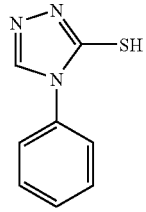

A-5

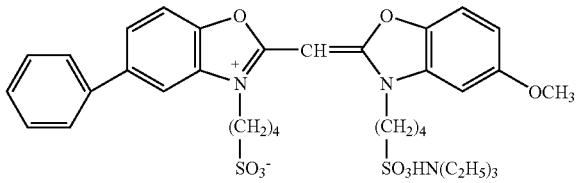

3) Preparation of Coating Solution for Surface Protective Layer

Each component was added to the coating solution to make the following coating amount.

The coating amount of each component per 1 $m^2$ on one side of the support:

| | |
|---|---|
| Gelatin | 0.767 g |
| Sodium polyacrylate (average molecular weight: 400, 000) | 80 mg |
| Sodium polystyrenesulfonate (average molecular weight: 600,000) | 1.1 mg |
| Matting agent-1 (mean particle size: 3.7 μm, on the basis of solid content) | 70 mg |
| A-6 | 18.1 mg |
| A-7 | 34.5 mg |
| A-8 | 6.8 mg |
| A-9 | 3.2 mg |
| A-10 | 1.4 mg |
| A-11 | 2.1 mg |
| A-12 | 1.0 mg |
| Antiseptic D | 0.9 mg |
| p-Benzoquinone | 0.7 mg |

Therein the coating solution for the surface protective layer was prepared adjusting the pH at 6.8 with a small amount of sodium hydroxide. The coating amount per 1 $m^2$ on one side of the support was 10.7 mL. The compounds used for the above solution are shown below.

Matting agent-1

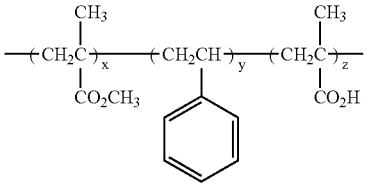

[X/Y/Z = 76.3/17.5/6.2]

A-6

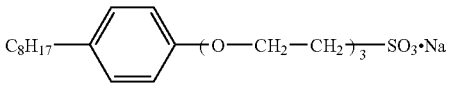

A-7

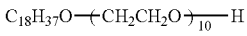

A-8

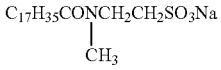

A-9

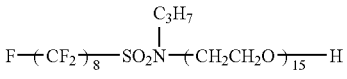

A-10

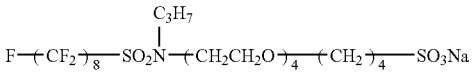

A-11

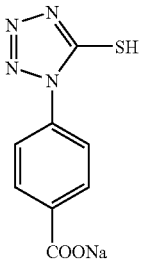

A-12

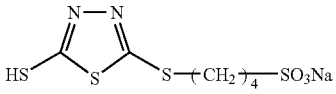

3. Evaluation of Photographic Properties

1) Exposure and Development

The double-sided coated photosensitive materials prepared above were evaluated as follows.

Two sets of X-ray regular screen HI-SCREEN B3 ($CaWO_4$ was used as fluorescent substance, the emission peak wavelength of 425 nm) produced by Fuji Photo Film Co., Ltd. were used, and the assembly for image formation was provided by inserting the sample between them. This assembly was subjected to X-ray exposure for 0.05 seconds, and then X-ray sensitometry was performed. The X-ray apparatus used was DRX-3724HD (trade name) produced by Toshiba Corp., and a tungsten target tube was used. X-ray emitted by a pulse generator operated at three phase voltage of 80 kVp and penetrated through a filter containing 7 cm thickness of water having the absorption ability almost the same as human body was used as the light source. By the method of distance, varying the exposure value of X-ray, the sample was subjected to exposure with a step wedge tablet having a width of 0.15 in terms of log E. After exposure, the exposed sample was subjected to development with the wet development condition mentioned below.

The exposed samples were processed for 5 minutes in the developer solution CE-D1 (trade name) with automatic developing processor CEPROS-M2 (trade name), both manufactured by Fuji Photo Film Co., Ltd.

2) Evaluation Terms (Evaluations of Sensitivity and Fog)

The density of the obtained image was measured by a densitometer and thereafter plotted against a logarithm of the exposure amount to draw a photographic characteristic curve. Fog was expressed in terms of a minimum density (Dmin) of the density on unexposed portion. Sensitivity was evaluated as a reciprocal of the exposure amount necessary for giving a density of 1.5, and expressed in terms of a relative value based on the sensitivity obtained for Sample No. 1, which was taken as 100. The lower the value of fog is, the more preferable, and the higher the value of sensitivity is, the more excellent in photographic property.

Relative Dmax: A maximum density saturated with increasing exposure amount is defined as Dmax and expressed in terms of a relative value based on the maximum density obtained for Sample No. 1.

3) Result of Evaluation

The results are shown in Table 2.

It is apparent from the data shown in Table 2 that in the photothermographic materials using the tabular grains of the present invention, the sensitivity increase by 2 to 3 times, but unexpectedly the fog decreases. And also they are excellent in exhibiting high Dmax.

Especially, Sample Nos. 5 to 7, which comprise tabular silver halide grains having a variation coefficient of an equivalent spherical diameter distribution of 20% or less and also a variation coefficient of an equivalent circular diameter distribution of 20% or less, exhibit high sensitivity by 2.5 times or more.

TABLE 2

| Sample No. | Emulsion No. | Sensitivity | Fog | Relative Dmax |
|---|---|---|---|---|
| 1 | 11 | 100 | 0.18 | 100 |
| 2 | 12 | 182 | 0.17 | 111 |
| 3 | 13 | 224 | 0.17 | 122 |
| 4 | 14 | 240 | 0.17 | 123 |
| 5 | 15 | 275 | 0.16 | 128 |
| 6 | 16 | 269 | 0.17 | 125 |
| 7 | 17 | 288 | 0.16 | 131 |

Example 3

1. Preparation of PET Support and Undercoating 1.1 Film Manufacturing

PET having IV (intrinsic viscosity) of 0.66 (measured in phenol/tetrachloroethane=6/4 (weight ratio) at 25° C.) was obtained according to a conventional manner using terephthalic acid and ethylene glycol. The product was pelletized, dried at 130° C. for 4 hours, and colored blue with the blue dye (1,4-bis(2,6-diethylanilinoanthraquinone). Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

1-2. Surface Corona Discharge Treatment

Both surfaces of the support were treated at room temperature at 20 m/minute using Solid State Corona Discharge Treatment Machine Model 6KVA manufactured by Piller GmbH. It was proven that treatment of 0.375 kV·A·minute·m$^{-2}$ was executed, judging from the readings of current and voltage on that occasion. The frequency upon this treatment was 9.6 kHz, and the gap clearance between the electrode and dielectric roll was 1.6 mm.

1-3. Preparation of Undercoated Support (1) Preparation of Coating Solution for Undercoat Layer

| | |
|---|---|
| Pesresin A-520 manufactured by Takamatsu Oil & Fat Co., Ltd. (30% by weight solution) | 46.8 g |
| BAIRONAARU MD-1200 manufactured by Toyo Boseki Co., Ltd. | 10.4 g |
| Polyethylene glycol monononylphenylether (average ethylene oxide number = 8.5) 1% by weight solution | 11.0 g |
| MP-1000 manufactured by Soken Chemical & Engineering Co., Ltd. (PMMA polymer fine particle, mean particle diameter of 0.4 μm) | 0.91 g |
| distilled water | 931 mL |

(2) Undercoating

Both surfaces of the biaxially tentered polyethylene terephthalate support having the thickness of 175 μm were subjected to the corona discharge treatment as described above. Thereafter, the aforementioned coating solution for undercoating was coated with a wire bar so that the amount of wet coating became 6.6 mL/m$^2$ (per one side), and dried at 180° C. for 5 minutes. This was performed on both sides, and thus an undercoated support was produced.

2. Preparation of Coating Materials

1) Preparations of Mixed Emulsion 1 to 7 for Coating Solution

Each of the silver halide emulsion-11 to -17 prepared in Example 2 were dissolved, and thereto was added benzothiazolium iodide in a 1% by weight aqueous solution at $7\times10^{-3}$ mol per 1 mol of silver. Further, as "a compound that can be one-electron-oxidized to provide a one-electron oxidation product, which releases one or more electrons", the compound Nos. 1, 2, and 3 were added respectively in an amount of $2\times10^{-3}$ mol per 1 mol of silver in silver halide.

Thereafter, as "a compound having an adsorptive group and a reducible group", the compound Nos. 1, 2, and 3 were added respectively in an amount of $8\times10^{-3}$ mol per 1 mol of silver halide.

Further, water was added thereto to give the content of silver halide of 15.6 g in terms of silver, per 1 liter of the mixed emulsion for coating solution.

2) Preparation of Silver Salt of Fatty Acid

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. The resulting crystal was subjected to centrifugal filtration, and washing was performed with 100 kg of isopropyl alcohol. Thereafter, the crystal was dried. The resulting crystal was esterified, and subjected to GC-FID analysis to give the results of the content of behenic acid being 96 mol %, lignoceric acid. 2 mol %, and arachidic acid 2 mol %. In addition, erucic acid was included at 0.001 mol % or less.

<Preparation of Dispersion of Silver Salt of Fatty>Acid>

88 kg of recrystallized behenic acid, 422 L of distilled water, 49.2 L of 5 mol/L sodium hydroxide, 120 L of t-butyl alcohol were admixed, and subjected to a reaction with stirring at 75° C. for one hour to give a solution of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of sodium behenate and the total amount of the aqueous silver nitrate solution with sufficient stirring at a constant flow rate over 93 minutes and 15 seconds, and 90 minutes, respectively.

Upon this operation, during first 11 minutes following the initiation of adding the aqueous silver nitrate solution, the added material was restricted to the aqueous silver nitrate solution alone. The addition of the solution of sodium behenate was thereafter started, and during 14 minutes and 15 seconds following the completion of adding the aqueous silver nitrate solution, the added material was restricted to the solution of sodium behenate alone. The temperature inside of the reaction vessel was then set to be 30° C., and the temperature outside was controlled so that the liquid temperature could be kept constant.

In addition, the temperature of a pipeline for the addition system of the solution of sodium behenate was kept constant by circulation of warm water outside of a double wall pipe, so that the temperature of the liquid at an outlet in the leading edge of the nozzle for addition was adjusted to be 75° C.

Further, the temperature of a pipeline for the addition system of the aqueous silver nitrate solution was kept constant by circulation of cool water outside of a double wall pipe. Position at which the solution of sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b and c are as defined aforementioned.).

To the wet cake corresponding to 260 kg of a dry solid matter content, were added 19.3 kg of polyvinyl alcohol (trade name: PVA-217) and water to give the total amount of 1000 kg. Then, a slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of the silver behenate. For the cooling manipulation, coiled heat exchangers were equipped in front of and behind the interaction chamber respectively, and accordingly, the temperature for the dispersion was set to be 18° C. by regulating the temperature of the cooling medium.

3) Preparations of Reducing Agent Dispersion

<<Preparation of Reducing Agent-1 Dispersion>>

To 10 kg of reducing agent-1 (2,2'-methylenebis-(4-ethyl-6-tert-butylphenol)) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 3 hours. Thereafter, 0.2 g of a benzoisothiazolinone sodium salt and water were added thereto, thereby adjusting the concentration of the reducing agent to be 25% by weight. This dispersion was subjected to heat treatment at 60° C. for 5 hours to obtain reducing agent-1 dispersion. Particles of the reducing agent included in the resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

<<Preparation of Reducing Agent-2 Dispersion>>

To 10 kg of reducing agent-2 (6,6'-di-t-butyl-4,4'-dimethyl-2,2'-butylidenediphenol)) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent heat treatment at 80° C. for one hour to obtain reducing agent-2 dispersion.

Particles of the reducing agent included in the resulting reducing agent-2 dispersion had a median diameter of 0.50 μm, and a maximum particle diameter of 1.6 μm or less. The resultant reducing agent-2 dispersion was subjected to filtration with a polypropylene filter having a pore size of 3.0 μm to remove foreign substances such as dust, and stored.

4) Preparation of Hydrogen Bonding Compound Dispersion

<<Preparation of Hydrogen Bonding Compound-1 Dispersion>>

To 10 kg of hydrogen bonding compound-1 (tri(4-t-butylphenyl)phosphineoxide) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 4 hours. Thereafter, 0.2 g of a benzoisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion.

Particles of the hydrogen bonding compound included in the resulting hydrogen bonding compound dispersion had a median diameter of 0.45 μm, and a maximum particle diameter of 1.3 μm or less. The resultant hydrogen bonding compound dispersion was subjected to filtration with a polypropylene filter having a pore size of 3.0 μm to remove foreign substances such as dust, and stored.

5) Preparations of Dispersions of Development Accelerator and Color-tone-adjusting Agent <Preparation of Development Accelerator-1 Dispersion>

To 10 kg of development accelerator-1 and 20 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 3 hours and 30 minuets. Thereafter, 0.2 g of a benzoisothiazolinone sodium salt and water were added thereto, thereby adjusting the concentration of the development accelerator to be 20% by weight. Accordingly, development accelerator-1 dispersion was obtained. Particles of the development accelerator included in the resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

Also concerning solid dispersions of development accelerator-2 and color-tone-adjusting agent-1, dispersion was executed in a similar manner to the development accelerator-1, and thus dispersions of 20% by weight and 15% by weight were respectively obtained.

6) Preparations of Organic Polyhalogen Compound Dispersion

<<Preparation of Organic Polyhalogen Compound-1 Dispersion>>

10 kg of organic polyhalogen compound-1 (tribromomethane sulfonylbenzene), 10 kg of a 20% by weight aqueous solution of modified polyvinyl alcohol (manufactured by Kuraray Co., Ltd., Poval MP203), 0.4 kg of a 20% by weight aqueous solution of sodium triisopropylnaphthalenesulfonate and 14 kg of water were thoroughly admixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. Accordingly, organic polyhalogen compound-1 dispersion was obtained.

Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<<Preparation of Organic Polyhalogen Compound-2 Dispersion>>

10 kg of organic polyhalogen compound-2 (N-butyl-3-tribromomethane sulfonylbenzoamide), 20 kg of a 10% by weight aqueous solution of modified polyvinyl alcohol (manufactured by Kuraray Co., Ltd., Poval MP203) and 0.4 kg of a 20% by weight aqueous solution of sodium triisopropylnaphthalenesulfonate were thoroughly admixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. This fluid dispersion was heated at 40° C. for 5 hours to obtain organic polyhalogen compound-2 dispersion.

Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

7) Preparation of Silver Iodide Complex-forming Agent 8 kg of modified polyvinyl alcohol MP203 was dissolved in 174.57 kg of water, and thereto were added 3.15 kg of a 20% by weight aqueous solution of sodium triisopropylnaphthalenesulfonate and 14.28 kg of a 70% by weight aqueous solution of 6-isopropylphthalazine. Accordingly, a 5% by weight solution of silver iodide complex-forming agent compound was prepared.

8) Preparations of Aqueous Solution of Mercapto Compound

<<Preparation of Aqueous Solution of Mercapto Compound-1>>

Mercapto compound-1 (1-(3-sulfophenyl)-5-mercaptotetrazole sodium salt) in an amount of 7 g was dissolved in 993 g of water to give a 0.7% by weight aqueous solution.

<<Preparation of Aqueous Solution of Mercapto Compound-2>>

Mercapto compound-2 (1-(3-methylureidophenyl)-5-mercaptotetrazole) in an amount of 20 g was dissolved in 980 g of water to give a 2.0% by weight aqueous solution.

9) Preparation of SBR Latex Solution

To a polymerization tank of a gas monomer reaction apparatus (manufactured by Taiatsu Techno Corporation, TAS-2J type), were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature was elevated to 60° C. Thereto was added a solution of 1.875 g of ammonium persulfate dissolved in 50 mL of water, and the mixture was stirred for 5 hours as it stood.

The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ration of $Na^+$ ion:$NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., solid matter concentration of 44% by weight, the equilibrium moisture content at 25° C. and 60% RH of 0.6% by weight, ionic conductance of 4.80 mS/cm (measurement of the ionic conductance performed using a conductivity meter CM-30S manufactured by Toa Electronics Ltd. for the latex stock solution (44% by weight) at 25° C.) and pH of 8.4.

3. Preparations of Coating Solutions

1) Preparations of Coating Solution for Image Forming Layer-1 to -7

To the dispersion of the silver salt of fatty acid obtained as described above in an amount of 1000 g and 276 mL of water were serially added the organic polyhalogen compound-1 dispersion, the organic polyhalogen compound-2 dispersion, the SBR latex (Tg: 17° C.) solution, the reducing agent-1 dispersion, the reducing agent-2 dispersion, the hydrogen bonding compound-1 dispersion, the development accelerator-1 dispersion, the development accelerator-2 dispersion, the color-tone-adjusting agent-1 dispersion, the mercapto compound-1 aqueous solution, and the mercapto compound-2 aqueous solution. After adding thereto the silver iodide complex-forming agent, the mixed emulsion 1 to 7 for coating solution was added thereto in an amount of 0.22 mol per 1 mol of silver salt of fatty acid, followed by thorough mixing just prior to the coating, which was fed directly to a coating die, and was coated.

2) Preparation of Coating Solution for Intermediate Layer

To 1000 g of polyvinyl alcohol PVA-205 (manufactured by Kuraray Co., Ltd.), and 4200 mL of a 19% by weight solution of methyl methacrylate/styrene/butyl acrylate/hydroxyethyl methacrylate/acrylic acid copolymer (weight ratio of the copolymerization of 64/9/20/5/2) latex, were added 27 mL of a 5% by weight aqueous solution of aerosol OT (manufactured by American Cyanamid Co.), 135 mL of a 20% by weight aqueous solution of ammonium secondary phthalate and water to give total amount of 10000 g. The mixture was adjusted with sodium hydroxide to give the pH of 7.5. Accordingly, the coating solution for the intermediate layer was prepared, and was fed to a coating die to provide 9.1 mL/$m^2$.

Viscosity of the coating solution was 58 [mPa·s] which is measured with a B type viscometer at 40° C. (No. 1 rotor, 60 rpm).

3) Preparation of Coating Solution for First Layer of Surface Protective Layers

In water was dissolved 64 g of inert gelatin, and thereto were added 112 g of a 19.0% by weight solution of methyl methacrylate/styrene/butyl acrylate/hydroxyethyl methacrylate/acrylic acid copolymer (weight ratio of the copolymerization of 64/9/20/5/2) latex, 30 mL of a 15% by weight methanol solution of phthalic acid, 23 mL of a 10% by weight aqueous solution of 4-metyl phthalic acid, 28 mL of 0.5 mol/L sulfuric acid, 5 mL of a 5% by weight aqueous solution of aerosol OT (manufactured by American Cyanamid Co.), 0.5 g of phenoxyethyl alcohol, and 0.1 g of benzoisothiazolinone. Water was added to give total amount of 750 g. Immediately before coating, 26 mL of a 4% by weight chrome alum which had been mixed with a static mixer was added to give a coating solution for the first layer of the surface protective layers, which was fed to a coating die so that 18.6 mL/$m^2$ could be provided.

Viscosity of the coating solution was 20 [mPa·s] which was measured with a B type viscometer at 40° C. (No. 1 rotor, 60 rpm).

4) Preparation of Coating Solution for Second Layer of Surface Protective Layers In water was dissolved 80 g of inert gelatin and thereto were added 102 g of a 27.5% by weight solution of methyl methacrylate/styrene/butyl acrylate/hydroxyethyl methacrylate/acrylic acid copolymer (weight ratio of the copolymerization of 64/9/20/5/2) latex, 5.4 mL of a 2% by weight solution of a fluorocarbon surfactant (F-1), 5.4 mL of a 2% by weight aqueous solution of another fluorocarbon surfactant (F-2), 23 mL of a 5% by weight aqueous solution of aerosol OT (manufactured by American Cyanamid Co.), 4 g of polymethyl methacrylate fine particles (mean particle diameter of 0.7 μm, distribution of volume weighted average being 30%) and 21 g of polymethyl methacrylate fine particles (mean particle diameter of 3.6 μm, distribution of volume weighted average being 60%), 1.6 g of 4-methyl phthalic acid, 4.8 g of phthalic acid, 44 mL of 0.5 mol/L sulfuric acid, and 10 mg of benzoisothiazolinone. Water was added to give total amount of 650 g. Immediately before coating, 445 mL of a aqueous solution containing 4% by weight chrome alum and 0.67% by weight phthalic acid, which was admixed with a static mixer, was added to give a coating solution for the second layer of the surface protective layers, which was fed to a coating die so that 8.3 mL/$m^2$ could be provided.

Viscosity of the coating solution was 19 [mPa·s] which is measured with a B type viscometer at 40° C. (No. 1 rotor, 60 rpm).

4. Preparations of Photothermographic Material-11 to -17

Simultaneous overlaying coating by a slide bead coating method is subjected in order of the image forming layer, intermediate layer, first layer of the surface protective layers and second layer of the surface protective layers, starting from the undercoated face, and thus samples of the photothermographic material were produced. In this method, the temperature of the coating solution was adjusted to 31° C. for the image forming layer and intermediate layer, to 36° C. for the first layer of the surface protective layers, and to 37° C. for the second layer of the surface protective layers. The coating amount of silver in the image forming layer was 0.821 g/$m^2$ per one side with respect to total amount of silver contained in silver salt of fatty acid and silver halide. This coating was performed on both sides of the support.

The coating amount of each compound (g/$m^2$) for the image forming layer per one side is as follows.

| | |
|---|---|
| Silver salt of fatty acid | 2.80 |
| Organic polyhalogen compound-1 | 0.028 |
| Organic polyhalogen compound-2 | 0.094 |
| Silver iodide complex-forming agent | 0.46 |
| SBR latex | 5.20 |
| Reducing agent-1 | 0.33 |
| Reducing agent-1 | 0.13 |
| Hydrogen bonding compound-1 | 0.15 |
| Development accelerator-1 | 0.005 |

-continued

| | |
|---|---|
| Development accelerator-2 | 0.035 |
| Color-tone-adjusting agent-1 | 0.002 |
| Mercapto compound-1 | 0.001 |
| Mercapto compound-2 | 0.003 |
| Silver halide (on the basis of Ag content) | 0.146 |

Conditions for coating and drying are as follows.

The support was decharged by ionic wind. Coating was performed at the speed of 160 m/min. Conditions for coating and drying were adjusted within the range described below, and conditions were set to obtain the most stable surface state.

The clearance between the leading end of the coating die and the support was 0.10 mm to 0.30 mm.

The pressure in the vacuum chamber was set to be lower than atmospheric pressure by 196 Pa to 882 Pa.

In the subsequent cooling zone, the coating solution was cooled by wind having the dry-bulb temperature of 10° C. to 20° C.

Transportation with no contact was carried out, and the coated support was dried with an air of the dry-bulb of 23° C. to 45° C. and the wet-bulb of 15° C. to 21° C. in a helical type contactless drying apparatus.

After drying, moisture conditioning was performed at 25° C. in the humidity of 40% RH to 60% RH.

Then, the film surface was heated to be 70° C. to 90° C., and after heating, the film surface was cooled to 25° C.

Thus prepared photothermographic material had the matt degree of 250 seconds as Beck's smoothness. In addition, measurement of the pH of the film surface gave the result of 6.0.

Chemical structures of the compounds used in Examples of the invention are shown below.

Compound 1 that can be one-electron-oxidized to provide a one-electron oxidation product which releases one or more electrons

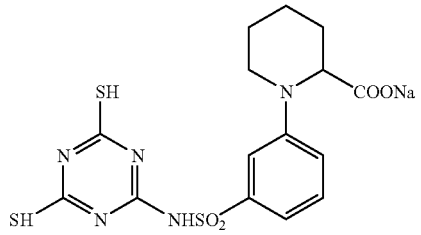

Compound 2 that can be one-electron-oxidized to provide a one-electron oxidation product which releases one or more electrons

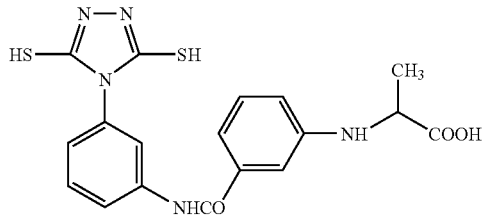

Compound 3 that can be one-electron-oxidized to provide a one-electron oxidation product which releases one or more electrons

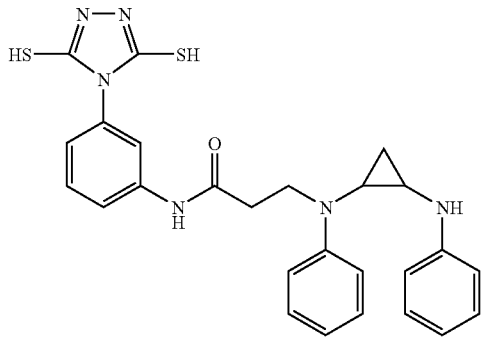

Compound 1 having adsorptive group and reducible group

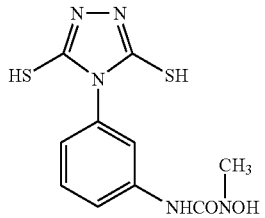

Compound 2 having adsorptive group and reducible group

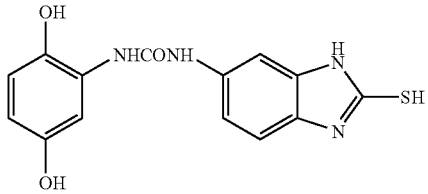

Compound 3 having adsorptive group and reducible group

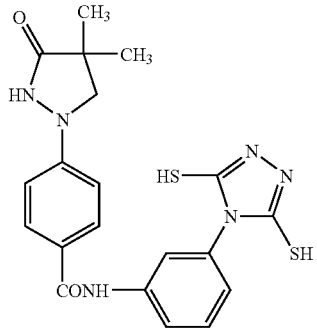

-continued

Tellurium sensitizer C

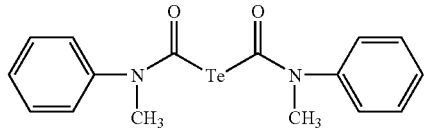

Reducing agent-1

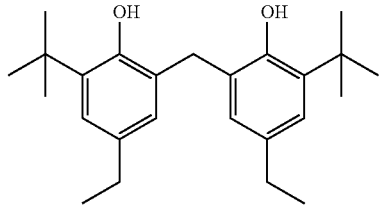

Reducing agent-2

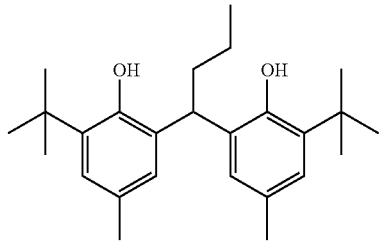

Hydrogen bonding compound-1

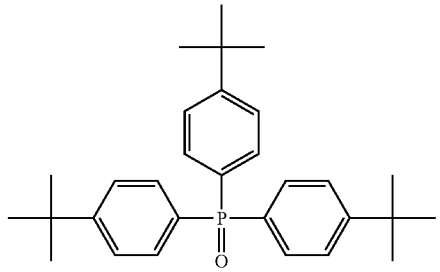

Organic polyhalogen compound-1

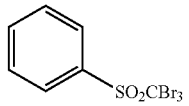

Organic polyhalogen compound-2

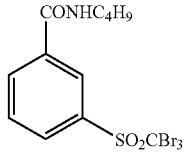

Mercapto compound-1

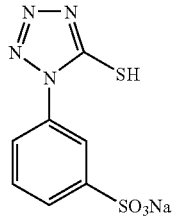

-continued

Mercapto compound-2

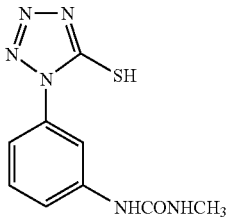

Silver iodide complex forming agent

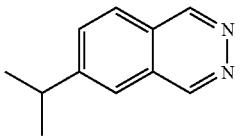

Development accelerator-1

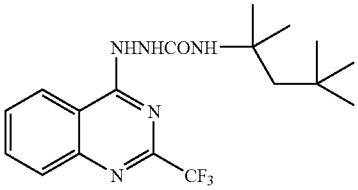

Development accelerator-2

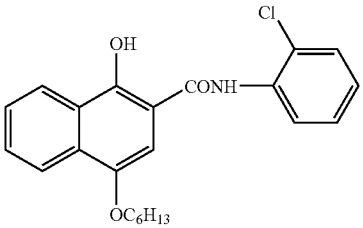

Color-tone-adjusting agent-1

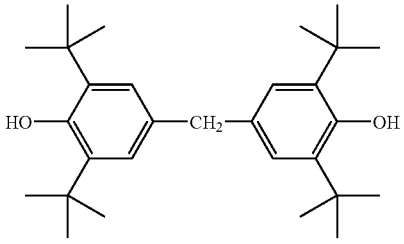

(F-1)

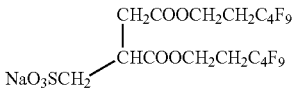

(F-2)

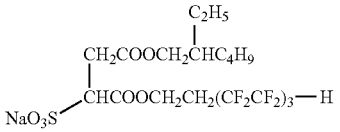

5. Evaluation

1) Exposure and Development

The resulting sample was cut into a half-cut size, and was wrapped with the following packaging material under an environment of 25° C. and 50% RH, and stored for 2 weeks at an ambient temperature.

(Packaging Material)

A film laminated with PET 10 μm/PE 12 μm/aluminum foil 9 μm/Ny 15 μm/polyethylene 50 μm containing carbon at 3% by weight:

oxygen permeability at 25° C.: 0.02 $mL \cdot atm^{-1}m^{-2}day^{-1}$, vapor permeability at 25° C.: 0.10 $g \cdot atm^{-1}m^{-2}day^{-1}$.

Thus prepared double-sided coated photothermographic material was evaluated as follows.

Two sets of X-ray regular screen HI-SCREEN B3 ($CaWO_4$ is used as fluorescent substance, the emission peak wavelength of 425 nm) produced by Fuji Photo Film Co., Ltd. were used, and the assembly for image formation was provided by inserting the sample between them. This assembly was subjected to X-ray exposure for 0.05 seconds, and then X-ray sensitometry was performed. The X-ray apparatus used was DRX-3724HD (trade name) produced by Toshiba Corp., and a tungsten target tube was used. X-ray emitted by a pulse generator operated at three phase voltage of 80 kVp and penetrated through a filter containing 7 cm thickness of water having the absorption ability almost the same as human body was used as the light source. By the method of distance, varying the exposure value of X-ray, the sample was subjected to exposure with a step wedge tablet having a width of 0.15 in terms of log E. After exposure, the exposed sample was subjected to thermal development with the condition mentioned below, and then the obtained image was evaluated by a densitometer.

The thermal developing portion of Fuji Medical Dry Laser Imager FM-DP L was modified so that it could heat from both sides, and by another modification the transportation rollers in the thermal developing portion were changed to the heating drum so that the sheet of film could be conveyed. The temperature of four panel heaters were set to 112° C.-118° C.-120° C.-120° C., and the temperature of the heating drum was set to 120° C. The total time period for thermal development was set to be 14 seconds by increasing the speed of transportation.

2) Evaluation Terms (Evaluations of Sensitivity and Fog)

Densities on an image obtained were measured to draw a photographic characteristic curve which is a D-log E curve representing a relationship between the common logarithm (log E) of an exposure value and the optical density (D). Fog (Dmin) is expressed in terms of the density of the unexposed part. Sensitivity is defined to be the inverse of the exposure value giving image density of 1.5. The sensitivities are shown in relative value, detecting the sensitivity of Sample No. 11 to be 100. The smaller the value of fog is, the more excellent it is in photographic property.

Relative Dmax: Dmax is a maximum density obtained with increasing the exposure value. Dmax is shown in relative value to the value of Sample No. 11.

(Evaluation of Image Storability (Print-out Resistance))

The obtained image was left under a fluorescent lamp with an intensity of 1000 lux for 24 hours, and the increment of the fog at Dmin part (Δ Dmin) was evaluated. The smaller the value is, the more excellent it is in image storability (print-out resistance).

3) Result of Evaluation

The results are shown in Table 3.

It is apparent from the data shown in Table 3 that in the photothermographic materials using the tabular grains of the present invention, the sensitivity increase by 2 to 3 times similar to Example 2, but unexpectedly, low fog and high Dmax are obtained. Further, they are excellent in image storability at the storage after thermal development.

Especially, Sample Nos. 15 to 17, which include the tabular silver halide grains having variation coefficients of 20% or less in both of an equivalent spheical diameter distribution and an equivalent circular diameter distribution, exhibit high sensitivity by 2.5 times or more.

On the other hand, RX-U regular film for wet developing system produced by Fuji Photo Film Co., Ltd. was subjected to exposure as the same condition as above, and processed with the automatic photographic processor CEPROS-M2 produced by Fuji Photo Film Co., Ltd. and Developer CE-D1.

As a result of comparing photographic properties of both images, which were obtained from the photothermographic material of the invention and from the wet developing system, similar excellent properties are attained.

TABLE 3

| Sample No. | Emulsion No. | Sensitivity | Fog | Relative Dmax | Image Storability (ΔDmin) |
|---|---|---|---|---|---|
| 11 | 11 | 100 | 0.20 | 100 | 0.03 |
| 12 | 12 | 179 | 0.20 | 105 | 0.03 |
| 13 | 13 | 219 | 0.20 | 111 | 0.02 |
| 14 | 14 | 234 | 0.19 | 113 | 0.02 |
| 15 | 15 | 269 | 0.19 | 114 | 0.02 |
| 16 | 16 | 251 | 0.20 | 112 | 0.02 |
| 17 | 17 | 282 | 0.19 | 116 | 0.02 |

Example 4

1. Preparations of Photosensitive Silver Halide Emulsion (Preparation of Silver Halide Emulsion-101)

To 1421 mL of distilled water was added 8 mL of a 10% by weight potassium iodide solution, and then 12 mL of 1 mol/L sodium hydroxide, 36.5 g of phthalated gelatin, and 25 mL of a 5% by weight methanol solution of 2,2'-(ethylene dithio)diethanol were further added. The solution was kept at 75° C. while stirring in a stainless steel reaction vessel, and thereto were added total amount of: solution A prepared through diluting 22.22 g of silver nitrate by adding distilled water to give the volume of 218 mL; and solution B prepared through diluting 36.6 g of potassium iodide with distilled water to give the volume of 366 mL. A method of controlled double jet was executed through adding total amount of the solution A at a constant flow rate over 32 minutes, accompanied by adding the solution B while maintaining the pAg at 10.2. Thereafter, 10 mL of a 3.5% by weight aqueous solution of hydrogen peroxide was added thereto, and 10.8 mL of a 10% by weight aqueous solution of benzimidazole was further added.

Moreover, a solution C prepared through diluting 51.86 g of silver nitrate by adding distilled water to give the volume of 508.2 mL and a solution D prepared through diluting 63.9 g of potassium iodide with distilled water to give the volume of 639 mL were added. A method of controlled double jet was executed through adding total amount of the solution C at a constant flow rate over 160 minutes, accompanied by adding the solution D while maintaining the pAg at 10.2. Hexachloroiridium (III) potassium salt was added in its entirety to give $1\times10^{-4}$ mol per 1 mol of silver, at 20 minutes post initiation of the addition of the solution C and the solution D. Moreover, at 5 seconds after completing the addition of the solution C, a potassium iron (II) hexacyanide aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce the silver halide emulsion-101 having the pAg of 11.0.

The silver halide grains in the silver halide emulsion-101 were pure silver iodide grains, and tabular grains having a mean projected area equivalent diameter of 0.72 μm, a variation coefficient of a projected area equivalent diameter distribution of 17.7%, a mean thickness of 0.060 μm and a mean aspect ratio of 12.0. Tabular grains having an aspect ratio of 2 or more occupied 80% or more of the total projected area. The equivalent spherical diameter of the grains was 0.36 μm. 30% or more of the silver iodide existed in γ phase from the result of powder X-ray diffraction analysis.

(Preparations of Silver Halide Emulsion-102 and -103)

Preparations of silver halide emulsion-102 and -103 were conducted in a similar manner to the process in the preparation of silver halide emulsion-101, except that changing the addition amount of the 5% by weight methanol solution of 2,2'-(ethylene dithio)diethanol to 100 mL and 400 mL, respectively.

(Preparations of Silver Halide Emulsion-104 to -106)

To 1421 mL of distilled water was added 8 mL of a 10% by weight potassium iodide solution, and then 12 mL of 1 mol/L sodium hydroxide, 36.5 g of phthalated gelatin, and 25 mL of a 3.57% by weight methanol solution of 1,3-dimethyl-imidazolidin-2-thione were further added. The solution was kept at 45° C. while stirring in a stainless steel reaction vessel, and thereto were added total amount of: solution A prepared through diluting 22.22 g of silver nitrate by adding distilled water to give the volume of 218 mL; and solution B prepared through diluting 36.6 g of potassium iodide with distilled water to give the volume of 366 mL. A method of controlled double jet was executed through adding total amount of the solution A at a constant flow rate over 32 minutes, accompanied by adding the solution B while maintaining the pAg at 10.2. Thereafter, 10 mL of a 3.5% by weight aqueous solution of hydrogen peroxide was added thereto, and 10.8 mL of a 10% by weight aqueous solution of benzimidazole was further added.

Moreover, a solution C prepared through diluting 51.86 g of silver nitrate by adding distilled water to give the volume of 508.2 mL and a solution D prepared through diluting 63.9 g of potassium iodide with distilled water to give the volume of 639 mL were added. A method of controlled double jet was executed through adding total amount of the solution C at a constant flow rate over 160 minutes, accompanied by adding the solution D while maintaining the pAg at 10.2. Hexachloroiridium (III) potassium salt was added in its entirety to give $1\times10^{-4}$ mol per 1 mol of silver, at 20 minutes post initiation of the addition of the solution C and the solution D. Moreover, at 5 seconds after completing the addition of the solution C, a potassium iron (II) hexacyanide aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce the silver halide emulsion-104 having the pAg of 11.0.

Preparations of silver halide emulsion-105 and -106 were conducted in a similar manner to the process in the preparation of silver halide emulsion-104, except that changing the addition amount of the 3.75% by weight methanol solution of 1,3-dimethyl-imidazolidin-2-thione to 100 mL and 400 mL, respectively.

(Preparations of Silver Halide Emulsion-107 to -109)

To 1421 mL of distilled water was added 8 mL of a 10% by weight potassium iodide solution, and then 12 mL of 1 mol/L sodium hydroxide, 36.5 g of phthalated gelatin, and 25 mL of a 5% by weight methanol solution of 2,2'-(ethylene dithio)diethanol were further added. The solution was kept at 75° C. while stirring in a stainless steel reaction vessel, and thereto were added total amount of: solution A prepared through diluting 22.22 g of silver nitrate by adding distilled water to give the volume of 218 mL; and solution B prepared through diluting 36.6 g of potassium iodide with distilled water to give the volume of 366 mL and adding 50 mL of a 5% by weight methanol solution of 2,2'-(ethylene dithio) diethanol. A method of controlled double jet was executed through adding total amount of the solution A at a constant flow rate over 32 minutes, accompanied by adding the solution B while maintaining the pAg at 10.2. Thereafter, 10 mL of a 3.5% by weight aqueous solution of hydrogen peroxide was added thereto, and 10.8 mL of a 10% by weight aqueous solution of benzimidazole was further added.

Moreover, a solution C prepared through diluting 51.86 g of silver nitrate by adding distilled water to give the volume of 508.2 mL and a solution D prepared through diluting 63.9 g of potassium iodide with distilled water to give the volume of 639 mL and adding 88 mL of a 5% by weight methanol solution of 2,2'-(ethylene dithio)diethanol were added. A method of controlled double jet was executed through adding total amount of the solution C at a constant flow rate over 160 minutes, accompanied by adding the solution D while maintaining the pAg at 10.2. Hexachloroiridium (III) potassium salt was added in its entirety to give $1\times10^{-4}$ mol per 1 mol of silver, at 20 minutes post initiation of the addition of the solution C and the solution D. Moreover, at 5 seconds after completing the addition of the solution C, a potassium iron (II) hexacyanide aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to pH of 5.9 with 1 mol/L sodium hydroxide to produce the silver halide emulsion-107 having the pAg of 11.0.

Preparation of silver halide emulsion-108 was conducted in a similar manner to the process in the preparation of silver halide emulsion-107, except that changing the amounts of the 5% by weight methanol solution of 2,2'-(ethylene dithio) diethanol added to the solutions B and D to 100 mL and 176 mL, respectively.

Preparation of silver halide emulsion-109 was conducted in a similar manner to the process in the preparation of silver halide emulsion-107, except that changing the amounts of the 5% by weight methanol solution of 2,2'-(ethylene dithio) diethanol added to the solutions B and D to 200 mL and 352 mL, respectively.

(Preparations of Silver Halide Emulsion-110 to -112)

To 1421 mL of distilled water was added 8 mL of a 10% by weight potassium iodide solution, and then 12 mL of 1 mol/L sodium hydroxide, 36.5 g of phthalated gelatin, and 25 mL of a 3.57% by weight methanol solution of 1,3-dimethyl-imidazolidin-2-thione were further added. The solution was kept at 45° C. while stirring in a stainless steel reaction vessel, and thereto were added total amount of: solution A prepared through diluting 22.22 g of silver nitrate by adding distilled water to give the volume of 218 mL; and solution B prepared through diluting 36.6 g of potassium iodide with distilled water to give the volume of 366 mL and adding 50 mL of a 3.57% by weight methanol solution of 1,3-dimethyl-imidazolidin-2-thione. A method of controlled double jet was executed through adding total amount of the solution A at a constant flow rate over 32 minutes, accompanied by adding the solution B while maintaining the pAg at 10.2. Thereafter, 10 mL of a 3.5% by weight aqueous solution of hydrogen peroxide was added thereto, and 10.8 mL of a 10% by weight aqueous solution of benzimidazole was further added.

Moreover, a solution C prepared through diluting 51.86 g of silver nitrate by adding distilled water to give the volume of 508.2 mL and a solution D prepared through diluting 63.9 g of potassium iodide with distilled water to give the volume of 639 mL and adding 88 mL of a 3.57% by weight methanol solution of 1,3-dimethyl-imidazolidin-2-thione were added. A method of controlled double jet was executed through adding total amount of the solution C at a constant flow rate over 160 minutes, accompanied by adding the solution D while maintaining the pAg at 10.2. Hexachloroiridium (III) potassium salt was added in its entirety to give $1\times10^{-4}$ mol per 1 mol of silver, at 20 minutes post initiation of the addition of the solution C and the solution D. Moreover, at 5 seconds after completing the addition of the solution C, a potassium iron (II) hexacyanide aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce the silver halide emulsion-110 having the pAg of 11.0.

Preparation of silver halide emulsion-111 was conducted in a similar manner to the process in the preparation of silver halide emulsion-110, except that changing the amounts of the 3.57% by weight methanol solution of 1,3-dimethyl-imidazolidin-2-thione added to the solutions B and D to 100 mL and 176 mL, respectively.

Preparation of silver halide emulsion-112 was conducted in a similar manner to the process in the preparation of silver halide emulsion-110, except that changing the amounts of the 3.57% by weight methanol solution of 1,3-dimethyl-imidazolidin-2-thione added to the solutions B and D to 200 mL and 352 mL, respectively.

(Preparation of Solver Halide Emulsion-113 —for comparision—)

Preparation of silver halide emulsion-113 was conducted in a similar manner to the process in the preparation of silver halide emulsion-101, except that not adding the 5% by weight methanol solution of 2,2'-(ethylene dithio)diethanol.

(Evaluation of Silver Halide Emulsion-101 to -113)

The grain forms of the silver halide emulsions prepared above were summarized in the following Table 4.

From the data in Table 4, it is apparent that, by coexisting a silver halide solvent when forming high silver iodide grains, it is possible to make the equivalent spherical diameter of the silver iodide grain big and to regulate the grain form to be tabular grain having a high aspect ratio. Further, it is found that tabular grains having higher aspect ratio can be obtained by subsequently adding a silver halide solvent during grain formation.

TABLE 4

| Emulsion No. | Composition | Dc | Th | AR | Dsp |
|---|---|---|---|---|---|
| 101 | AgI | 0.72 | 0.060 | 12.0 | 0.36 |
| 102 | AgI | 0.86 | 0.045 | 19.1 | 0.37 |
| 103 | AgI | 2.10 | 0.150 | 14.0 | 1.00 |

TABLE 4-continued

| Emulsion No. | Composition | Dc | Th | AR | Dsp |
|---|---|---|---|---|---|
| 104 | AgI | 0.72 | 0.024 | 30.0 | 0.27 |
| 105 | AgI | 1.20 | 0.035 | 34.3 | 0.42 |
| 106 | AgI | 3.40 | 0.080 | 42.5 | 1.12 |
| 107 | AgI | 1.20 | 0.051 | 23.5 | 0.48 |
| 108 | AgI | 1.40 | 0.071 | 19.7 | 0.59 |
| 109 | AgI | 2.20 | 0.110 | 20.0 | 0.93 |
| 110 | AgI | 1.10 | 0.024 | 45.8 | 0.35 |
| 111 | AgI | 1.70 | 0.039 | 43.6 | 0.55 |
| 112 | AgI | 2.40 | 0.069 | 34.8 | 0.84 |
| 113 | AgI | 0.21 | 0.110 | 1.90 | 0.19 |

In th table, Dc, Th, AR, and Dsp represent an equivalent circular diameter, a thickness, an aspect ratio, and an equivalent spherical diameter, respectively.

Example 5

(Preparations of Silver Halide Emulsion-114 to -118)

1 mol of the silver halide emulsion-102 of Example 4 was added to the reaction vessel. 0.5 mol/L potassium bromide solution and 0.5 mol/L silver nitrate solution were added at an addition speed of 10 mL/min over 20 minutes by the method of double jet addition to precipitate substantially a 10 mol % of silver bromide on the host silver iodide grains as epitaxial form while keeping the pAg at 10.2 during the operation. Furthermore, the mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

The above-mentioned silver halide dispersion was kept at 38° C. with stirring, and thereto was added 5 mL of a 0.34% by weight methanol solution of 1,2-benzoisothiazoline-3-one, and after 40 minutes the temperature ws elevated to 47° C. At 20 minutes after elevating the temperature, sodium benzene thiosulfonate in a methanol solution was added at $7.6\times10^{-5}$ mol per 1 mol of silver. At additional 5 minutes later, a tellurium sensitizer C in a methanol solution was added at $2.9\times10^{-5}$ mol per 1 mol of silver and subjected to ripening for 91 minutes. And then, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureidophenyl)-5-mercaptotetrazole in an aqueous solution at $8.5\times10^{-3}$ mol per 1 mol of silver were added to produce silver halide emulsion-114.

The silver halide grains in the resulting silver halide dispersion were high silver iodide grains having a silver bromide content of 10 mol %, and the grains have a mean projected area equivalent diameter of 0.86 μm, a variation coefficient of a projected area equivalent diameter distribution of 17.7%, a mean thickness of 0.045 μm and a mean aspect ratio of 19.1. Tabular grains having an aspect ratio of 2 or more occupied 80% or more of the total projected area. The equivalent spherical diameter of the grains was 0.37 μm. 30% or more of the silver iodide existed in γ phase from the result of powder X-ray diffraction analysis.

Preparations of silver halide emulsion-115 to -118 were conducted in a similar manner to the process in the preparation of silver halide emulsion-114, except that the silver halide emulsion added into the reaction vessel was changed to silver halide emulsion-105, -108, -111 and -113 respectively, instead of using silver halide emulsion-102.

The silver halide grains in the resulting silver halide dispersion were tabular grains having an epitaxial junction structure on its corner position.

Example 6

1. Preparation of Coated Sample 1-1. Undercoating of the Support

It was done similar to Example 2.

1-2. Coating of Photosensitive Layer

On both sides of the undercoated support mentioned above, simultaneous coating by an extrusion method was subjected in order of the crossover cut layer, silver halide emulsion layer and surface protective layer from the support side and dried.

1) Crossover Cut Layer

It was prepared similar to Example 2.

2) Silver Halide Emulsion Layer

Each component was added to the emulsion to make the following coating amount. The coating amount of each component per 1 $m^2$ on one side of the support is shown below.

| | |
|---|---|
| Coating amount of coated silver | 1.8 g |
| Gelatin | 1.7 g |
| Dextrane (average molecular weight: 39,000) | 428 mg |
| Sodium polystyrenesulfonate (average molecular weight: 600,000) | 40 mg |
| A-2 | 204 mg |
| A-3 | 2.2 mg |
| A-4 | 0.5 mg |
| A-5 | 2.8 mg |
| 1,2-Bis(vinyl sulfonylacetamide)ethane | 50 mg |

Therein the amount of coating solution for the silver halide emulsion layer was 45.2 mL per 1 $m^2$ on one side of the support.

3) Surface Protective Layer

A surface protective layer was disposed similar to Example 2.

2. Evaluation of Photographic Properties

1) Exposure and Development

Exposure and development were performed similar to Example 2.

2) Evaluation Terms (Evaluations of Sensitivity and Fog)

They were done similar to Example 2. Sensitivity is expressed in terms of a relative value based on the sensitivity obtained for Sample No. 101, which is taken as 100.

(Evaluation of Image Storability (Print-out Resistance))

It was done similar to Example 2.

3) Result of Evaluation

The results are shown in Table 5.

It is apparent from the data shown in Table 5 that the photothermographic materials using the tabular grains of the present invention is excellent in exhibiting high sensitivity and low fog, and also excellent in image storability at the storage after processing.

TABLE 5

| Sample No. | Emulsion No. | Sensitivity | Fog | Image Storability |
|---|---|---|---|---|
| 101 | 14 | 100 | 0.12 | 0.01 |
| 102 | 15 | 137 | 0.12 | 0.01 |
| 103 | 16 | 220 | 0.12 | 0.02 |
| 104 | 17 | 240 | 0.12 | 0.01 |
| 105 | 18 | 71 | 0.12 | 0.01 |

Example 7

1. Preparation of PET Support and Undercoating

Preparation of PET support and undercoating were conducted similar to Example 3.

2. Preparations of Coating Materials

1) Prepartations of Mixed Emulsion 114 to 118 for Coating Solution

Each of the silver halide emulsion-114 to -118 prepared in Example 5 were dissolved, and thereto was added benzothiazolium iodide in a 1% by weight aqueous solution at $7\times10^{-3}$ mol per 1 mol of silver. Further, as "a compound that can be one-electron-oxidized to provide a one-electron oxidation product, which releases one or more electrons", the compounds Nos. 1, 2, and 3 were added respectively in an amount of $2\times10^{-3}$ mol per 1 mol of silver in silver halide.

Thereafter, as "a compound having an adsorptive group and a reducible group", the compound Nos. 1, 2, and 3 were added respectively in an amount of $8\times10^{-3}$ mol per 1 mol of silver halide.

Further, water was added thereto to give the content of silver halide of 15.6 g in terms of silver, per 1 liter of the mixed emulsion for a coating solution.

2) Preparation of Silver Salt of Fatty Acid

It was done similar to Example 3.

3) Preparations of Reducing Agent Dispersion

They were done similar to Example 3.

4) Preparation of Hydrogen Bonding Compound Dispersion

It was done similar to Example 3.

5) Preparations of Dispersions of Development Accelerator and Color-Tone-Adjusting Agent They were done similar to Example 3.

6) Preparations of Organic Polyhalogen Compound Dispersion

They were done similar to Example 3.

7) Preparation of Silver Iodide Complex-forming Agent

It was done similar to Example 3.

8) Preparations of Aqueous Solution of Mercapto Compound

They were done similar to Example 3.

9) Preparation of SBR Latex Solution

It was done similar to Example 3.

3. Preparations of Coating Solution

1) Preparations of Coating Solution for Image Forming Layer-114 to -118

Preparations of coating solution for image forming layer-114 to -118 were conducted similar to Example 3 except that using mixed emulsion 114 to 118 for coating solution as photosensitive silver halide emulsion.

2) Preparation of Coating Solution for Intermediate Layer

It was done similar to Example 3.

3) Preparation of Coating Solution for First Layer of Surface Protective Layers

It was done similar to Example 3.

4) Preparation of Coating Solution for Second Layer of Surface Protective Layers It was done similar to Example 3.

4. Preparations of Photothermographic Material-106 to -110

Simultaneous overlaying coating by a slide bead coating method was subjected in order of the image forming layer, intermediate layer, first layer of the surface protective layers and second layer of the surface protective layers, starting from the undercoated face, and thus samples of the photothermographic material were produced. In this method, the temperature of the coating solution was adjusted to 31° C. for the image forming layer and intermediate layer, to 36° C. for the first layer of the surface protective layers, and to 37° C. for the second layer of the surface protective layers. The coating amount of silver in the image forming layer is 0.821 $g/m^2$ per one side with respect to total amount of silver contained in silver salt of fatty acid and silver halide. This coating was performed on both sides of the support.

The coating amount of each compound ($g/m^2$) for the image forming layer per one side is as follows.

| | |
|---|---|
| Silver salt of fatty acid | 2.80 |
| Organic polyhalogen compound-1 | 0.028 |
| Organic polyhalogen compound-2 | 0.094 |
| Silver iodide complex-forming agent | 0.46 |
| SBR latex | 5.20 |
| Reducing agent-1 | 0.33 |
| Reducing agent-2 | 0.13 |
| Hydrogen bonding compound-1 | 0.15 |
| Development accelerator-1 | 0.005 |
| Development accelerator-2 | 0.035 |
| Color-tone-adjusting agent-1 | 0.002 |
| Mercapto compound-1 | 0.001 |
| Mercapto compound-2 | 0.003 |
| Silver halide (on the basis of Ag content) | 0.146 |

Conditions for coating and drying were similar to those of Example 3.

Thus prepared photothermographic material had the matt degree of 550 seconds as Beck's smoothness. In addition, measurement of the pH of the film surface gave the result of 6.0.

5. Evaluation

1) Exposure and Development

Exposure and development were done similar to Example 3.

2) Evaluation Terms (Evaluations of Sensitivity and Fog)

They were done similar to Example 3. Sensitivity is expressed in terms of a relative value based on the sensitivity obtained for Sample No. 114, which is taken as 100.

(Evaluation of Image Storability (Print-out Resistance))

It was done similar to Example 3.

4) Result of Evaluation

The results are shown in Table 6.

It is apparent from the data shown in Table 6 that the photothermographic materials using the tabular grains of the present invention is excellent in exhibiting high sensitivity and low fog, and also excellent in image storability at the storage after processing.

On the other hand, RX-U regular film for wet developing system produced by Fuji Photo Film Co., Ltd. was subjected to exposure as the same condition as above, and processed for 45 seconds with the automatic photographic processor CEPROS-M2 and Developer CE-D1, both produced by Fuji Photo Film Co., Ltd.

As a result of comparing photographic properties of both images, which were obtained from the photothermographic material of the invention and from the wet developing system, similar excellent properties are attained.

TABLE 6

| Sample No. | Emulsion No. | Sensitivity | Fog | Image Storability (ΔDmin) |
|---|---|---|---|---|
| 106 | 14 | 100 | 0.12 | 0.02 |
| 107 | 15 | 128 | 0.12 | 0.02 |
| 108 | 16 | 174 | 0.12 | 0.02 |
| 109 | 17 | 194 | 0.12 | 0.02 |
| 110 | 18 | 75 | 0.12 | 0.02 |

Example 8

1. Preparations of Photosensitive Silver Halide Emulsion (Preparation of Silver Halide Emulsion-201)

A solution was prepared by adding 8 mL of a 10% by weight potassium iodide solution, and then 12 mL of 1 mol/L sodium hydroxide, 10 g of alkali processed gelatin, and 25 mL of a 5% by weight methanol solution of 2,2'-(ethylenedithio)-diethanol to 1421 mL of distilled water. The solution was kept at 75° C. while stirring in a stainless steel reaction vessel, and therefore added total amount of: solution A prepared through diluting 22.22 g of silver nitrate by adding distilled water to give the volume of 218 mL; and solution B prepared through diluting 36.6 g of potassium iodide with distilled water to give the volume of 366 mL. A method of controlled double jet was executed through adding total amount of the solution A at a constant flow rate over 32 minutes, accompanied by adding the solution B while maintaining the pAg at 10.2. Thereafter, 10 mL of a 3.5% by weight aqueous solution of hydrogen peroxide was added thereto, and 10.8 mL of a 10% by weight aqueous solution of benzimidazole was further added.

Thereafter, a solution C prepared through diluting 51.86 g of silver nitrate by adding distilled water to give the volume of 508.2 mL and a solution D prepared through diluting 63.9 g of potassium iodide with distilled water to give the volume of 639 mL were added. A method of controlled double jet was executed through adding total amount of the solution C at a constant flow rate over 160 minutes, accompanied by adding the solution D while maintaining the pAg at 10.2. Hexachloroiridium (III) potassium salt was added in its entirety to give $1\times10^{-4}$ mol per 1 mol of silver, at 20 minutes post initiation of the addition of the solution C and the solution D. Moreover, at 5 seconds after completing the addition of the solution C, a potassium iron (II) hexacyanide aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide emulsion-201 having the pAg of 11.0.

The silver halide grains in the resulting silver halide emulsion-201 were pure silver iodide grains having a mean projected area equivalent diameter of 0.72 μm, a variation coefficient of a projected area equivalent diameter distribution of 28.7%, a mean thickness of 0.14 μm, and a mean aspect ratio of 4.2. Tabular grains having an aspect ratio of 2 or more occupied 80% of the total projected area. 30% or more of the silver iodide existed in γ phase from the result of powder X-ray diffraction analysis.

(Preparations of Silver Halide Emulsion-202 to -210)

Preparations of silver halide emulsion-202 to -210 were conducted in a similar manner to the process in the preparation of silver halide emulsion-201, except that using each kind of modified gelatin shown in Table 7 as gelatin. The amount of used gelatin was 10 g. In the table, modification ratio of amino groups of each gelatin, which is calculated by formol titration method, is described.

TABLE 7

| Emulsion No. | Gelatin | Modification Ratio of Amino Groups(%) |
|---|---|---|
| 202 | Phthalated gelatin | 22.1 |
| 203 | Phthalated gelatin | 58.0 |
| 204 | Phthalated gelatin | 96.3 |
| 205 | Succinated gelatin | 24.0 |
| 206 | Succinated gelatin | 62.0 |
| 207 | Succinated gelatin | 95.4 |
| 208 | Trimellitated gelatin | 21.0 |
| 209 | Trimellitated gelatin | 59.2 |
| 210 | Trimellitated gelatin | 95.7 |

3) Evaluation of Silver Halide Emulsion-201 to -210

The forms of silver halide grains prepared above are summarized in the following Table 8.

From the data in Table 8, it is apparent that the amino group-modified gelatin has a big effect on reducing thickness of silver halide grains when compared with gelatin whose amino groups are not processed.

TABLE 8

| Emulsion No. | Shape | Dc(μm) | Th(μm) | AR | Dsp(μm) |
|---|---|---|---|---|---|
| 201 | Tetradeca hedron | 0.64 | 0.120 | 5.4 | 0.42 |
| 202 | Tetradeca hedron | 0.71 | 0.073 | 9.7 | 0.38 |
| 203 | Tetradeca hedron | 0.88 | 0.051 | 17.3 | 0.39 |
| 204 | Tetradeca hedron | 1.09 | 0.031 | 35.0 | 0.38 |
| 205 | Tetradeca hedron | 0.81 | 0.076 | 10.6 | 0.42 |
| 206 | Tetradeca hedron | 0.92 | 0.054 | 17.1 | 0.41 |
| 207 | Tetradeca hedron | 1.20 | 0.037 | 32.4 | 0.43 |
| 208 | Tetradeca hedron | 0.86 | 0.082 | 10.5 | 0.45 |
| 209 | Tetradeca hedron | 0.96 | 0.062 | 15.4 | 0.44 |
| 210 | Tetradeca hedron | 1.15 | 0.043 | 26.7 | 0.44 |

In the table, Dc, Th, AR, and Dsp represent equivalent circular diameter, thickness, aspect ratio, and equivalent spherical diameter, respectively.

Example 9

1. Preparations of Silver Halide Emulsion-211 to -220

1 mol of the silver halide emulsion-201 to -210 prepared above in Example 8 was added to the reaction vessel. 0.5 mol/L potassium bromide solution and 0.5 mol/L silver nitrate solution were added at an addition speed of 10 mL/min over 12 minutes by the method of double jet addition to precipitate substantially a 10 mol % of silver bromide on the host silver iodide grains as epitaxial form while keeping the pAg at 10.2 during the operation. Furthermore, the mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

The above silver halide dispersion was kept at 38° C. with stirring, and thereto was added 5 mL of a 0.34% by weight methanol solution of 1,2-benzoisothiazoline-3-one, and after 40 minutes the temperature was elevated to 47° C. At 20 minutes after elevating the temperature, sodium benzene thiosulfonate in a methanol solution was added at $7.6\times10^{-5}$ mol per 1 mol of silver. At additional 5 minutes later, a tellurium sensitizer C in a methanol solution was added at $2.9\times10^{-5}$ mol per 1 mol of silver and subjected to ripening for 91 minutes. And then, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureido phenyl)-5-mercaptotetrazole in an aqueous solution at $8.5\times10^{-3}$ mol per 1 mol of silver were added to produce silver halide emulsion-211 to -220.

2. Preparations of Coated Sample 2-1. Undercoating of the Support

Prepartion of undercoated support was conducted similar to Example 2.

2-2. Coating of Photosensitive Layer

On both sides of the undercoated support mentioned above, simultaneous coating by an extrusion method was subjected in order of the crossover cut layer, silver halide emulsion layer and surface protective layer from the support side and dried.

1) Crossover Cut Layer

It was disposed similar to Example 2.

2) Silver Halide Emulsion Layer

Each component was added to each emulsion to make the following coating amount. The coating amount of each component per 1 $m^2$ on one side of the support is shown below.

| | |
|---|---|
| Coating amount of coated silver | 1.8 g |
| Gelatin | 1.7 g |
| Dextrane (average molecular weight: 39,000) | 428 mg |
| Sodium polystyrenesulfonate (average molecular weight: 600,000) | 40 mg |
| A-2 | 204 mg |
| A-3 | 2.2 mg |
| A-4 | 0.5 mg |
| A-5 | 2.8 mg |
| 1,2-Bis(vinyl sulfonylacetamide)ethane | 50 mg |

Therein the amount of coating solution for the silver halide emulsion layer was 45.2 mL per 1 $m^2$ on one side of the support.

3) Surface Protective Layer

It was disposed similar to Example 2.

3. Evaluation of Photographic Properties

1) Exposure and Development

They were performed similar to Example 2.

2) Evaluation Terms (Sensitivity and Fog)

They were done similar to Example 2. Sensitivity is expressed in terms of a relative value based on the sensitivity obtained for coated Sample No. 201, which is taken as 100.

(Image Storability (Print-out Resistance))

The obtained image was left under a fluorescent lamp with an intensity of 1000 lux for 24 hours, and the increment of the fog at fog part (ΔDmin part) was evaluated. The smaller the value is, the more excellent in image storability (print-out resistance).

(Raw Stock Storability)

Raw stock storability means a storage stability in the period after production of photothermographic material and before thermal development.

The coated sample was stored for 16 hours under the forced aging environment of 60° C. and 40% RH. Thereafter the sample was given back to ordinary temperature and ordinary humidity, and was exposed and developed. Sensitivity of the obtained image was measured. The ratio of this sensitivity to the sensitivity of the image which was obtained by being not stored under the environment of 60° C. and 40% RH and exposed and developed. The nearer to 1 is the value, the smaller the variation of sensitivity and more excellent in raw stock storability.

3) Result of Evaluation

The results are shown in Table 9.

It is apparent from the data shown in Table 9 that the photothermographic materials using the tabular grains of the present invention is excellent in exhibiting high sensitivity and low fog, and also excellent in image storability at the storage after processing.

Particularly, taking the grain size into consideration, the sensitivity of the high silver iodide content tabular grains which are formed in the presence of gelatin with high ratio of phthalated amino groups is excellent.

TABLE 9

| Sample No. | Emulsion No. | Sensitivity | Fog | Image Storability | Storability before Processing |
|---|---|---|---|---|---|
| 201 | 211 | 100 | 0.18 | 0.03 | 0.82 |
| 202 | 212 | 93 | 0.17 | 0.01 | 0.92 |
| 203 | 213 | 107 | 0.17 | 0.01 | 0.94 |
| 204 | 214 | 120 | 0.17 | 0.01 | 0.95 |
| 205 | 215 | 125 | 0.17 | 0.01 | 0.89 |
| 206 | 216 | 141 | 0.17 | 0.01 | 0.89 |
| 207 | 217 | 158 | 0.17 | 0.01 | 0.92 |
| 208 | 218 | 121 | 0.17 | 0.01 | 0.89 |
| 209 | 219 | 136 | 0.17 | 0.01 | 0.91 |
| 210 | 220 | 149 | 0.17 | 0.01 | 0.92 |

Example 10

1. Preparation of PET Support and Undercoating 1-1. Film Manufacturing

It was done similar to Example 3.

1-2. Surface Corona Discharge Treatment

It was done similar to Example 3.

1-3. Preparation of Undercoated Support

It was done similar to Example 3.

2. Preparations of Coating Materials

1) Preparations of Mixed Emulsion 211 to 220 for Coating Solution

Each of the silver halide emulsion-211 to -220 prepared in Example 9 were dissolved, and thereto was added benzothiazolium iodide in a 1% by weight aqueous solution at $7\times10^{-3}$ mol per 1 mol of silver.

Further, as "a compound that can be one-electron-oxidized to provide a one-electron oxidation product, which releases one or more electrons", the compounds Nos. 1, 2, and 3 were added respectively in an amount of $2\times10^{-3}$ mol per 1 mol of silver in silver halide.

Thereafter, as "a compound having an adsorptive group and a reducible group", the compound Nos. 1, 2, and 3 were added respectively in an amount of $8\times10^{-3}$ mol per 1 mol of silver halide.

Further, water was added thereto to give the content of silver halide of 15.6 g in terms of silver, per 1 liter of the mixed emulsion for a coating solution.

2) Preparation of Silver Salt of Fatty Acid

It was done similar to Example 3.

3) Preparations of Reducing Agent Dispersion

They were done similar to Example 3.

4) Preparation of Hydrogen Bonding Compound Dispersion

It was done similar to Example 3.

5) Preparations of Dispersions of Development Accelerator and Color-tone-adjusting Agent They were done similar to Example 3.

6) Preparations of Organic Polyhalogen Compound Dispersion

They were done similar to Example 3.

7) Preparation of Silver Iodide Complex-forming Agent

It was done similar to Example 3.

8) Preparations of Aqueous Solution of Mercapto Compound

They were done similar to Example 3.

9) Preparation of SBR Latex Solution

It was done similar to Example 3.

3. Preparations of Coating Solution

1) Preparations of Coating Solution for Image Forming Layer-211 to -220

To the dispersion of the silver salt of fatty acid obtained as described above in an amount of 1000 g and 276 mL of water were serially added the organic polyhalogen compound-1 dispersion, the organic polyhalogen compound-2 dispersion, the SBR latex (Tg: 17° C.) solution, the reducing agent-1 dispersion, the reducing agent-2 dispersion, the hydrogen bonding compound-1 dispersion, the development accelerator-1 dispersion, the development accelerator-2 dispersion, the color-tone-adjusting agent-1 dispersion, the mercapto compound-1 aqueous solution, and the mercapto compound-2 aqueous solution. After adding thereto the silver iodide complex-forming agent, the mixed emulsion 211 to 220 for coating solution was added thereto in an amount of 0.22 mol per 1 mol of silver salt of fatty acid, followed by thorough mixing just prior to the coating, which was fed directly to a coating die, and was coated.

2) Preparation of Coating Solution for Intermediate Layer

It was done similar to Example 3.

3) Preparation of Coating Solution for First Layer of Surface Protective Layers

It was done similar to Example 3.

4) Preparation of Coating Solution for Second Layer of Surface Protective Layers It was done similar to Example 3.

4. Preparations of Photothermographic Material-211 to -220

Simultaneous overlaying coating by a slide bead coating method was subjected in order of the image forming layer, intermediate layer, first layer of the surface protective layers and second layer of the surface protective layers, starting from the undercoated face, and thus samples of the photothermographic material were produced. In this method, the temperature of the coating solution was adjusted to 31° C. for the image forming layer and intermediate layer, to 36° C. for the first layer of the surface protective layers, and to 37° C. for the second layer of the surface protective layers. The coating amount of silver in the image forming layer was 0.821 g/m$^2$ per one side with respect to total amount of silver contained in silver salt of fatty acid and silver halide. This coating was performed on both sides of the support.

The coating amount of each compound (g/m$^2$) for the image forming layer per one side is as follows.

| | |
|---|---|
| Silver salt of fatty acid | 2.80 |
| Organic polyhalogen compound-1 | 0.028 |
| Organic polyhalogen compound-2 | 0.094 |
| Silver iodide complex-forming agent | 0.46 |
| SBR latex | 5.20 |
| Reducing agent-1 | 0.33 |
| Reducing agent-2 | 0.13 |
| Hydrogen bonding compound-1 | 0.15 |
| Development accelerator-1 | 0.005 |
| Development accelerator-2 | 0.035 |
| Color-tone-adjusting agent-1 | 0.002 |
| Mercapto compound-1 | 0.001 |
| Mercapto compound-2 | 0.003 |
| Silver halide (on the basis of Ag content) | 0.146 |

Conditions for coating and drying were similar to those of Example 3.

Thus prepared photothermographic material had the matt degree of 550 seconds as Beck's smoothness. In addition, measurement of the pH of the film surface gave the result of 6.0.

5. Evaluation

1) Exposure and Development

Exposure and development were performed similar to Example 3.

2) Evaluation Terms (Evaluations of Sensitivity and Fog)

They were done similar to Example 3. Sensitivity is expressed in terms of a relative value based on the sensitivity obtained for Sample No. 211, which is taken as 100.

(Evaluation of Image Storability (Print-out resistance))

It was done similar to Example 3.

(Evaluation of Raw Stock Storability)

Each prepared sample was stored for 16 hours under the environment of 60° C. and 40% RH. Thereafter the sample was given back to ordinary temperature and ordinary humidity, and was exposed and developed. Sensitivity of the obtained image was measured. The ratio of this sensitivity to the sensitivity of the image which was obtained by being not stored under the environment of 60° C. and 40% RH and exposed and developed. The nearer to 1 is the value, the smaller the variation of sensitivity and more excellent in raw stock storability.

3) Result of Evaluation

The results are shown in Table 10.

It is apparent from the data shown in Table 10 that the photothermographic materials using the tabular grains of the present invention is excellent in exhibiting high sensitivity and low fog, and also excellent in image storability at the storage after processing.

Particularly, taking the grain size into consideration, the sensitivity of the high silver iodide content tabular grains which is formed in the presence of gelatin with high ratio of phthalated amino groups is excellent. Further, concerning the storability before processing, the high silver iodide content tabular grains which are formed in the presence of gelatin with high ratio of phthalated amino groups are excellent, and exhibit excellent properties in photothermographic material.

On the other hand, RX-U regular film for wet developing system produced by Fuji Photo Film Co., Ltd. was subjected to exposure as the same condition as above, and processed for 45 seconds with the automatic photographic processor CEPROS-M2 and Developer CE-D1, both produced by Fuji Photo Film Co., Ltd.

As a result of comparing photographic properties of both images, which were obtained from the photothermographic material of the invention and from the wet developing system, similar excellent properties are attained.

TABLE 10

| Sample No. | Emulsion No. | Sensitivity | Fog | Image Storability | Storability before Processing |
|---|---|---|---|---|---|
| 211 | 211 | 100 | 0.18 | 0.03 | 0.74 |
| 212 | 212 | 97 | 0.17 | 0.01 | 0.88 |
| 213 | 213 | 111 | 0.17 | 0.01 | 0.90 |
| 214 | 214 | 129 | 0.17 | 0.01 | 0.93 |
| 215 | 215 | 127 | 0.17 | 0.01 | 0.86 |
| 216 | 216 | 134 | 0.17 | 0.01 | 0.87 |
| 217 | 217 | 156 | 0.17 | 0.01 | 0.90 |
| 218 | 218 | 126 | 0.17 | 0.01 | 0.86 |
| 219 | 219 | 142 | 0.17 | 0.01 | 0.88 |
| 220 | 220 | 159 | 0.17 | 0.01 | 0.91 |

What is claimed is:

1. A photothermographic material comprising, on at least one surface of a support, at least a photosensitive silver halide, a non-photosensitive organic silver salt, a reducing agent and a binder, wherein the material contains a silver iodide complex-forming agent, and wherein 1) the photosensitive silver halide has an average silver iodide content of 40 mol % or higher,
2) 50% or more of a total projected area of the photosensitive silver halide is occupied by tabular grains having an aspect ratio of 2 or more, and
3) a mean equivalent spherical diameter of the photosensitive silver halide grains is from 0.2 μm to 5 μm and a variation coefficient of an equivalent spherical diameter distribution of the photosensitive silver halide grains is 30% or less.

2. The photothermographic material according to claim 1, wherein a mean equivalent circular diameter of the photosensitive silver halide grains is from 0.2 μm to 5 μm and a variation coefficient of an equivalent circular diameter distribution of the photosensitive silver halide grains is 30% or less.

3. The photothermographic material according to claim 1, wherein the average silver iodide content is 80 mol % or higher.

4. The photothermographic material according to claim 1, wherein the average silver iodide content is 90 mol % or higher.

5. The photothermographic material according to claim 1, wherein the aspect ratio is from 5 to 200.

6. A method for preparing a photosensitive silver halide for use in a photothermographic material according to claim 1, wherein grains are formed in the presence of at least one substance selected from an amino group-modified gelatin in which 20% or more of all of the amino groups are modified and a silver halide solvent.

7. The method for preparing a photosensitive silver halide according to claim 6, wherein the grains are formed in the presence of the silver halide solvent.

8. The method for preparing a photosensitive silver halide according to claim 6, wherein the grains are formed in the presence of the amino group-modified gelatin in which 20% or more of all of the amino groups are modified.

9. The method for preparing a photosensitive silver halide according to claim 6, wherein the grains are formed in the presence of the amino group-modified gelatin in which 20% or more of all of the amino groups are modified and the silver halide solvent.

10. The method for preparing a photosensitive silver halide according to claim 7, wherein an amount of the silver halide solvent being added is increased while the grains are formed.

11. The method for preparing a photosensitive silver halide according to claim 7, wherein the silver halide solvent is present from the beginning of nucleation.

12. The method for preparing a photosensitive silver halide according to claim 7, wherein the silver halide solvent is a compound containing at least one atom selected from a sulfur atom, a selenium atom, and a tellurium atom.

13. The method for preparing a photosensitive silver halide according to claim 12, wherein the silver halide solvent is a compound represented by formula (I):

$$L_{a1}\text{-}(A_{a1}\text{-}L_{a2})r\text{-}A_{a2}\text{-}L_{a3} \qquad \text{Formula (I)}$$

wherein $L_{a1}$ and $L_{a3}$ each independently represent one selected from an aliphatic group, an aromatic hydrocarbon group, and a heterocyclic group, and $L_{a2}$ represents one selected from a divalent aliphatic group, a divalent aromatic hydrocarbon group, a divalent substituted or unsubstituted heterocyclic linking group, and a linking group made up of a combination thereof; $A_{a1}$ and $A_{a2}$ each independently represent one selected from —S—, —Se—, —Te—, —O—, —$NR_{a20}$—, —CO—, —$SO_2$—, and a group made up of a combination thereof; r represents an integer from 0 to 10; $L_{a1}$ and $L_{a3}$ may be substituted by one selected from —$SO_3M_{a1}$, —$PO_3M_{a2}M_{a3}$, —$NR_{a1}(R_{a2})$, —$N^+R_{a3}(R_{a4})(R_{a5}).X_{a1}^-$, —$SO_2NR_{a6}(R_{a7})$, —$NR_{a8}SO_2R_{a9}$, —$CONR_{a10}(R_{a11})$, —$NR_{a12}COR_{a13}$, —$SO_2R_{a14}$, —$PO(—NR_{a15}(R_{a16}))_2$, —$NR_{a17}CONR_{a18}(R_{a19})$, —$COOM_{a4}$, and a heterocyclic group; $M_{a1}$, $M_{a2}$, $M_{a3}$, and $M_{a4}$ each independently represent one selected from a hydrogen atom and a counter cation; $R_{a1}$ to $R_{a20}$ each independently represent one selected from a hydrogen atom, an aliphatic group, and an aromatic hydrocarbon group; and $X_{a1}^-$ represents an anion; provided that at least one of $A_{a1}$ and $A_{a2}$ represents one selected from —S—, —Se—, and —Te—.

14. The method for preparing a photosensitive silver halide according to claim 12, wherein the silver halide solvent is a compound represented by formula (II):

Formula (II)

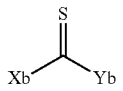

wherein $X_b$ and $Y_b$ each independently represent one selected from an aliphatic group, an aromatic hydrocarbon group, a heterocyclic group, —$N(R_{b1})R_{b2}$, —$N(R_{b3})N(R_{b4})R_{b5}$, —$OR_{b6}$, and —$SR_{b7}$; $X_b$ and $Y_b$ may form a ring; $X_b$ and $Y_b$ each may be substituted by one selected from the group consisting of a carboxylic acid, a salt thereof, a sulfonic acid, a salt thereof, an amino group, an ammonium group, and a hydroxy group; $R_{b1}$, $R_{b2}$, $R_{b3}$, $R_{b4}$, and $R_{b5}$ independently represent one of a hydrogen atom, an aliphatic group, an aromatic hydrocarbon group, and a heterocyclic group; and $R_{b6}$ and $R_{b7}$ each independently represent one of a hydrogen atom, a cation, an aliphatic group, an aromatic hydrocarbon group, and a heterocyclic group.

15. The method for preparing a photosensitive silver halide according to claim 8, wherein the amino group-modified gelatin is a gelatin having at least one carboxyl group newly introduced when the amino groups are chemically modified.

16. The method for preparing a photosensitive silver halide according to claim 15, wherein the gelatin is a gelatin having amino groups modified by phthalation.

17. The method for preparing a photosensitive silver halide according to claim 15, wherein the gelatin is a gelatin having amino groups modified by trimellitation.

18. The method for preparing a photosensitive silver halide according to claim 15, wherein the gelatin is a gelatin having amino groups modified by pyromellitation.

19. The method for preparing a photosensitive silver halide according to claim 15, wherein the gelatin is a gelatin having amino groups modified by succination.

20. The photothermographic material according to claim 1, wherein the silver iodide complex-forming agent is a compound represented by formula (C3):

Formula (C3)

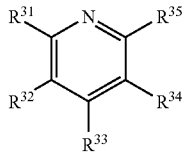

wherein $R^{31}$ to $R^{35}$ each independently represent a hydrogen atom or a substituent.

21. The photothermographic material according to claim 20, wherein the substituent in $R^{31}$ to $R^{35}$ is a halogen atom, an alkyl group, an aryl group, a carbamoyl group, a hydroxy group, an alkoxy group, an aryloxy group, a carbamoyloxy group, an amino group, an acylamino group, an ureido group, an alkoxycarbonylamino group, or an aryloxycarbonylamino group.

22. The photothermographic material according to claim 1, wherein the silver iodide complex-forming agent is a compound represented by formula (C4):

Formula (C4)

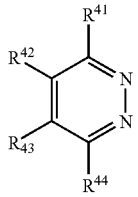

wherein $R^{41}$ to $R^{44}$ each independently represent a hydrogen atom or a substituent.

23. The photothermographic material according to claim 22, wherein the substituent in $R^{41}$ to $R^{44}$ is an alkyl group, an alkenyl group, an alkynyl group, an aryl group, a hydroxy group, an alkoxy group, an aryloxy group, or a hetecyclic oxy group.

24. The photothermographic material according to claim 1, wherein the silver iodide complex-forming agent is a compound represented by formula (C5):

Formula (C5)

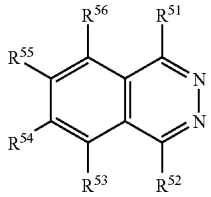

wherein $R^{51}$ to $R^{56}$ each independently represent a hydrogen atom or a substituent.

25. The photothermographic material according to claim 24, wherein the substituent in $R^{51}$ to $R^{56}$ is an alkyl group, an alkenyl group, an alkynyl group, an aryl group, a hydroxy group, an alkoxy group, or an aryloxy group.

* * * * *